US006994220B2

(12) United States Patent
Schererz et al.

(10) Patent No.: US 6,994,220 B2
(45) Date of Patent: Feb. 7, 2006

(54) MIXED MAIL SORTING MACHINE

(75) Inventors: Holger Schererz, Rehfelde (DE); Dieter Powollik, Berlin (DE); Peter Enenkel, Konstanz (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/969,274

(22) Filed: Oct. 2, 2001

(65) Prior Publication Data

US 2002/0070149 A1 Jun. 13, 2002

Related U.S. Application Data

(60) Provisional application No. 60/242,299, filed on Oct. 2, 2000.

(51) Int. Cl.
*B07C 5/02* (2006.01)

(52) U.S. Cl. ..... 209/539; 209/540; 209/541; 209/584; 209/657

(58) Field of Classification Search ..... 209/539, 209/540, 541, 544, 545, 584, 656, 657, 900; 271/196, 225, 272, 184, 185, 298, 305; 198/457.03, 198/626.6, 370.04, 861.5
See application file for complete search history.

(56) References Cited

U.S. PATENT DOCUMENTS

| | | | | |
|---|---|---|---|---|
| 3,052,467 A | * | 9/1962 | Fertig | 271/188 |
| 3,371,926 A | * | 3/1968 | Anderson et al. | 271/298 |
| 3,674,143 A | * | 7/1972 | Hunter et al. | 414/791 |
| 3,889,811 A | * | 6/1975 | Yoshimura | 209/549 |
| 4,426,074 A | * | 1/1984 | Fischer | 271/302 |
| 4,493,484 A | * | 1/1985 | Eyer | 271/220 |
| 5,119,954 A | * | 6/1992 | Svyatsky et al. | 209/584 |
| 5,143,225 A | | 9/1992 | Rabindran et al. | |

(Continued)

FOREIGN PATENT DOCUMENTS

DE 19757717 C1 12/1997

(Continued)

OTHER PUBLICATIONS

U.S. Appl. No. 09/219,462, filed Dec. 23, 1998 for "Apparatus For Turning Flat Shipments," by Holger Schererz, Inventor.

(Continued)

*Primary Examiner*—Donald P. Walsh
*Assistant Examiner*—Joseph Rodriguez
(74) *Attorney, Agent, or Firm*—Philip G. Meyers

(57) ABSTRACT

A mixed mail sorting machine includes a feeder that receives a stack of incoming mail pieces and outputs the mail pieces one at a time in a vertical position; a scanner which receives mail pieces from the feeder and scans each mail piece in a vertical position to read sorting information thereon; a reorientation conveyor which receives the scanned mail pieces from the scanner and re-orients each mail piece from a vertical to a horizontal position; a transport device for turning mailing through a 180° arc; a splitter conveyor including a movable divert section which diverts each mail piece to an upper path or a lower path; a bin module which includes upper and lower bin sections which receive mail pieces from the upper and lower paths, respectively, wherein each bin section includes a row of bins and an associated series of tiltable conveyor sections which can be actuated to drop a mail piece into the associated bin; and a control system which tracks each mail piece as it moves from the scanner to the bins and controls operation of the divert section and the tiltable conveyor section so that each mail piece is sorted to predetermined bin based on the sorting information read by the scanner.

17 Claims, 48 Drawing Sheets

U.S. PATENT DOCUMENTS

| | | | | |
|---|---|---|---|---|
| 5,150,891 | A | 9/1992 | Svyatsky et al. | |
| 5,190,282 | A | 3/1993 | Rabindran et al. | |
| 5,363,971 | A | 11/1994 | Weeks et al. | |
| 5,503,388 | A * | 4/1996 | Guenther et al. | 271/300 |
| 5,542,547 | A * | 8/1996 | Ricciardi | 209/539 |
| 5,651,445 | A | 7/1997 | Stevens et al. | |
| 5,659,163 | A | 8/1997 | Lagan et al. | |
| 5,667,078 | A | 9/1997 | Walach | |
| 5,852,826 | A | 12/1998 | Graunke et al. | |
| 5,971,161 | A * | 10/1999 | Branecky et al. | 209/657 |
| 6,186,312 | B1 | 2/2001 | Schererz | |
| 6,244,419 | B1 * | 6/2001 | Slocum | 198/369.1 |
| 6,533,266 | B1 | 3/2003 | Schererz et al. | |
| 2002/0121735 | A1 * | 9/2002 | Slocum et al. | 271/198 |

FOREIGN PATENT DOCUMENTS

| | | |
|---|---|---|
| EP | 0 270 731 A2 | 5/1987 |
| EP | 0 407 795 A2 | 6/1990 |
| EP | 0 512 363 A1 | 4/1992 |
| FR | 2 365 379 | 9/1976 |

OTHER PUBLICATIONS

U.S. Patent Application entitled "Piling Bin For Flat Mail Pieces," by Herbert Gaissmaier,et at., U.S. Appl. No. 09/622,338, filed Jan. 19, 1990, 10 pages.

* cited by examiner

MIXED MAIL SORTING MACHINE

This application claims priority of U.S. Provisional Application Ser. No. 60/242,299, filed Oct. 2, 2000.

TECHNICAL FIELD

The present invention relates to the field of mail sorting, and particularly to a mail sorting machine capable of sorting mail pieces having a wide variety of sizes, weights, and shapes.

BACKGROUND OF THE INVENTION

Corporate and institutional mail rooms typically maintain large staffs for handling the large volume of mail that must be processed daily. The type of mail processed by the typical corporate or institutional mail room includes internal mail, which originates within the organization and has a destination also within the organization, incoming mail, which comes into the organization from external sources, and outgoing mail, which originates within the organization and has a destination external to the organization. In the typical corporate or institutional mail room, 60% of the daily mail is internal, 35% is incoming, and 5% is outgoing. Mail processing systems for these installations must be capable of sorting the organization's internal and incoming mail into groups corresponding to internal mail stops as well as sorting the organization's outgoing mail. With a large, and continually growing, number of mail pieces being processed, it is becoming increasingly important to provide an efficient process to sort the mail pieces.

For installations where there is a very large flow of mail to be sorted, on the order of thousands of pieces a day or more, large, highly automated systems automatically scan mail pieces to determine their address and thereafter control an automatic sorting system to properly sort the mail pieces. Various automated sorting techniques, systems and methods for processing mail are known. These systems may use either highly sophisticated optical character recognition (OCR) technology to recognize the addresses placed on the envelopes, or may use relatively simple bar code scanners to scan bar code which has been prerecorded on each mail piece. In these systems, highly sophisticated OCR systems are used to scan printed or handwritten addresses from each mail piece and automatic sortation equipment is controlled in accordance with the scanned address to properly sort the mail pieces. The OCR/CS system often includes a bar-code printer for printing zip codes on envelopes in bar-code form on each mail piece so that each mail piece might be further sorted at local stations more efficiently. In general, one large sorting machine is used to sort the mail for delivery to various geographic locations. Typically, the mail pieces are sorted according to a sort scheme into numerous groups (e.g. a range of ZIP codes, ZIP code (5 digits), ZIP code (9 digits), etc.).

The volume of mail handled on a daily basis by carriers, as for example, the U.S. Postal Service, is such that automated handling and sorting equipment is employed whenever and wherever possible to facilitate the distribution of mail pieces. Such systems have been extremely effective in sorting large volume mail flows, but the traditional systems have limitations. Mail pieces include letters, flats, irregular parcel pieces, and mail pieces which are delivered by individual mail carriers. Although traditional OCR/CS systems are capable of sorting thousands of pieces of mail per hour, most are limited in that they are designed to work with mail pieces falling into a fairly narrow range of sizes and thicknesses. Furthermore, most of the systems incorporate older control electronics that limit the functionality and flexibility of the systems.

SUMMARY OF THE INVENTION

The mail sorting machine of the present invention allows a user to sort mail of varying sizes, especially of varying thicknesses, accurately at a high volume. By automating many of the manual tasks involved in sorting mail, the machine can significantly increase mailroom efficiency. In varying embodiments, the machine may be used to rough sort mail for further machine or manual processing, fine sort incoming mail down to a building, mail stop, department, or office, or pre-sort outgoing mail to take advantage of U.S.P.S. discounts.

According to one aspect of the invention, such a system includes:

a feeder that receives a stack of incoming mail pieces and outputs the mail pieces one at a time in a vertical position;

a scanner which receives mail pieces from the feeder and scans each mail piece in a vertical position to read sorting information thereon;

a reorientation conveyor which receives the scanned mail pieces from the scanner and re-orients each mail piece from a vertical to a horizontal position;

a splitter conveyor including a movable divert section which diverts each mail piece to an upper path or a lower path;

a bin module which includes upper and lower bin sections which receive mail pieces from the upper and lower paths, respectively, wherein each bin section comprises a row of bins and an associate series of tiltable conveyor sections which can be actuated to drop a mail piece into the associated bin; and a control system which tracks each mail piece as it moves from the scanner to the bins and controls operation of the divert section and the tiltable conveyor section so that each mail piece is sorted to predetermined bin based on the sorting information read by the scanner.

In this sorter, mail of varying sizes addressed to various destinations is loaded into a feeder at one end of the machine. The pieces are then drawn into the machine one piece at a time for processing. Each piece is scanned for an address, and then diverted to one of several sorting bins based on the destination. One embodiment of a sorter according to the present invention comprises a feeder module for receiving the mail pieces, a scanner module for scanning the surface of each mail piece, a turner module and twister module for reorienting the mail pieces, and an elevator module for diverting each mail piece into one of two bin groups within the attached bin modules.

The sorter can be roughly divided into two sections. The first section of the machine, comprising the feeder, scanner, and turner modules, serves to separate, scan and feed the mail pieces along a single common path. The second section of the machine, comprising the twister, elevator, and bin modules, sorts the mail pieces into their respective destination bins. Owing to the fact that separation and turning of the mail pieces is most readily done with vertically-oriented mail pieces, the first part of the machine works with the mail pieces in this orientation. The second part of the machine works with mail pieces disposed in a horizontal orientation due to several factors, including ergonomic and form factor considerations. As an example, more sorting bins can be placed in a given amount of floor space if multiple rows of bins are stacked vertically. The entry portion of the twister module is designed to rotate the orientation of the mail pieces accordingly.

The sorter incorporates a system control computer (SCC) for top-level machine control and two embedded controls for low-level control. One embedded control, the embedded feeder control, acts as the dedicated control for the feeder module. The second embedded control, the embedded sorter control, performs low-level control functions for the remainder of the sorter. The system control computer runs the application software including the user interface (UI), the machine control (MC) and the optical character recognition (OCR) processes. In certain embodiments, the system control computer is a PC architecture system running Microsoft Windows NT.

The embedded sorter control (ESC) comprises an embedded sorter control computer (ECC) running the embedded sorter control software (ESC-SW) to provide embedded machine control (EMC), which includes embedded tracking control (ETC). Embedded machine control comprises control of most on-line related devices such as the flap drive motors, printer, and meter, while embedded tracking control (ETC) provides mail piece tracking through the machine based on the outputs of a set of light barriers and encoders. In certain embodiments, the embedded sorter control computer is a PC architecture computer running under the QNX 4.24 operating system.

Message exchange between the various sorter components takes place through a set of message handlers. For example, information is passed between the system control computer and the embedded sorter control via a machine control message handler.

Message routing through the message handlers is based on message destination information contained in the message itself. Each message is passed by the concerned message handlers. If a message handler receives a message with a communication area ID value corresponding to a different message handler, then the message will be passed to the correct message handler. Otherwise, the message will be sent to all the processes within the communication area of the current message handler that have an 'interest' in that message type. With this routing scheme, one message can be sent to more than one recipient. Certain embodiments utilize the Pitney Bowes FOX/B900 Link Layer Protocol for the application related communication between the system control computer and the embedded control computer.

In another aspect, the mail sorting machine includes a transport device disposed between the scanner and reorientation conveyor having a deflector defining a substantially semicircular path through which the transport device transports mail pieces. In this aspect, the carries the mail pieces through an arc of about 180°. The deflector further defines an input end and a discharge end of the transport and is configured to turn mail pieces received by the device from a first transport direction substantially aligned with the input end to a to a second transport direction substantially aligned with the discharge end. The transport device turns mail pieces using a first, vertically oriented, endless belt configured to travel along the substantially semicircular path in contact with the deflector from the input end to the discharge end of the transport device and a second, vertically oriented, endless belt configured to travel along the substantially semicircular path form the input end to the discharge end. The first endless belt contacts the second endless belt adjacent to the input end and carries the second endless belt around the path to the discharge end of the transport device.

At least one, and preferably a pair of, guide members form a path for mail pieces fed to the transport device into the input end of the transport device and between the first and second endless belts. Likewise, a discharge guide assembly, including at least one, and preferably a pair, of guide members guides mail pieces exiting the transport device between the first and second belts. A horizontal conveyor is configured to receive the bottom edge of mail pieces entering the input end of the transport device and convey the mail pieces along the guide member or members and between the first and second endless belts so that the first and second endless belts convey the mail pieces through the path from the input end to the discharge end. In one aspect, the transport device includes a printer for labeling mail pieces carried though the semicircular path.

In another aspect, the moveable divert section further comprises a belt-type conveyor configured to receive and convey horizontally positioned mail pieces from the reorientation section. The conveyor includes first and second ends and is pivotable around the first end to move the second end to a selected flight. In this aspect, the moveable divert also includes a plurality of resilient rotating members that retain mail pieces between the members and the endless belt as the mail pieces are conveyed by the endless belt.

In another aspect, the mail sorting machine includes an elevator conveyor that receives mail from the divert section and carries the mail along an incline to an upper flight for sorting into a selected one of a plurality of sort bins. The elevator conveyor preferably utilizes a plurality of resilient rotating members to retain the mail pieces between the conveyor and the members mail pieces are carried up the incline. The mail sorting machine uses the elevator conveyor and tiltable conveyors for directing mail pieces into a selected one of the plurality of bins, each of the tiltable conveyors being pivotable around a first end to incline the conveyor section to direct mail pieces to an associated bin. A deflector is associated with each tiltable conveyor for directing mail pieces into the associated bin.

In yet another aspect, a bin module includes upper and lower bin sections which receive mail pieces from the upper and lower flights, respectively. Each bin section comprises a row of bins and an associated series of tiltable conveyor sections which can be actuated to drop a mail piece into the associated bin wherein each of the tiltable conveyors is pivotable around a first end to incline the conveyor section to direct mail pieces into an associated bin. The bins each include an impact wall, an inclined moveable stacking platter, a side wall and an upper wall wherein the impact wall is inclined toward the stacking platter and toward the side wall to align mail pieces entering bin. The upper wall of the bin is downwardly extended into the path of mail pieces entering the bin to direct the mail pieces downwardly into the bin. The stacking platter is supported with a spring so as to move and maintain a substantially constant distance between an uppermost mail piece positioned in the bin and the upper wall. A sensor is provided to detect the volume of mail pieces present in the bin and signal the control system when the volume of mail pieces in the bin reaches a predetermined level.

These and others aspects of the invention are further described and illustrated in the Detailed Description and Drawings.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention. The entire contents, other than any incorporations by reference, of U.S. Pat. No. 6,186,312, issued Feb. 13, 2001 and U.S. Pat. No. 6,533,266 issued Mar. 18, 2003 are hereby incorporated by reference herein.

The mail sorting machine of the present invention allows the user to sort mail accurately at a high volume. By automating many of the manual tasks involved in sorting mail, the machine can significantly increase mailroom efficiency. In varying embodiments, the machine may be used to: rough sort mail for further machine or manual processing; fine sort incoming mail down to a building, mail stop, department, or office; or pre-sort outgoing mail to take advantage of U.S.P.S. discounts.

In this sorter, mail of varying sizes addressed to various destinations is loaded into a feeder at one end of the machine. The pieces are then drawn into the machine one piece at a time for processing. Each piece is scanned for an address, and then diverted to one of several sorting bins based on the destination.

Figure 1:
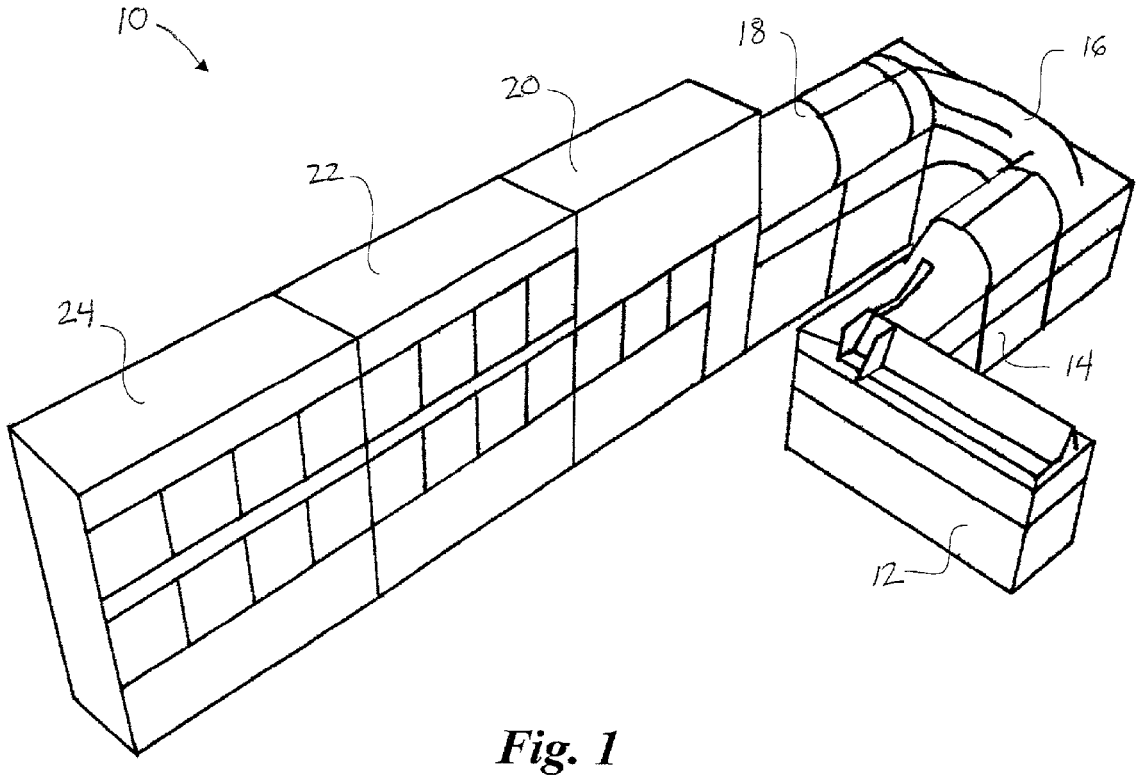
FIG. 1 shows one embodiment of a sorter according to the present invention.

One embodiment of a sorter according to the present invention is shown in FIG. 1 and generally designated 10. Sorter 10 comprises feeder module 12, scanner module 14, turner module 16, twister module 18, splitter module 20, and bin modules 22 and 24.

The feeder module 12 is the module into which the mail is loaded to start the sorting process on the machine. Feeder module 12 incorporates a stack advance section on which the mail is placed, a nudger section that changes the direction of movement, a first separator section that grabs the mail, an aligner section that aligns the mail so it is not skewed, and a second separator section that separates the mail into individual pieces. Mail pieces are loaded into the feeder module 12 in a vertical orientation, and leave the feeder module 12 in the same orientation.

Mail pieces leaving the feeder module 12 pass first into the scanner module 14, which digitally scans the surface of the mail piece. The scanner module 14 incorporates a camera inside that takes a digital image of the mail piece as it passes by. This image is sent to a computer inside the machine which performs an optical character recognition analysis on the image for a name and address. Once the address is identified from the mail piece, the computer determines the bin into which that mail piece should go based on the sort routine of the job being run. Mail pieces maintain their vertical orientation as they pass through the scanner module 14.

The turner module 16 moves the mail pieces from the scanner module 14 to the twister module 18. This movement requires the pieces to be swept through a 180 degree arc as part of the movement. Mail pieces maintain their vertical orientation as they pass through turner module 16. The turner module 16 serves multiple functions, including facilitating a reduction in the overall machine length, raising the mail pieces from the shorter scanner module to the taller twister module inlet, allowing the optical character recognition and sorting systems time to complete their functions, and serving as the repository for the embedded control computer.

The twister module 18, as the name implies, changes the orientation of each mail piece. It takes a vertically-oriented mail piece coming from the turner module 16 and rotates it to a horizontal orientation before transferring it to the splitter module 20. This change in orientation is necessary due to the fact that the downstream splitter module 20 and bin modules 22 and 24 are designed to work with horizontally-oriented mail pieces.

The splitter module 20 diverts each mail piece to either the upper bin or the lower bin transport path according to the location of the final destination bin. The machine controls the diverting process in the splitter module 20 based on the information received from the scanner module 14. In the embodiment shown in FIG. 1, splitter module 20 incorporates a set of bins in its lower section.

Mail pieces pass from the splitter module 20 into either the upper or lower transport path of one or more attached Eight-bin modules such as 22 and 24. Each eight-bin module 22 and 24 has a set of upper and lower bins that act as collection baskets for the mail. The machine determines the proper bin for each mail piece and diverts or opens the corresponding bin gate so that the mail piece falls into the proper bin based on the information received from the scanner module 14. There are sensors in each bin that relay back to the user whether a bin is almost full or completely full of mail to help the user in sweeping the bins.

A system control computer (not shown) controls the top-level operation of the machine. This computer contains the necessary software to operate the machine and keep track of the mail pieces as they move through the machine. In certain embodiments, a computer monitor sits above the feeder module of the machine to allow the user to interact with the machine to set up sort schemes, run sort jobs, print reports, update mail databases, and do other administrative tasks. In addition to the system control computer, sorter 10 comprises two embedded control units for low-level control of the sorter mechanisms. The feeder module 12 is controlled by a dedicated embedded feeder control (EFC). Low-level control of the remainder of the machine is handled by an embedded sorter control (ESC).

As described above, the scanner module 14 is located after the feeder module 12. The scanner module transmits mail pieces from the scanner module to the turner module. The primary function of the scanner module 14 is to scan the surface of the mail piece as it passes through. The scanner 14 uses a stationery camera to capture an image of the addressed portion of the mail piece. The scanned image is transmitted to the main computer of the mixed mail sorter 10 where the image is processed via an optical character recognition scheme in order to determine the address written or printed on the mail piece. The address ascertained by this method is then fed into an algorithm which serves to select a destination bin based on the address scanned.

Figure 2:
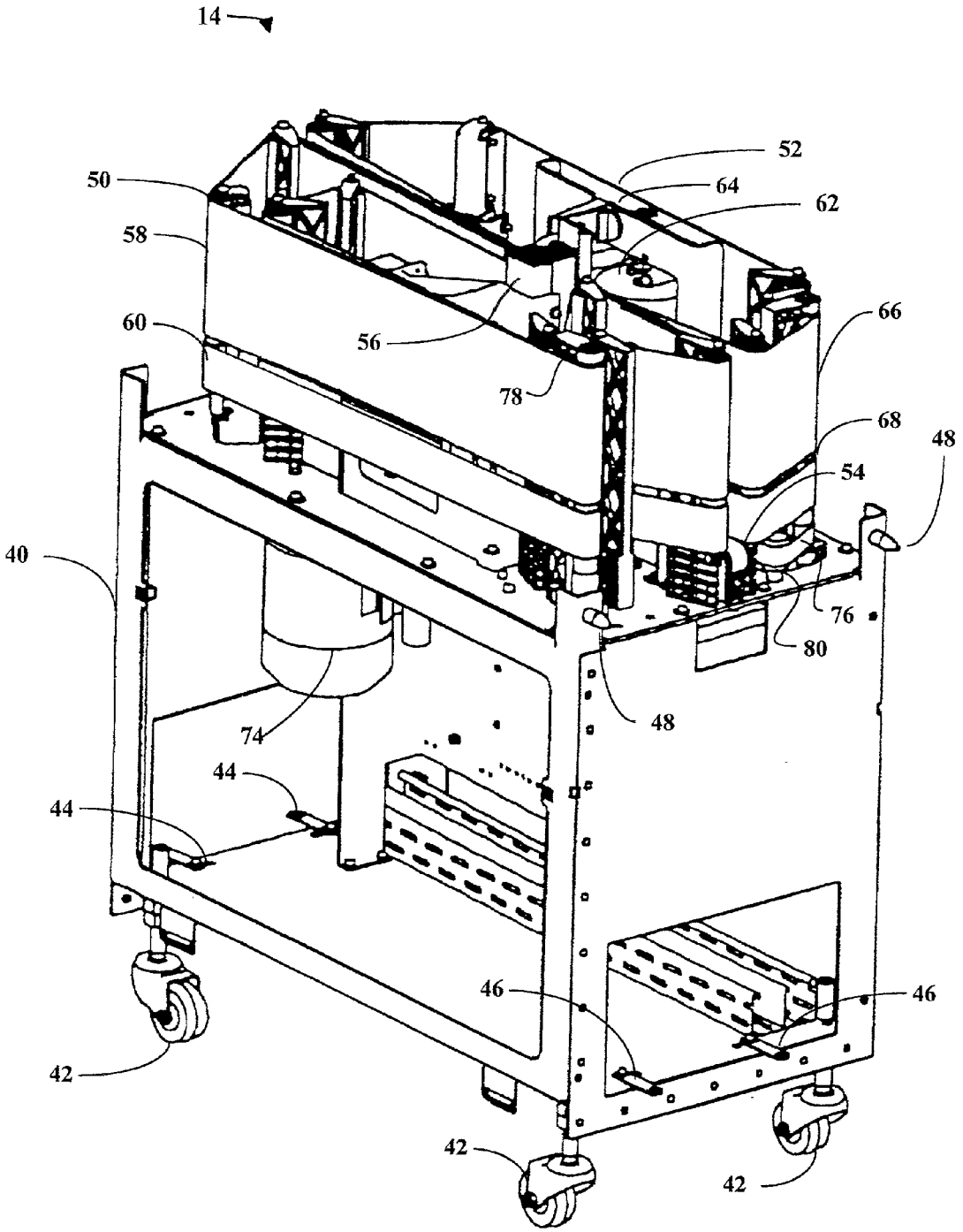
FIG. 2 is an isometric view of a mail piece scanner module of the sorter of FIG. 1.
Figure 3:
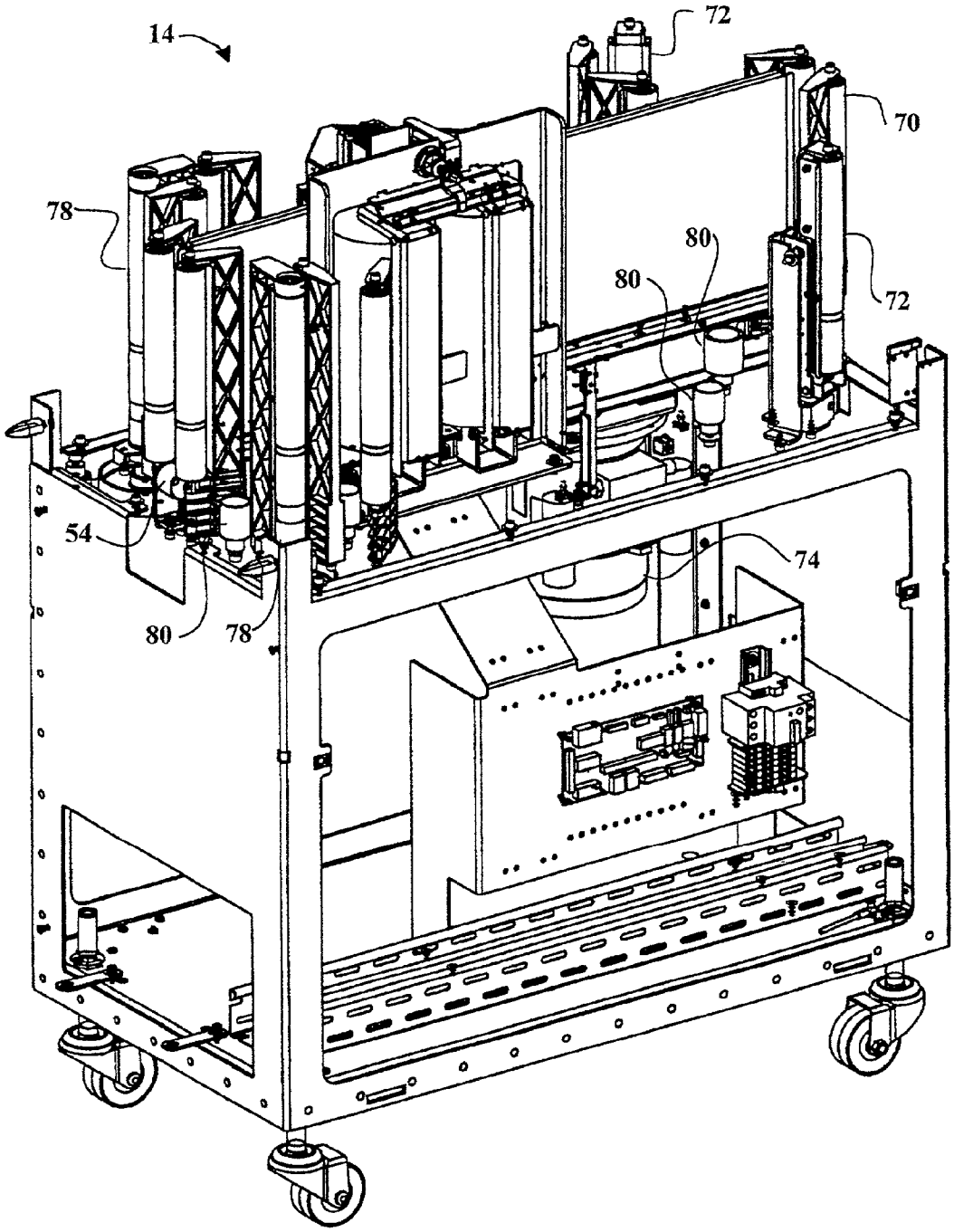
FIG. 3 is a second isometric view of the mail piece scanner module of FIG. 2 with conveyor belts and certain frame pieces removed for clarity.
Figure 4:
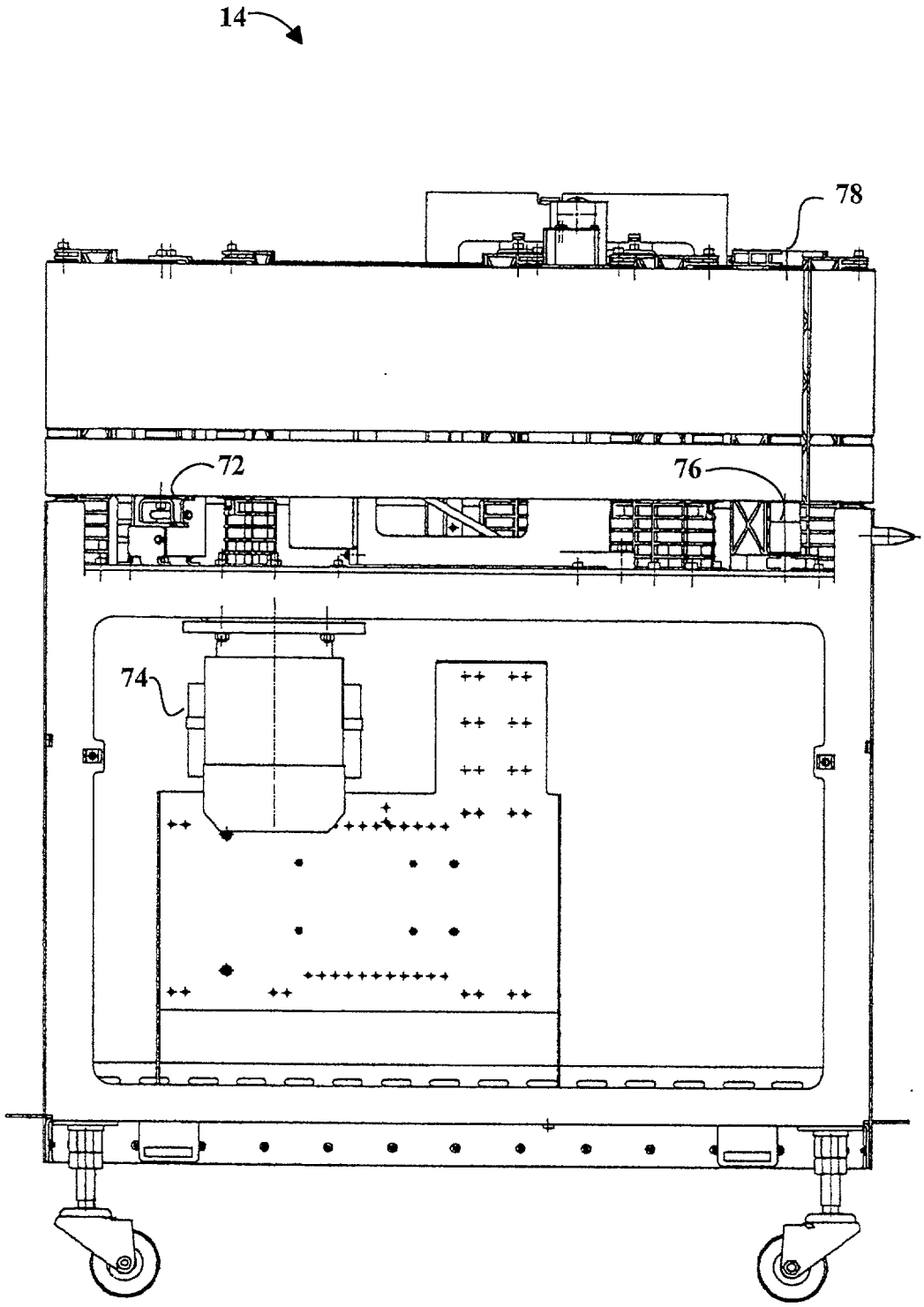
FIG. 4 is a side view of the mail piece scanner module of FIGS. 2 and 3.
Figure 5:
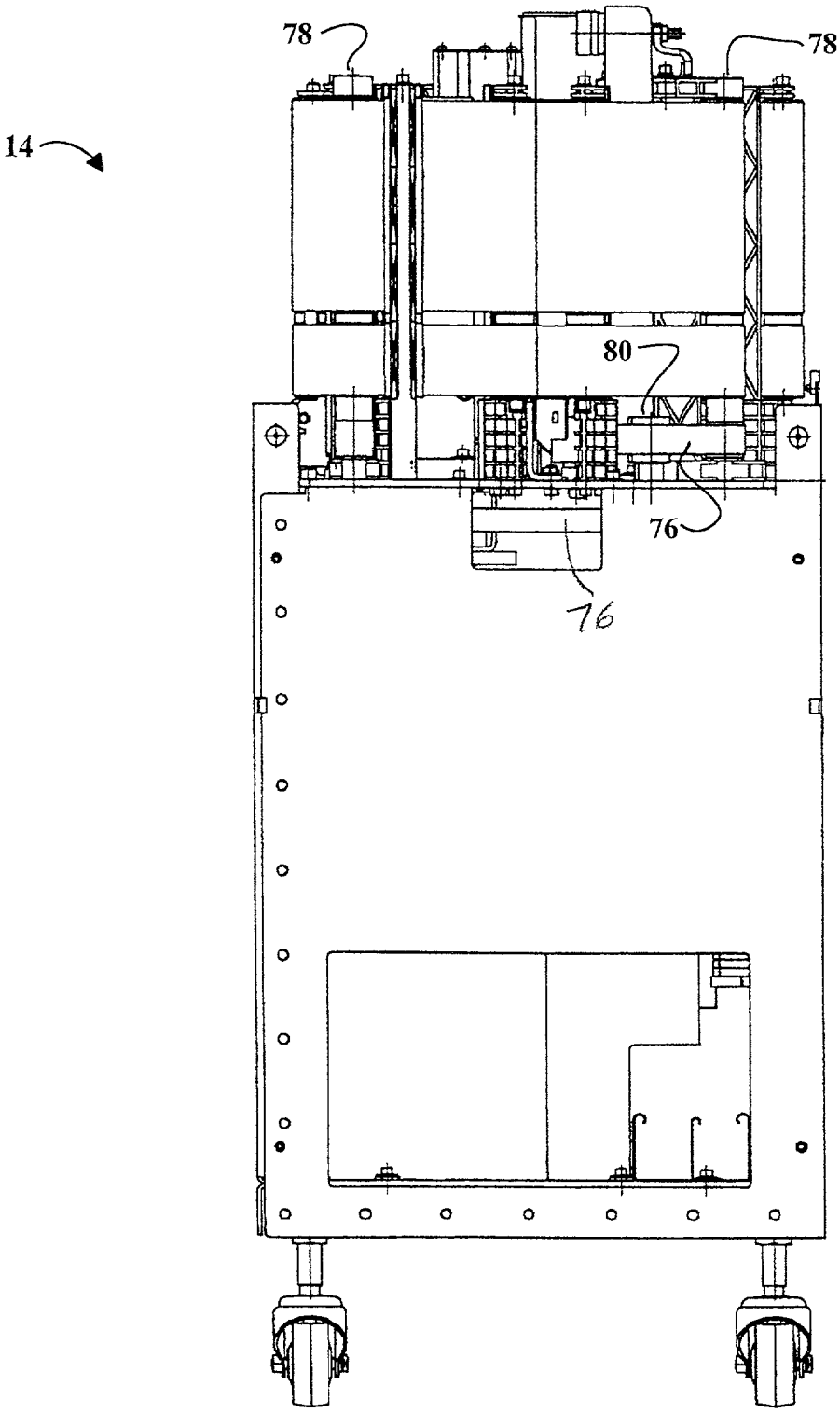
FIG. 5 is an end view of the mail piece scanner module of FIGS. 2–4.
Figure 6:
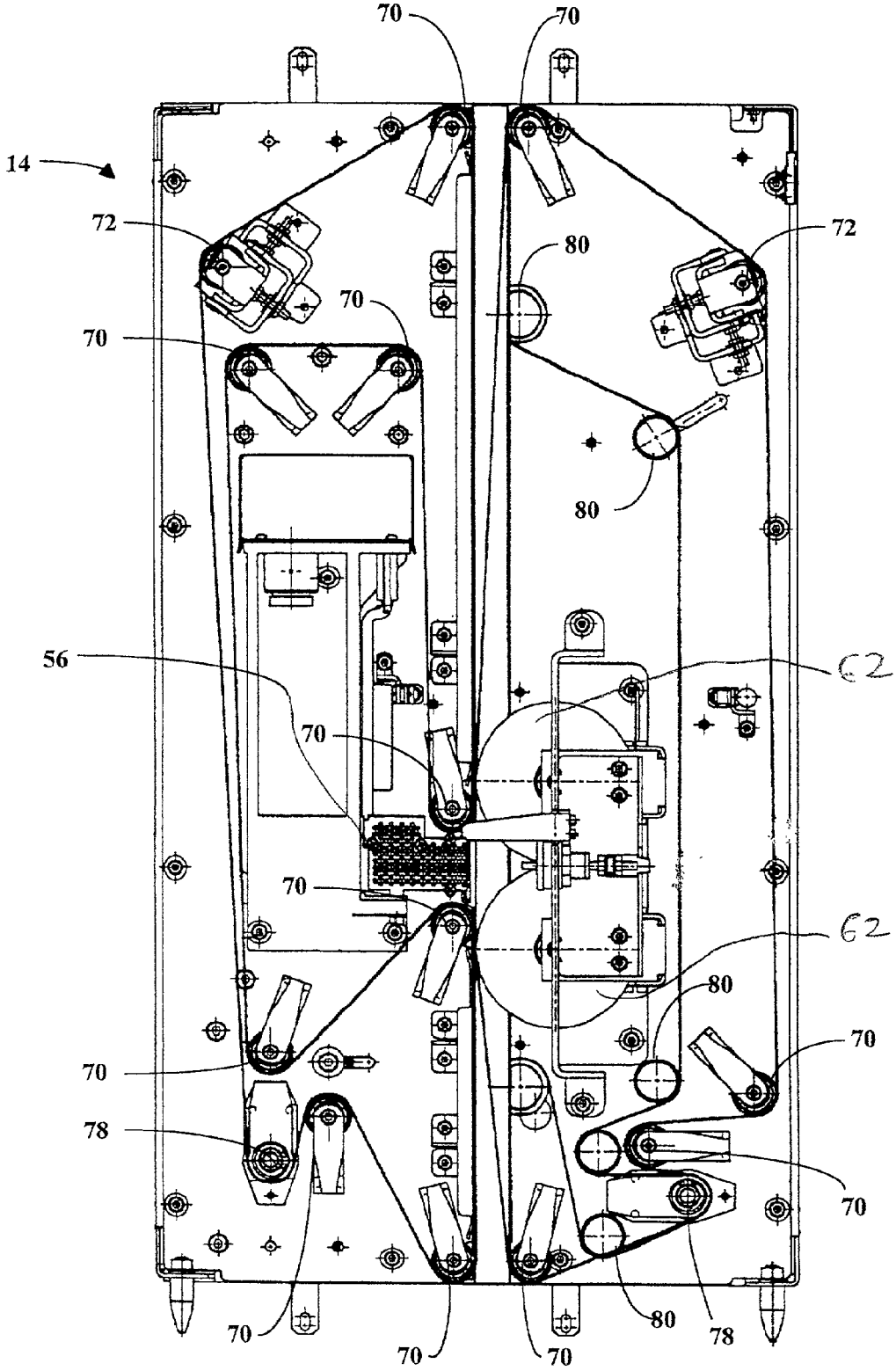
FIG. 6 is a top view of the mail piece scanner module of FIGS. 2–5.
Figure 7:
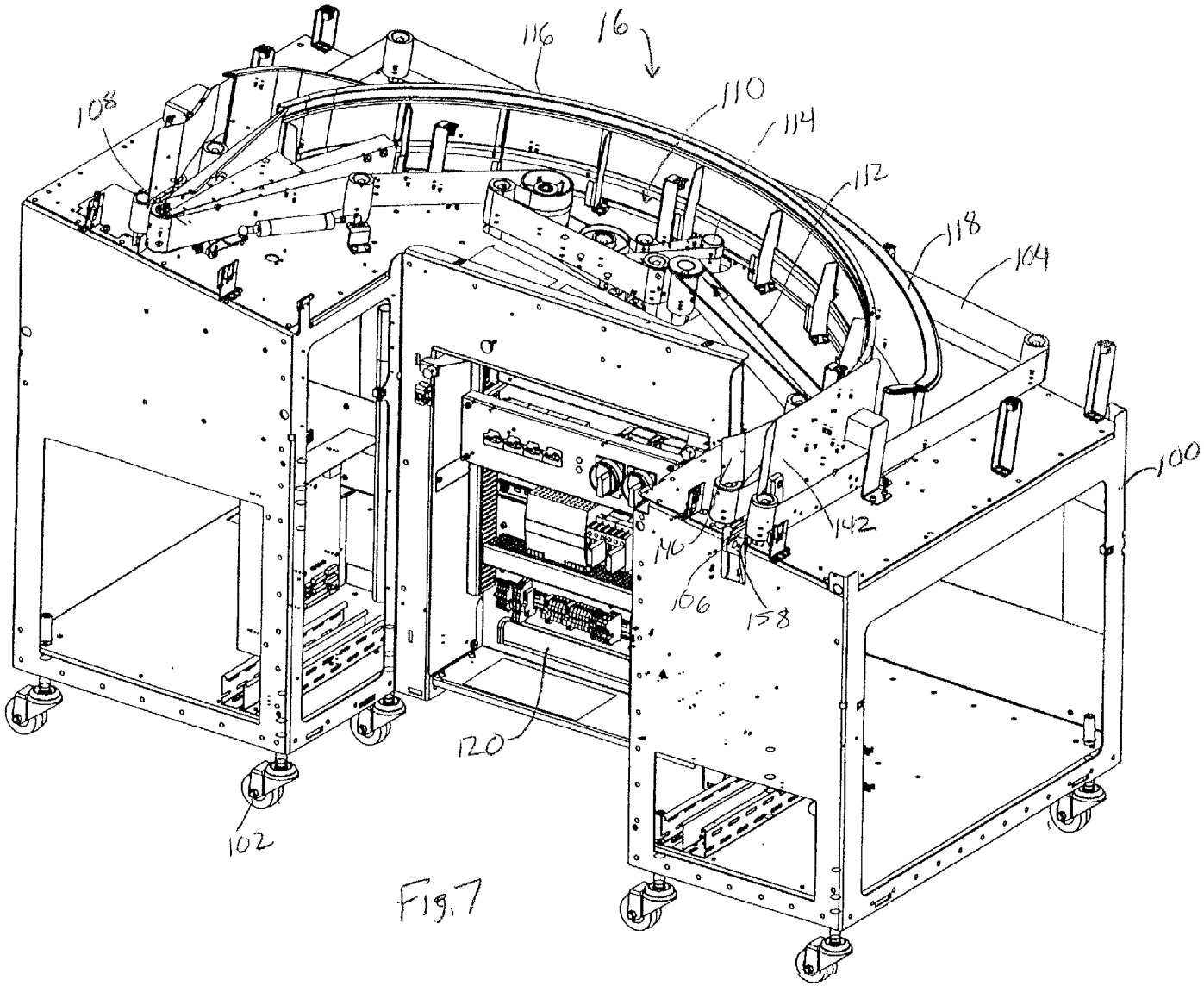
FIG. 7 is an isometric view of a mail piece turner module of the sorter of FIG. 1 according to one embodiment of the present invention.

FIGS. 2 through 6 depict the scanner module 14 of the mixed mail sorter 10 from a variety of angles so as to fully appreciate the scope of the invention. FIG. 2 is an isometric view of a mail piece scanner module 14 of the sorter 10 of FIG. 1. FIG. 3 is a second isometric view of the mail piece scanner module 14 of FIG. 2 with conveyor belts and certain frame pieces removed for clarity. FIG. 4 is a side view of the mail piece scanner module 14 of FIGS. 2 and 3. FIG. 5 is an end view of the mail piece scanner module 14 of FIGS. 2–4. FIG. 6 is a top view of the mail piece scanner module 14 of FIGS. 2–5.

As shown in FIGS. 2–6, scanner module 14 comprises scanner frame 40 mounted atop scanner casters 42 and having module connectors 44 and 46 at each end of the frame 40. In the orientation shown in FIG. 2, the entry end of the module, which connects to the feeder module, is disposed away from the viewer. The output end of the module, therefore, is disposed closer to the viewer. Attached to frame 40 are alignment bullets 48 to facilitate positive alignment of the scanner module 14 with turner module 16.

The functional portion of the scanner module 14 is the scanning mechanism mounted to the top of frame 40. The scanning mechanism comprises a scanner side mechanism 50, a compliant side mechanism 52, and a horizontal conveyer 54. The primary functional components of the scanner side mechanism 50 are the scanner camera 56, the scanner side upper belt 58, and the scanner side lower belt 60. The primary components of the compliant side mechanism 52 are the compliant rollers 62, the compliant roller frame 64, the compliant side upper belt 66, and the compliant side lower belt 68.

A mail piece entering the scanner module 14 is forced between the scanner side mechanism 50 and the compliant side mechanism 52. In operation, the scanner side belts 58 and 60 travel in a clockwise direction on the outside, while the compliant side belts 66 and 68 travel in a counter clockwise direction on the outside. Owing to these dynamics, a mail piece entering the scanner module 14 is drawn in by belts 58, 60, 66, and 68 as well as by horizontal conveyer 54. As can be seen in FIG. 2, as well as in FIGS. 5 and 6, the scanner module 14 is designed so that the compliant rollers 62 press belts 66 and 68 into close contact with belts 58 and 60. With this geometry, any mail piece of any thickness passing through the scanner module 14 can only pass the camera 56 by compressing the compliant rollers 62.

It can be seen in FIG. 2 that belts 58 and 60 wind through scanner side mechanism 50 in such a way that there is a gap in the belt path allowing camera 56 a clear view of a mail piece passing through the scanner module 14. This is accomplished through the use of a belt travel path having an inner and an outer loop. Belts 58 and 60 travel in a counter clockwise direction around the outside of the scanner side mechanism 50, while they travel in a counter clockwise direction through the inside portion of scanner side mechanism 50. This travel path can be seen even more clearly in FIG. 6, which is a top down view of the scanner module 14.

Scanner module 14 is powered by scanner drive motor 74, which transmits power to the scanner side mechanism 50 and compliant side mechanism 52 through scanner drive belt 76. Scanner drive belt 76, in turn, travels through the scanner module 14 around a series of power transfer rollers 78 and idler rollers 80.

Certain aspects of the various drive mechanisms of the scanner module 14 can be seen most clearly in FIG. 3, which is an isometric view of the scanner module 14 with belts 58, 60, 66, and 68 removed. FIG. 3 is the layout of various power drive idlers 80, as well as the design of power transfer rollers 78. It can be seen in FIG. 3 that power transfer rollers 78 comprise an upper, conveyor driving portion and a lower, driven portion in contrast to idler rollers 70, which comprise only an upper portion. The lower, driven portions of power transfer rollers 78 are driven by drive belt 76. Also shown in FIG. 3 are tensioner mechanisms 72, which serve to maintain proper tension in belts 58, 60, 66, and 68. FIGS. 4 and 5 show, among other features, additional views of tensioner mechanism 72, driver motor 74, drive belt 76, power transfer rollers 78, and power drive idlers 80.

FIG. 6 is scanner module 14 from a top view. Scanner module 14 shown in FIG. 6 is disposed with the entry end towards the top of the page. A substantial portion of the path of power drive belt 76 can be clearly seen in FIG. 6. As described above, the scanner side belts 58 and 60 travel in a clockwise direction on the outside, while the compliant side belts 66 and 68 travel in a counter clockwise direction on the outside. As also discussed above, a mail piece entering the scanner module 14 is drawn in by belts 58, 60, 66, and 68 as well as by horizontal conveyer 54. As can be seen in FIG. 6, the scanner module 14 is designed so that the compliant rollers 62 press belts 66 and 68 into close contact with belts 58 and 60.

The manner in which belts 58 and 60 wind through scanner side mechanism 50 can be clearly seen in FIG. 6. As shown in this figure, belts 58 and 60 wind through mechanism 50 in such a way that there is a gap in the belt path allowing camera 56 a clear view of a mail piece passing through the scanner module 14. The inner and outer loops of the belt path can also be clearly seen in FIG. 6. As described above, belts 58 and 60 travel in a counter clockwise direction around the outside of the scanner side mechanism 50, while they travel in a counter clockwise direction through the inside portion of scanner side mechanism 50.

Mail pieces exiting the scanner module 14 pass into the turner module 16. The turner module 16 is so named because in operation it carries the mail pieces through a 180 degree arc, so that they exit the turner module 16 in the opposite direction from the direction in which they entered. As with the mail piece conveyance mechanisms of scanner module 14, mail pieces passing through turner module 16 are sandwiched between two vertical conveyor belts. In contrast to the mail piece conveyance mechanisms of scanner module 14, however, in the turner module 16 a horizontal conveyer belt is used only with the entry portion of the module.

As shown in FIGS. 7–10, turner module 16 comprises turner module frame 100 riding on turner module casters 102. Movement of mail pieces through the turner module 16 is accomplished by the combined action of outer mail piece conveyer 104, horizontal mail piece conveyor 106, and inner mail piece conveyor 108. Mechanical power is distributed through the machine through power transmission mechanism 110 located in the center of the turner module 16. Mechanism 110 distributes mechanical power from the turner drive motor 114 to various mechanical elements of the module 16, including inner conveyer belt 108 and horizontal conveyer drive belt 112. The mail piece travel path comprises primarily the space between mail piece deflector 116 and curve cover 118. In addition to serving as a mail piece conveying device, turner module 16 also functions as the mounting location for the low level machine controller 120, which handles all low level control of the sorter 10.

Figure 8:
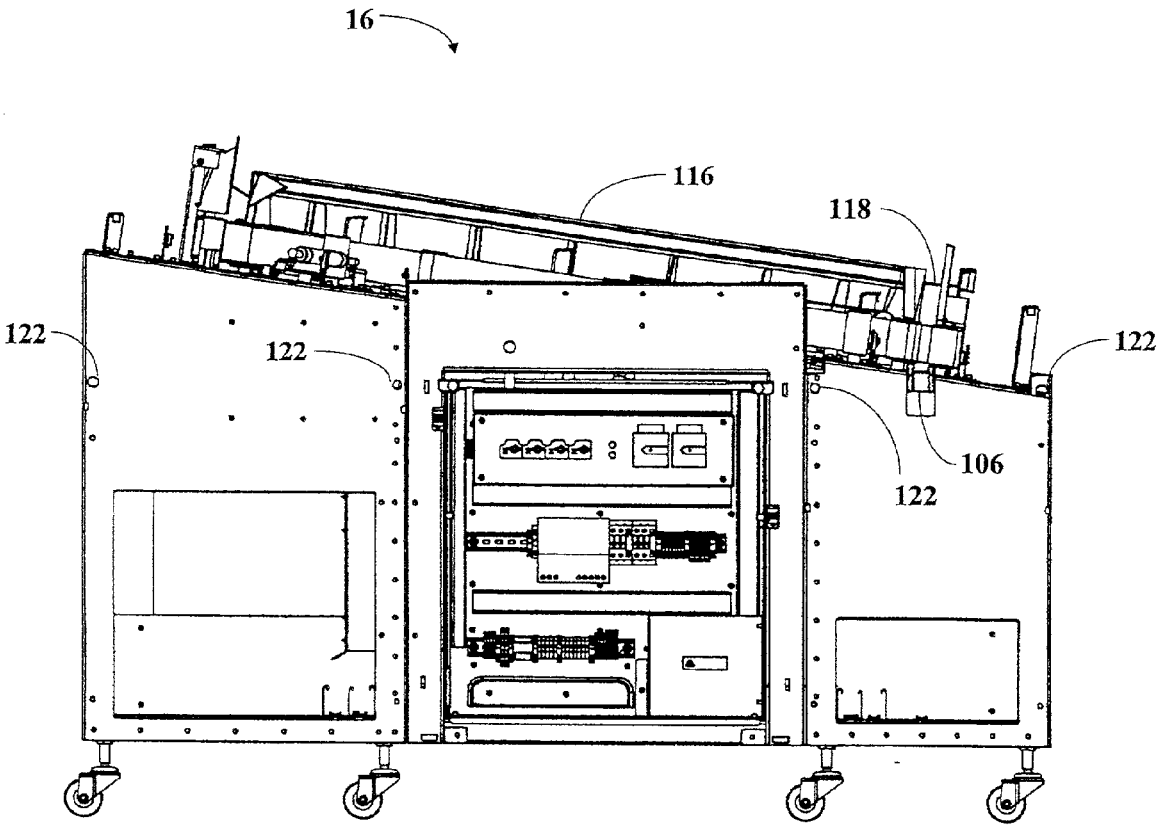
FIG. 8 is a side view of the mail piece turner module of FIG. 7.

FIG. 8 is a frontal view of the turner module 16, providing an additional view of certain principal components of turner module 16. For example, certain aspects of horizontal entry conveyer 106, mail piece deflector 116, and curve cover 118 are more clearly depicted in this figure. In addition, FIG. 8 is more clearly the alignment bullet receivers 112 which are designed to align the turner module 16 with its mating modules. Turner module 16 mates with the scanner module at its entry end and with twister module 18 at its exit. It can be seen in FIG. 8 that the mail piece exit path is significantly higher than the mail piece entry path. This is to accommodate the height differential between the mail piece paths of scanner module 14 and twister module 18.

Figure 9:
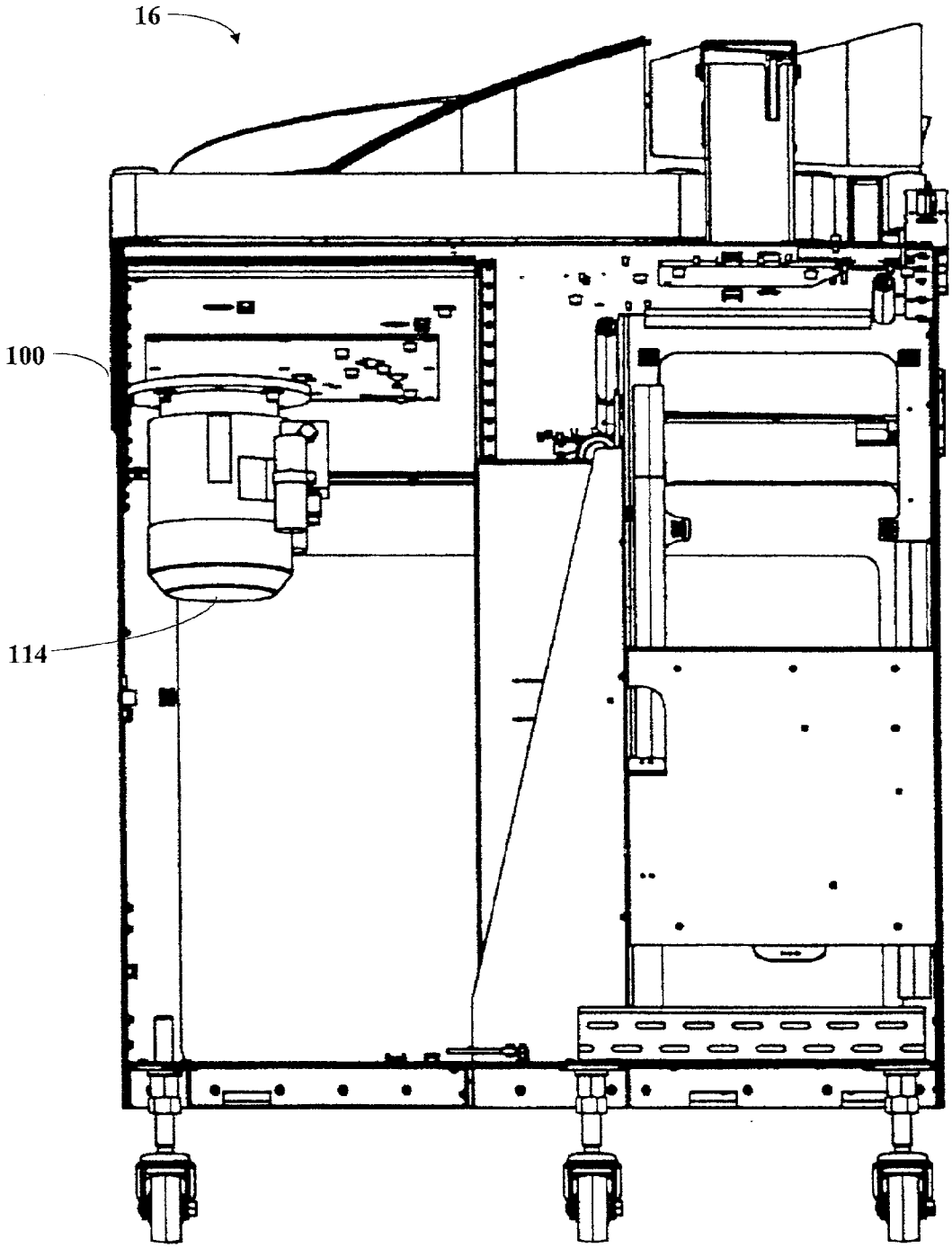
FIG. 9 is an end view of the mail piece scanner module of FIGS. 7 and 8 having certain frame components removed for clarity.
Figure 10:
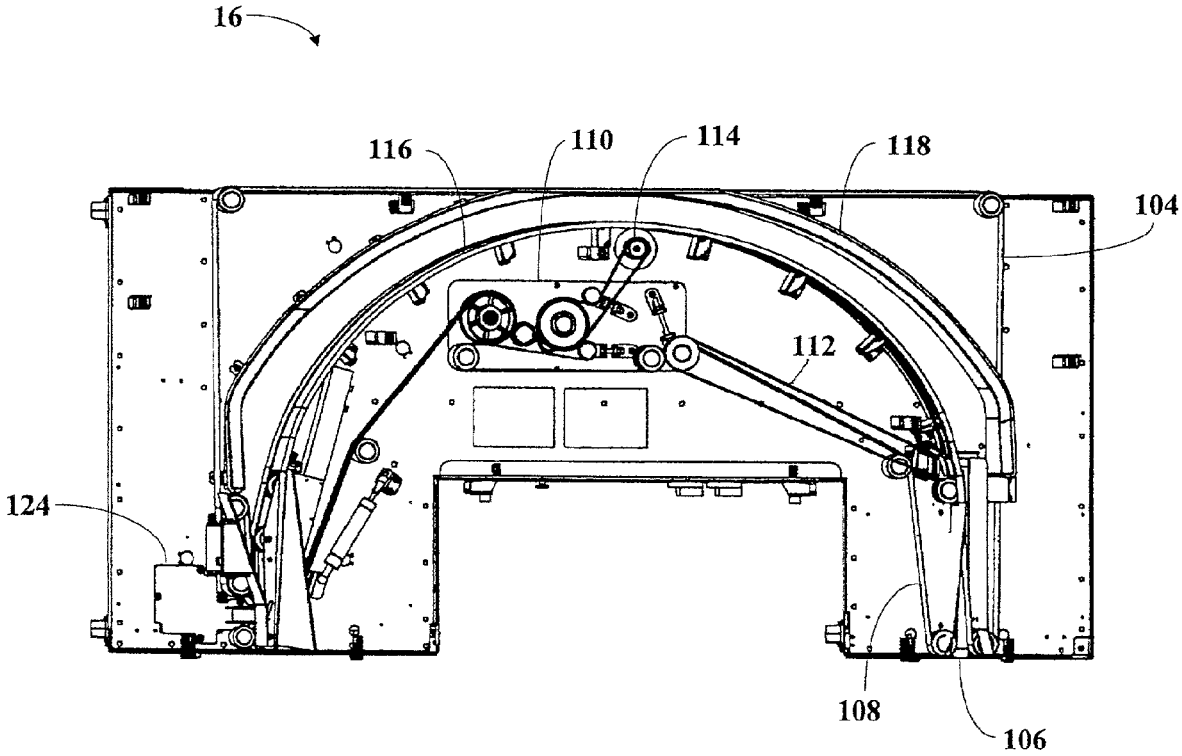
FIG. 10 is a top view of the mail piece turner module of FIGS. 7–9.

FIGS. 9 and 10 provide additional views of turner module 16. FIG. 9 is an end view of turner module 16 showing the location of drive motor 114 within turner module frame 100. FIG. 10 is a top view of turner module 16, which provides a clearer representation of the interaction operation of the belt mechanisms of the turner module 16, particularly, power transmission mechanism 110. As shown in FIG. 10, power transmission mechanism 110 receives inner conveyer belt 108 and imparts mechanical energy to belt 108 through a series of drive pulleys. Outer conveyer belt 104 is powered by high frictional contact with inner conveyer 108 as the two belts ride together around mail piece deflector 116. Horizontal entry conveyer 106 is powered by entry conveyer drive belt 112, which is driven by power transmission mechanism 110.

Figure 11:
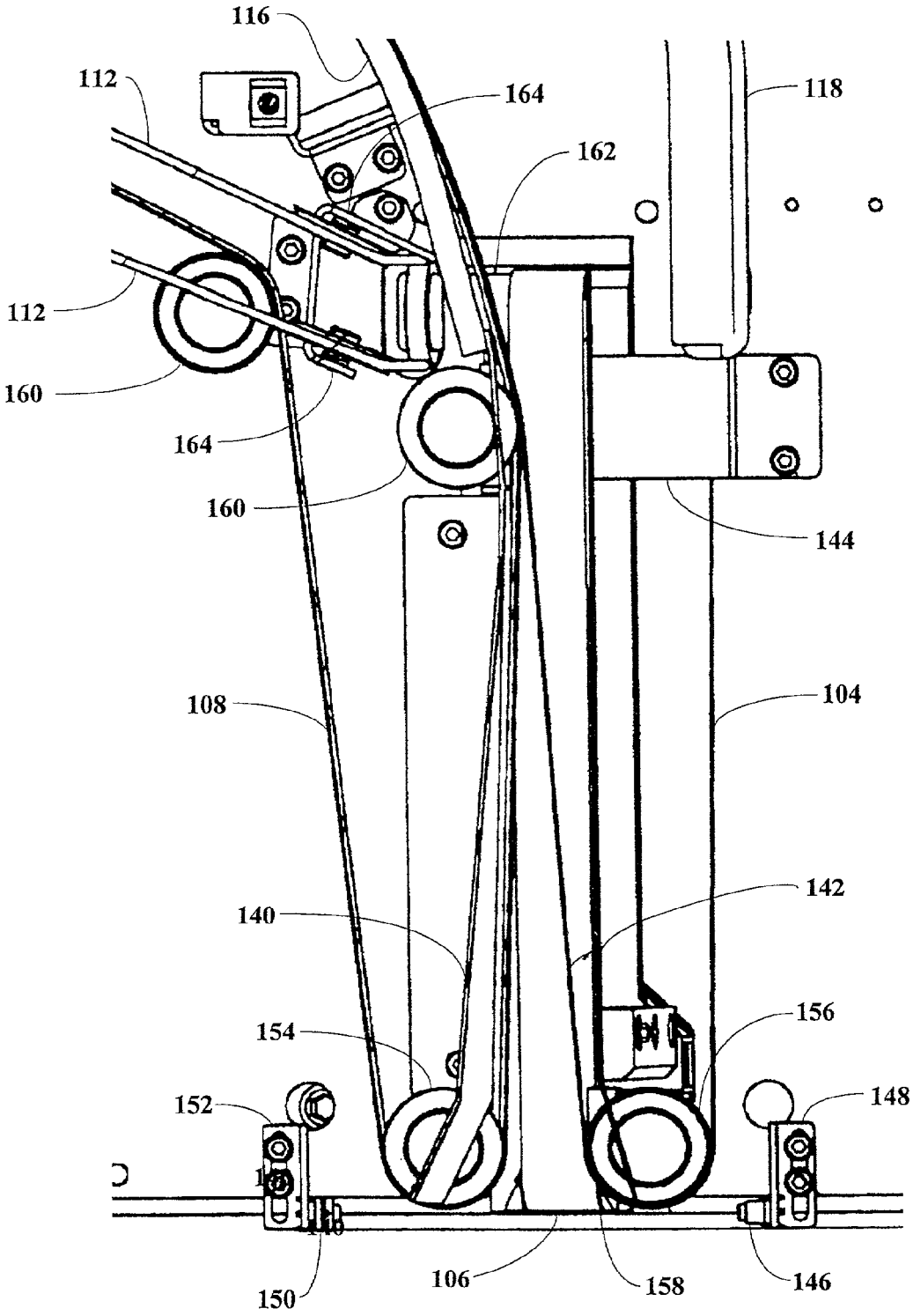
FIG. 11 is a top view of the mail piece entry section of the mail piece turner module of FIGS. 7–10.

FIG. 11 gives a detailed view of the mail piece entry section of turner module 16. In addition to the elements and aspects shown and elaborated in the previous figures, FIG. 11 more clearly is inner guide flange 140 and outer guide flange 142, which together direct an entering mail piece in the proper manner between inner conveyer belt 108 and outer conveyer belt 104. Outer guide flange 142 is backed by a guide flange pad assembly 144 which is designed to absorb the energy of an incoming mail piece striking outer guide flange 142. Clearly shown in FIG. 11 are photo eye emitter 146 and emitter bracket 148 which work in conjunction with photo eye detector 150 and detector bracket 152. When a mail piece passes between emitter 146 and detector 150, the optical signal is temporarily interrupted, thereby providing the control computers of the sorter 10 to ascertain the position of mail pieces within the system. The use of photo emitters and photo detectors to detect mail piece position is found throughout sorter 10, as this method of position detection avoids numerous problems attendant to mechanical switches, such as contact wear and switch bounce.

A mail piece entering the turner module 14 first encounters inner inlet idler 154, outer inlet idler 156, and lower inlet idler 158. Idlers 154, 156, and 158 are designed to work in conjunction with guide flanges 140 and 142 to properly guide the mail piece into the turner module. As described above, inner conveyer belt 108 is driven directly by power transmission mechanism 110 and outer conveyer belt 104 is driven through contact with inner conveyer belt 108. Horizontal inlet conveyer 106 is driven through a separate mechanism. As can be seen in FIG. 11, horizontal conveyer 106 is driven by horizontal conveyer drive belt 112. As described in conjunction with FIG. 10, the end of drive belt 112 not shown in FIG. 11 is connected to, and driven by, transmission mechanism 110. Within the entry section shown in FIG. 11, drive belt 112 passes over idlers 164 and down around horizontal conveyer driving roller 162, thereby providing mechanical power to horizontal conveyer 106. As shown in FIG. 11, horizontal inlet conveyer 106 carries the entering mail piece only a short distance into turner module 16. As the mail piece passes off the end of horizontal inlet conveyer 106, it is pulled tightly against curved mail piece deflector 116 by inner conveyer belt 108 and outer conveyer belt 104.

Figure 12:
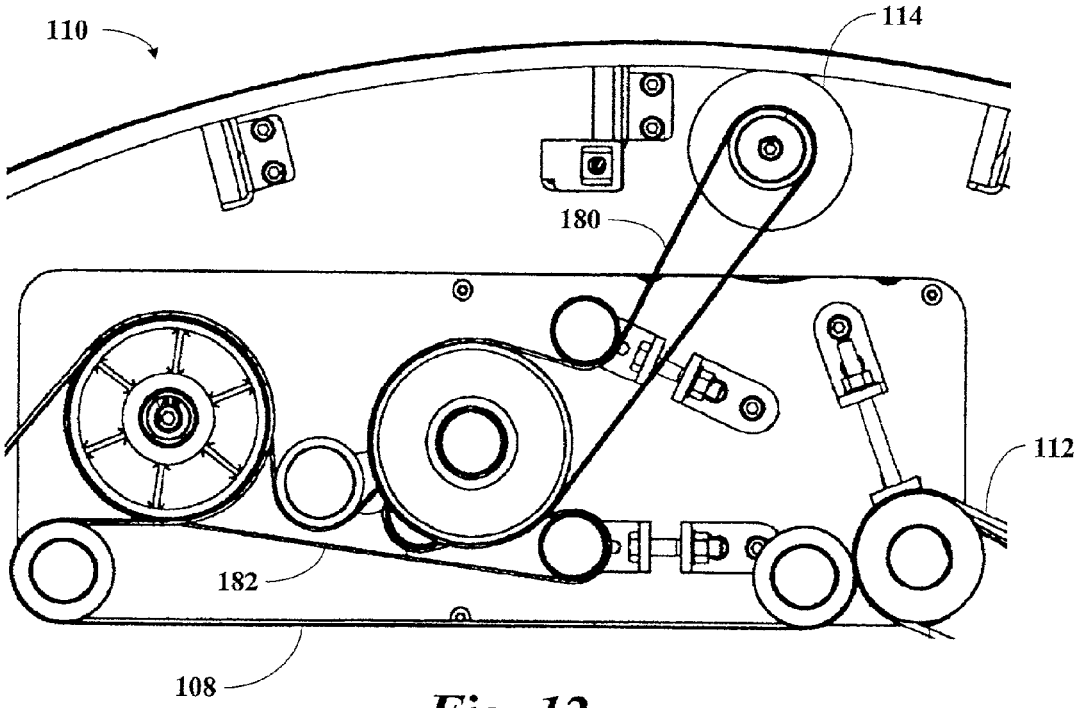
FIG. 12 is a top view of the mechanical power distribution mechanism of the mail piece turner module of FIGS. 7–10.
Figure 13:
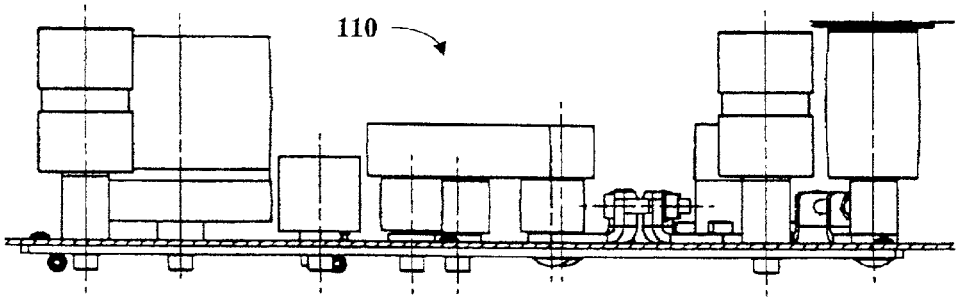
FIG. 13 is a side view of the mechanical power distribution mechanism of the mail piece turner module of FIGS. 7–10 with power transmission belts removed for clarity.
Figure 14:
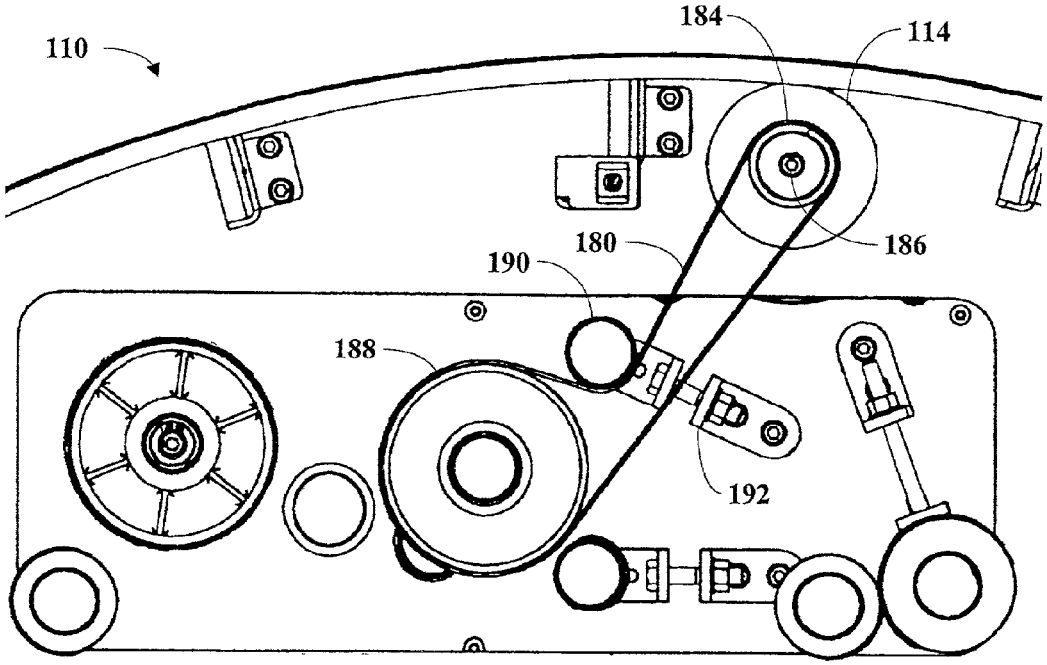
FIG. 14 is a top view of the mechanical power distribution mechanism of FIGS. 12 and 13 with only the motor power input belt installed.
Figure 15:
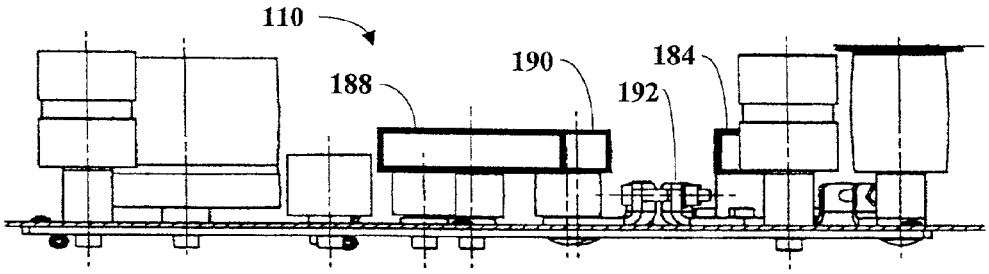
FIG. 15 is a side view of the mechanical power distribution mechanism of FIGS. 12 and 13 with power transmission belts removed for clarity.

FIG. 12 is a detailed view of power transmission mechanism 110. Power transmission mechanism 110 comprises drive motor 114, power input belt 180, intermediate transmission belt 102, inner conveyer belt 108, and horizontal inlet conveyer belt drive 112. FIG. 13 is mechanism 110 from the side view. A more detailed view of power input belt 180 and related components is shown in FIG. 14. As shown in FIG. 14, the power input portion of power transmission mechanism 110 comprises power input belt 180, which is driven by power input driving pulley 104 mounted in shaft 186 of motor 114. Power input belt 180, in turn, drives power input driven pulley 188, which transmits power to the rest of mechanism 110, as described below. Tension in belt 180 is maintained by tensioner idler 180 mounted on tensioner bracket 192.

Figure 16:
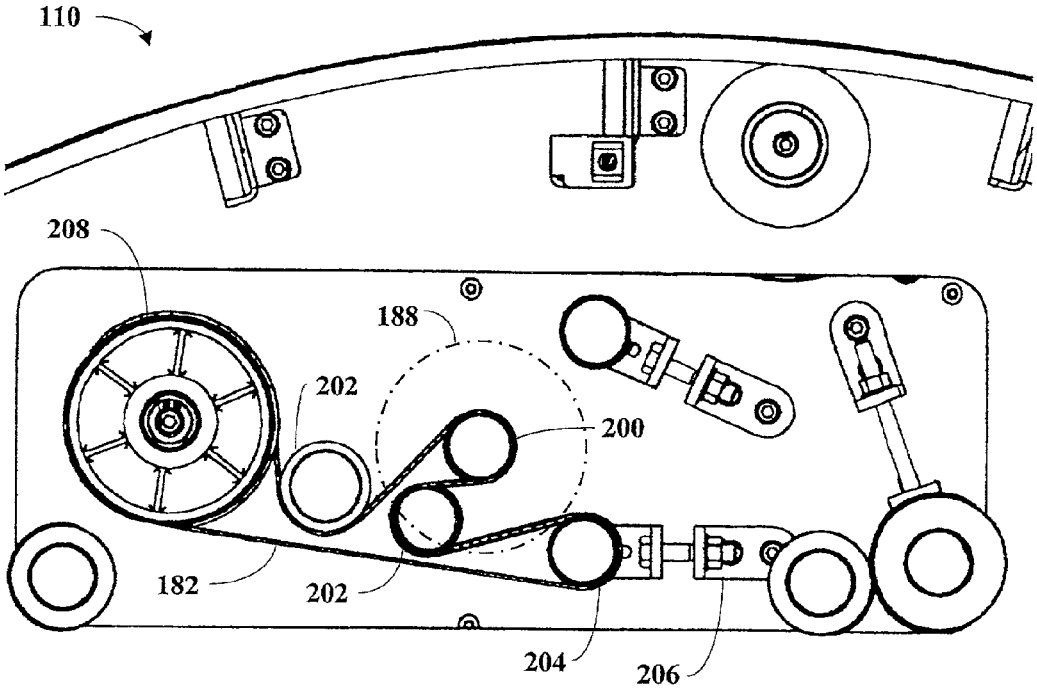
FIG. 16 is a top view of the mechanical power distribution mechanism of FIGS. 12 and 13 with only the intermediate drive belt installed.
Figure 17:
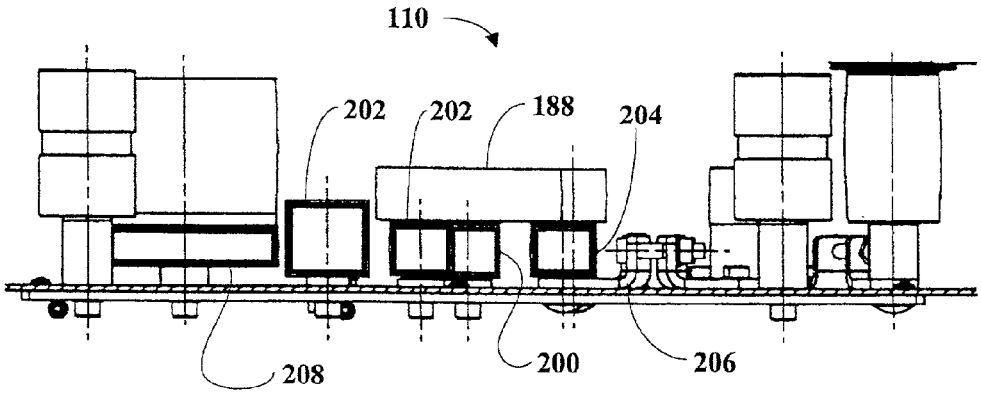
FIG. 17 is a side view of the mechanical power distribution mechanism of FIGS. 12 and 13 with power transmission belts removed for clarity.

The intermediate portion of mechanism 110 is shown in FIGS. 16 and 17. Power input driven pulley 188 is fixed to intermediate belt driving pulley 200, which drives intermediate belt 182, which in turn, drives intermediate driven pulley 208. In a similar manner to that employed for power input belt 180, tension in belt 182 is maintained by fixed idlers 202 and tensioner idler 104, which is mounted to tensioner bracket 206.

Figure 18:
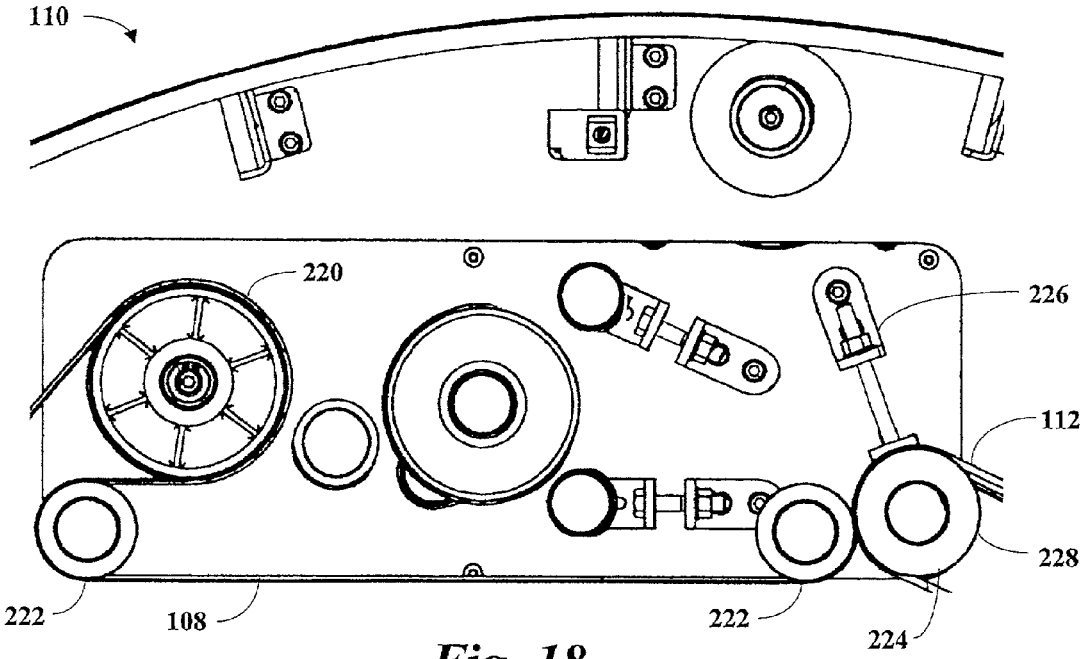
FIG. 18 is a top view of the mechanical power distribution mechanism of FIGS. 12 and 13 with only the inner mail piece conveyor belt and horizontal entry conveyor drive belt installed.
Figure 19:
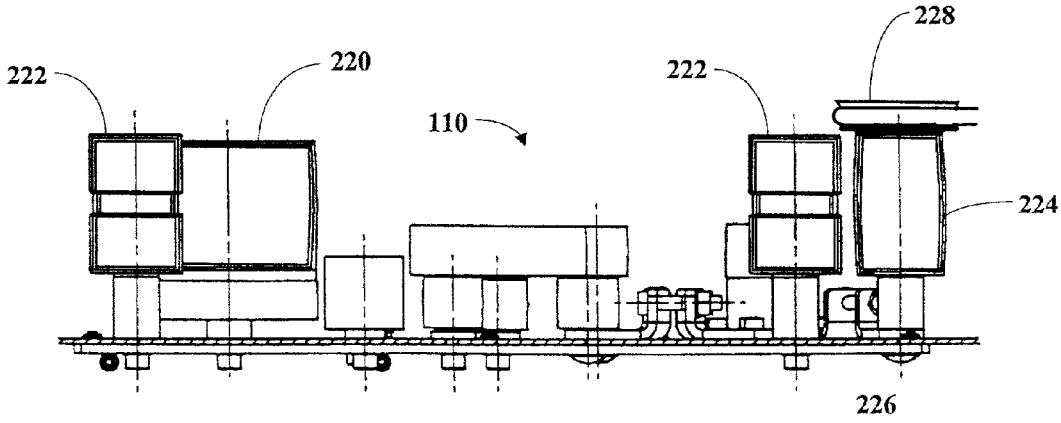
FIG. 19 is a side view of the mechanical power distribution mechanism of FIGS. 12 and 13 with power transmission belts removed for clarity.

The output portion of transmission mechanism 110 is shown in detail in FIGS. 18 and 19. As shown in FIG. 19, intermediate driven pulley 208 is fixed to inner conveyer driving pulley 220, which drives inner conveyer belt 108. Tension in inner belt 108 is maintained by fixed idlers 222 and tensioner idler 224, which is mounted on tensioner bracket 226.

As can be seen in FIGS. 18 and 19, horizontal conveyer drive belt 112 is driven by driving pulley 228. Driving pulley 228 is fixed to tensioner idler 224, so that motion imparted to tensioner idler 224 by inner conveyer belt 108 is transmitted to horizontal inlet conveyer 106 through drive belt 112.

Figure 20:
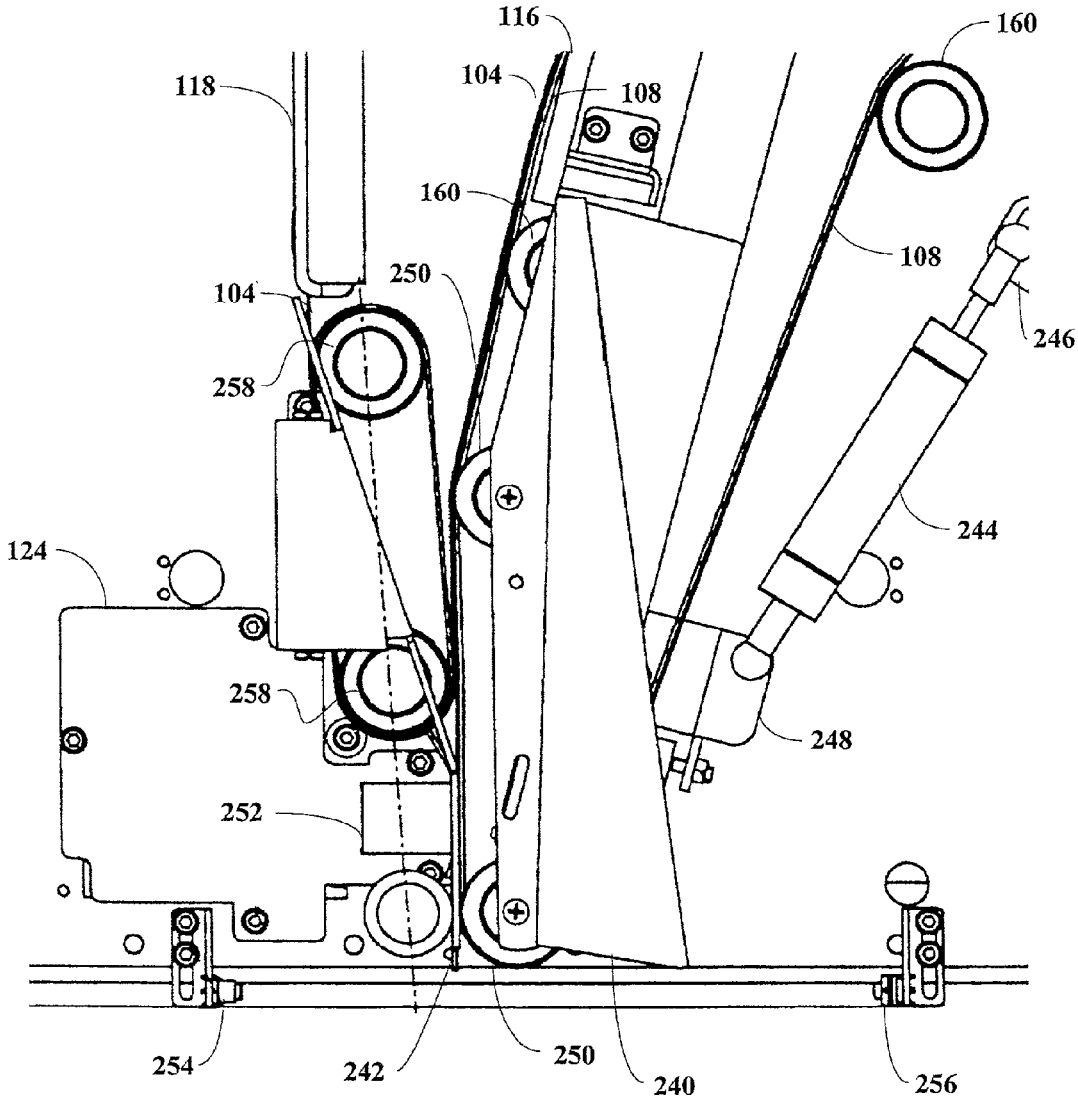
FIG. 20 is a top view of the mail piece exit section of the mail piece turner module of FIGS. 7–10.

The exit section of turner module 16 is shown in detail in FIG. 20. As with the entry portion of the turner module 16, the exit section incorporates an inner guide flange 240 and an outer guide flange 242, which are designed to guide the exiting mail piece into the twister module 20. The exit portion of the turner module 16 is constricted so that mail pieces cannot pass out of the turner module 16 without displacing the inner guide flange 240 and its accompanying idlers 250. In order to accommodate mail pieces passing out of the turner module 16 through inner flange 240 and outer flange 242, inner flange 240 is designed to be displaced by the mail piece. When no mail piece is present between inner flange 240 and outer flange 242, flange 240 is held against flange 242 by shock absorber 244, which is mounted to inner flange 240 by mount 248 at one end and is mounted to frame 100 of turner 16 by bracket 246 at the other end. Outer flange 242 incorporates a printer 124 to facilitate application of bar codes or other machine readable patterns to the mail pieces as they pass out of turner module 16 between guide flange 240 and print head 252. As shown in FIG. 20, turner module 16 incorporates exit photo emitter 254 and exit photo detector 256, which are similar to the photo sensors used at the entry of turner module 16 and described above. As with the entry sensors, photo sensors 254 and 256 allow the control hardware to determine when a mail piece is passing out of turner module 16.

Mail pieces leaving turner module 16 pass into twister module 18. Twister module 18 is shown in isometric view in FIG. 21. As described above, in the sorter 10 of the present invention, the shipments are separated out from a stack in the feeder module 12. The mail pieces retain an upright vertical orientation as they pass out of the feeder module 12 and through scanner module 14 and turner module 16, as the feeding and turning operations are most easily accomplished with vertical mail pieces. In order to distribute the mail pieces subsequently to an optimal number of sorting bins while requiring a minimum of floor space for the machine, however, it is advantageous to stack the sorting bins vertically and to fill the bins with mail pieces having a horizontal orientation.

It follows, therefore, that the mail pieces, during their travel through the sorting machine 10, must be changed from the vertical orientation, in which they stand on their edges, to a horizontal orientation, in which they lie on a flat face. This task is accomplished in the twister module 18. In this module, mail pieces undergo a rotation about an axis parallel to the direction of travel by an angle of approximately 90 degrees, depending somewhat on the particular shape of each mail piece.

Mechanisms for modifying the orientation of mail pieces, in which the mail pieces are clamped between driven conveyor belts and conveyed through the sorting machine, are known. The belts in such mechanisms are correspondingly twisted together along the direction of travel. This mechanism has been shown to be effective for rotating post cards and standard sized letters. For handling a wider size range of mail pieces, however, this type of mechanism cannot assure reliable operation in a compact apparatus. Belt clamping does not assure secure, nonslip conveyance of heavy mail pieces, and if a relatively thick mail piece is followed by a relatively thin mail piece, the latter will not be grasped tightly enough by the belts that are spread apart by the thicker mail piece. This undesirable effect can only be avoided in a belt clamping design by maintaining very long space intervals between mail pieces.

A twisting apparatus designed to twist thick mail pieces using a belt clamping mechanism would have to be very long, with undesirably long gaps between mail pieces, making the machine less productive due to a significantly reduced throughput rate. One design having spring-supported rollers is known to partially alleviate the above-described disadvantages, but such a design is complex and does not assure reliable functionality.

One object of the design of the twister module 16 of the present invention is, therefore, to create a compact apparatus for securely twisting mail pieces of various sizes and weights by rotating them about their longitudinal axis, from a vertical orientation in which they stand on their edges, to a horizontal orientation in which they lay on their sides, during conveyance at medium speed.

The controlled re-orientation of the mail pieces in the manner of twister 18 facilitates a reliable and relatively inexpensive twisting apparatus having a relatively short length. Additionally, twister module 18 performs the re-orientation with minimal change in the spacing intervals between successive mail pieces.

Figure 22:
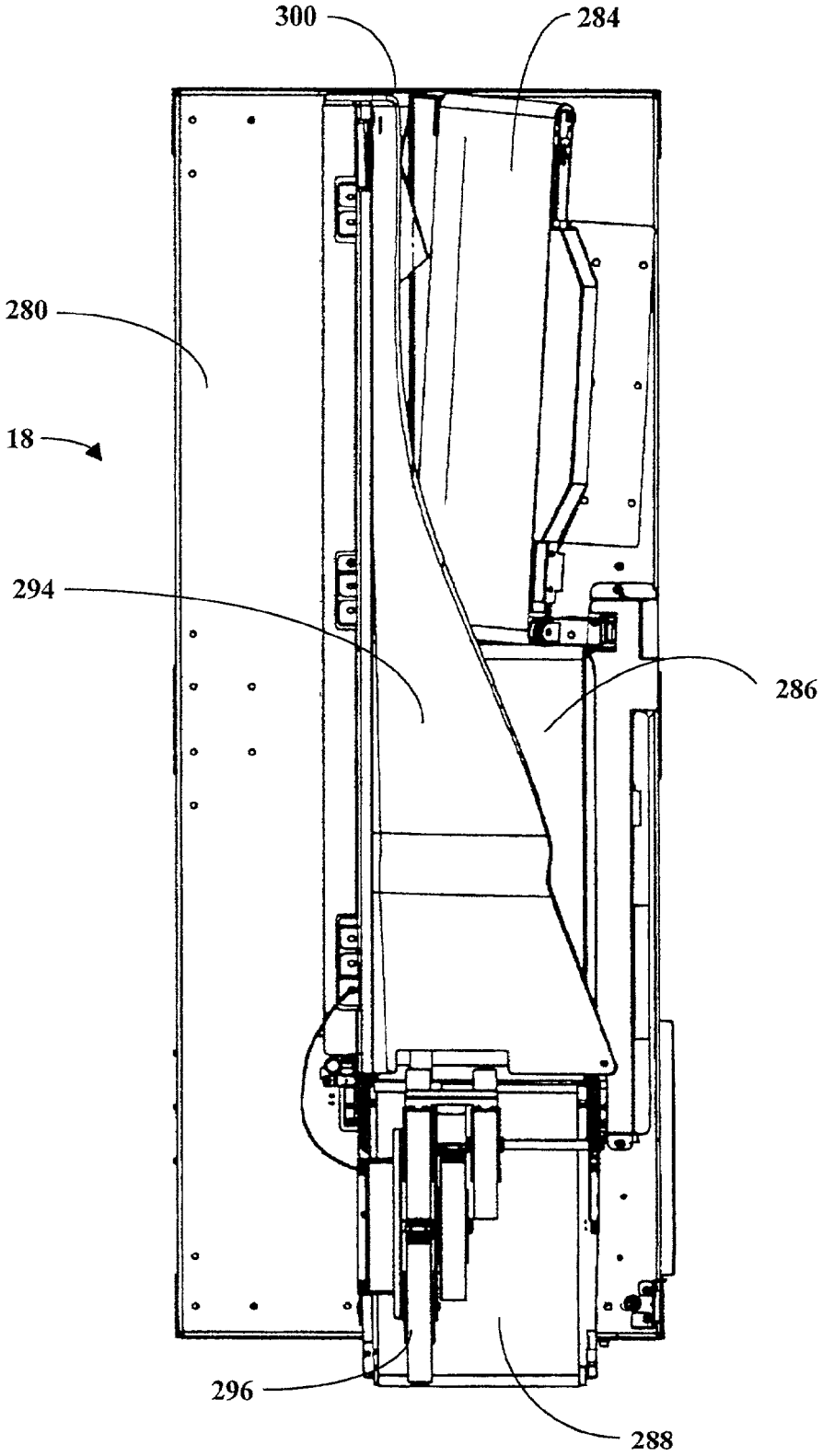
FIG. 22 is a top view of the mail piece twister module of FIG. 21.
Figure 23:
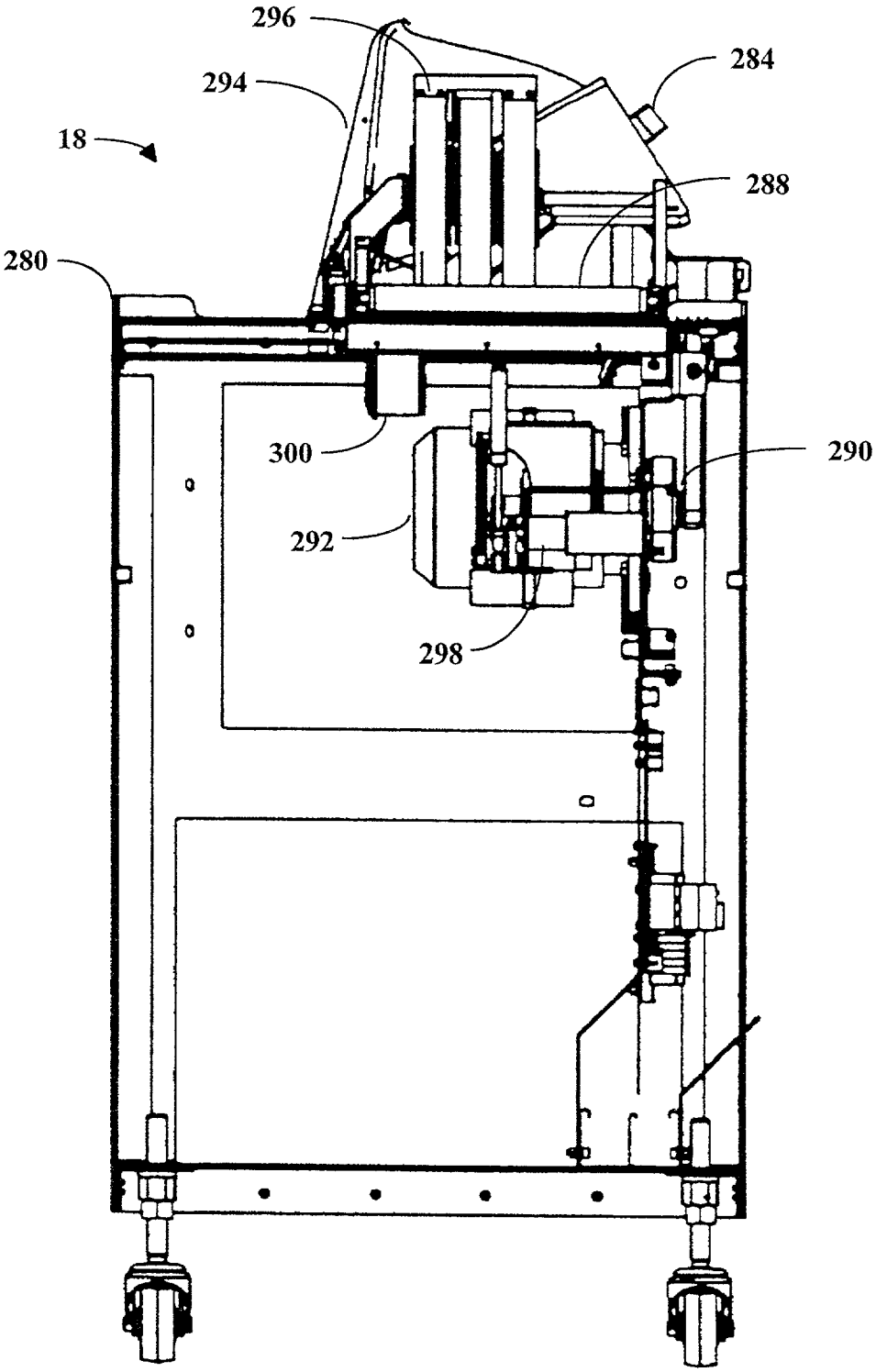
FIG. 23 is an end view of the mail piece twister module of FIGS. 21 and 22 with certain frame components removed for clarity.
Figure 24:
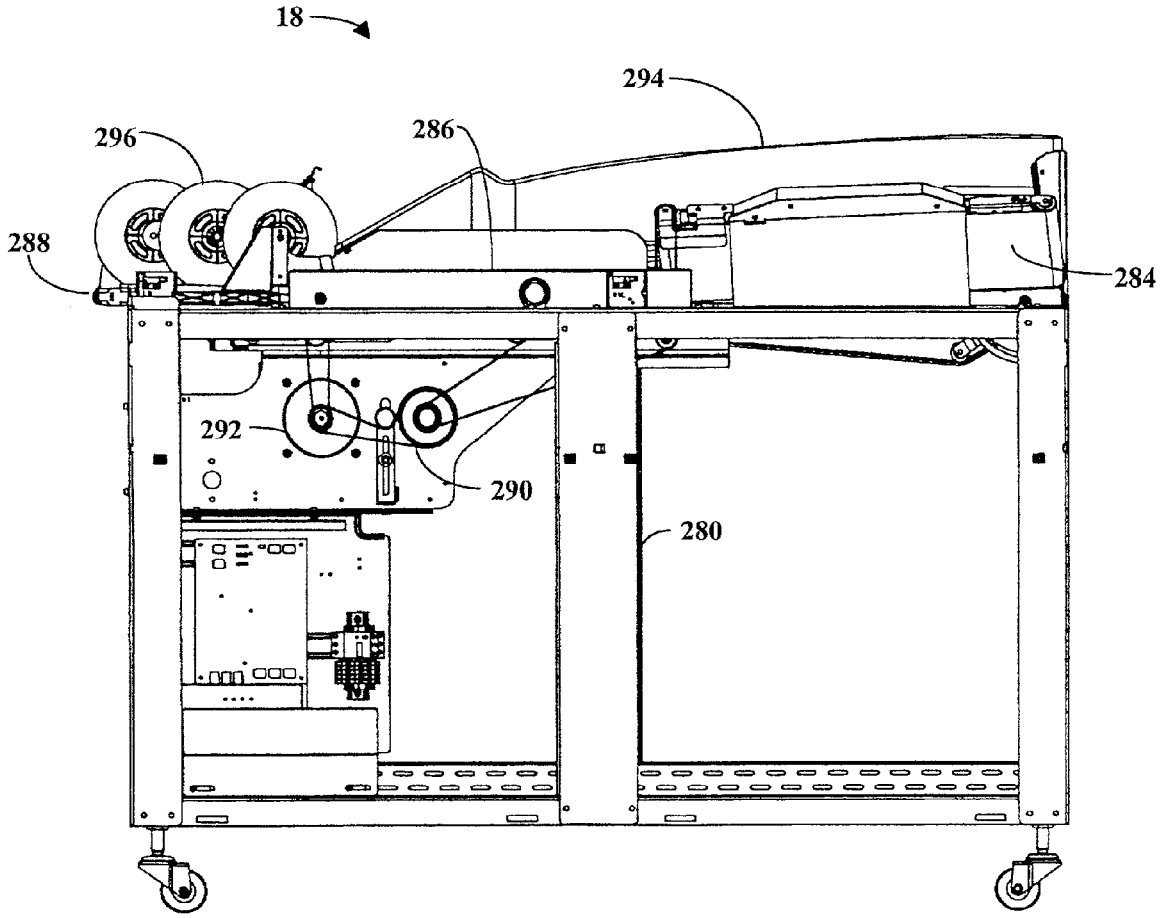
FIG. 24 is a side view of the mail piece twister module of FIGS. 21–23.

As with the above-described modules, twister 18 is built around a frame 280 riding on casters 282. The function of the twister module is two-fold. The entry portion of the twister module 18 is designed to accept mail pieces having a substantially vertical orientation and rotate them about their direction of travel to a horizontal orientation. This is necessary because the downstream modules of the mail sorter are designed to work with horizontal, rather than vertical mail pieces. The exit portion of the twister module 18 is designed to divert the horizontal mail piece to an upper or a lower path through the remainder of the mixed mail sorter 10. The travel path of the mail piece is determined according to the location of the destination bin for the mail piece, which is determined by the control software according to the address printed on the mail piece. FIG. 22 is a view of the twister module from the top, while FIG. 23 is an end view of twister module 18, and FIG. 24 is a side view of twister module 18.

Figure 21:
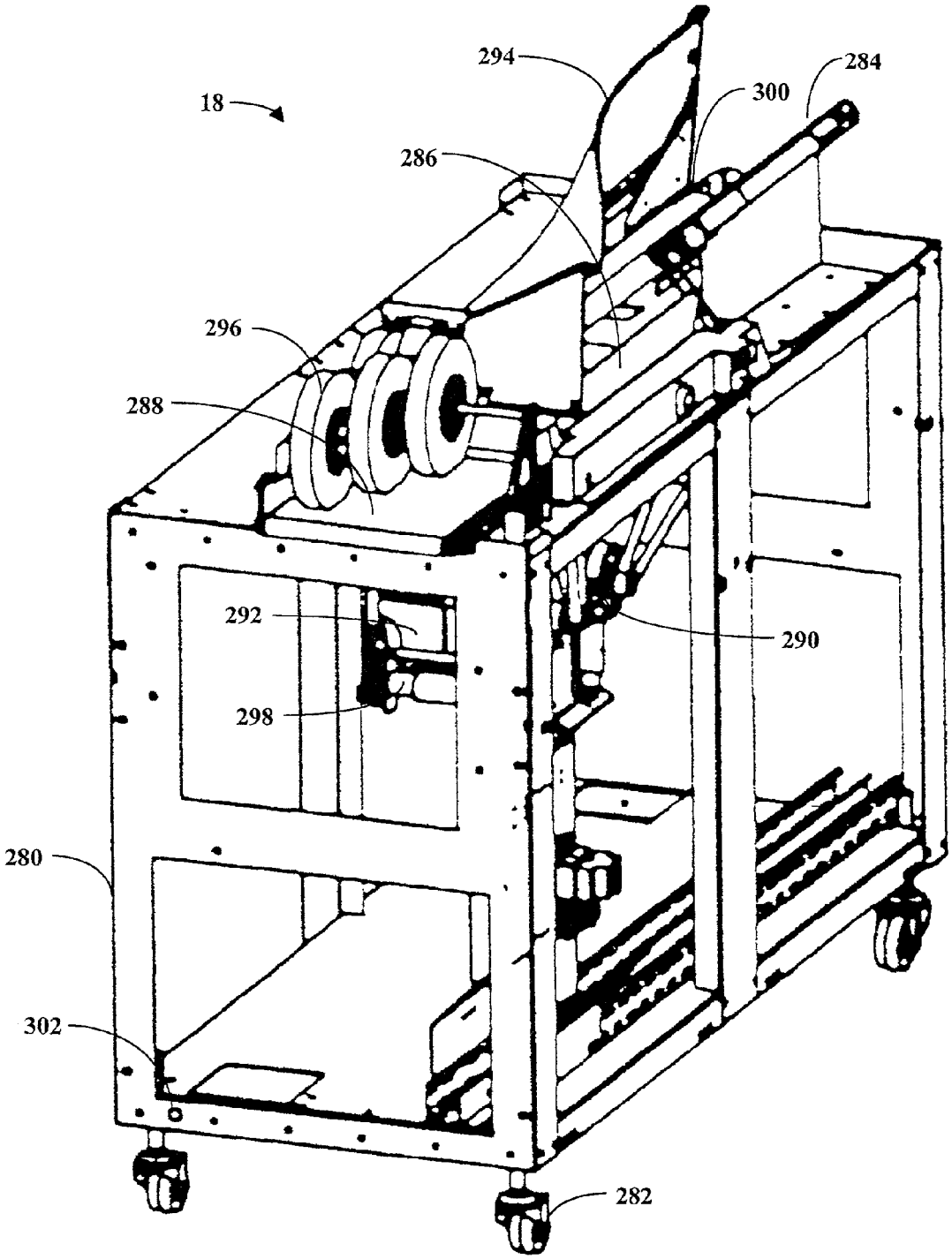
FIG. 21 is an isometric view of a mail piece twister module of the sorter of FIG. 1.

As seen in FIG. 21, the mechanical portion of twister 18 comprises an angled entry conveyor 284, an intermediate horizontal conveyor 286, and a diverter gate conveyor 288, all of which are driven by a power distribution mechanism 290, which receives power from drive motor 292. Mail pieces moving through the twister module 18 are rotated partly by gravity, and partly by deflector 294, which is designed to lay vertical mail pieces over to a horizontal orientation as they pass through the twister module 18. Mail pieces entering twister module 18 first encounter and are carried by horizontal entry conveyor 300. After traveling some distance down horizontal entry conveyor 300, a mail piece either falls or is deflected over onto angled entry conveyor 284, at which point it is borne by both horizontal entry conveyor 300 and angled entry conveyor 284. At this point the mail piece is disposed at approximately 45° from horizontal. Mail pieces carried by conveyors 284 and 300 are carried to the end of conveyor 284, at which point the outer edge of the mail piece is drawn by gravity down to intermediate conveyor 286. Conveyor 300 extends past the end of conveyor 286 and continues to carry the outside edge of the mail piece.

Intermediate conveyor 286 and conveyor 300 transmits the mail piece from conveyor 284 to diverter gate conveyor 288. The design of diverter gate 288 is similar to intermediate conveyor 286 and has a horizontal orientation. Gate conveyor 288 is distinct from intermediate conveyor 286, however, in that the exit end of convertor gate conveyor 288 can be actuated vertically to change the travel path of the horizontal mail piece. The position of diverter gate conveyor 288 is changed by converter gate actuator 298. Diverter gate conveyor 288 also incorporates compliant rollers 296, which serve to hold the mail piece tightly against diverter gate conveyor 288 as the mail piece passes out of twister module 18. Compliant rollers 296 are useful in that converter gate conveyor 288 will sometimes be disposed in an inclined position.

Figure 25:
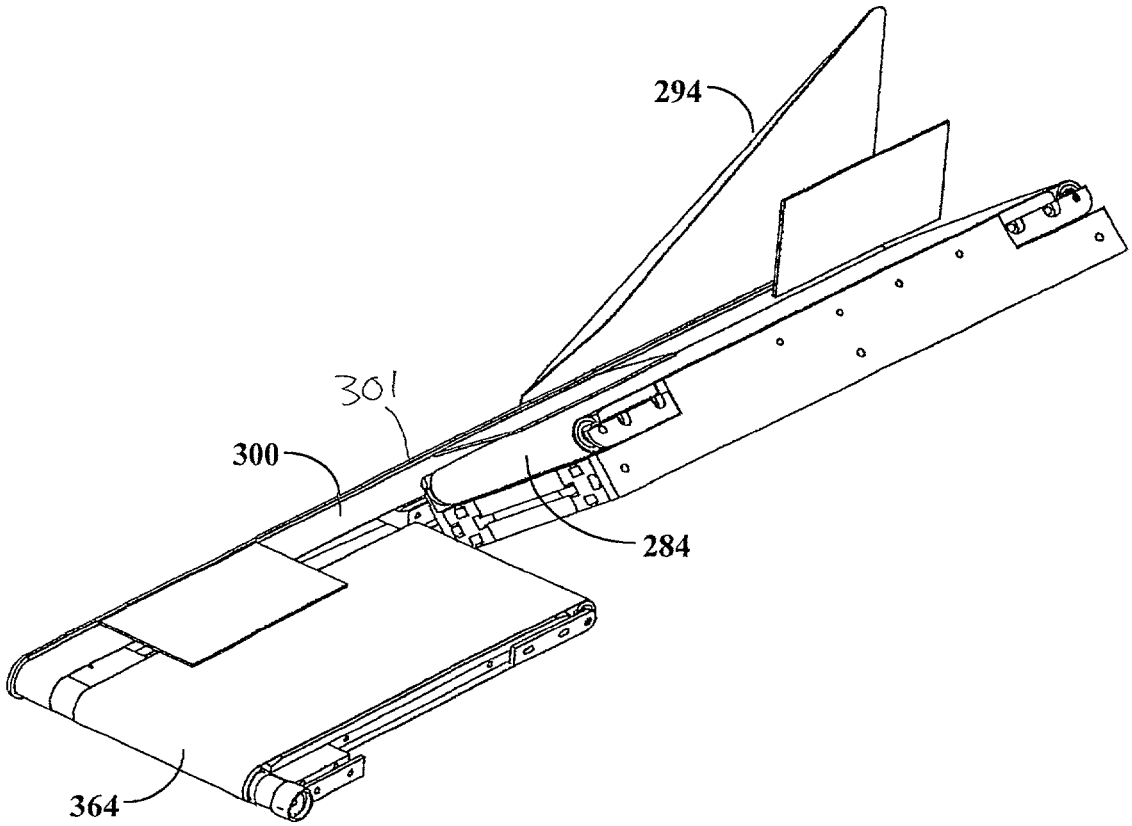
FIG. 25 is an isometric view of the entry and intermediate sections of the twister module.

The operation of the entry and intermediate sections of twister module 18 can be more clearly seen in FIG. 25. A mail piece enters the module 18 at the front edge of horizontal conveyor 300 in a vertical orientation. Because the mail piece is not supported at the sides, it is free to tip over. In certain embodiments of sorter 10, the mail pieces enter the twister module 18 in a slightly oblique orientation due to the guidance of the inner and outer exit flanges 240 and 242 of turner module 16, although this orientation is not absolutely necessary. The mail pieces may, therefore, be disposed in a preferential orientation for falling over as they enter twister module 18. Mail pieces that do not fall over on their own onto angled entry conveyor 284 are deflected over by deflector 294. Deflector 294 may be a guide baffle having a low coefficient of friction (i.e., a passive guide baffle), which deflects the mail piece during conveyance and tips it in the preferential direction. In embodiments for which positive drive is important and slippage must be minimized, deflector 294 may also incorporate a driven belt.

The mail pieces tip laterally onto the angled entry conveyor 284 so that instead of being borne solely by horizontal entry conveyor 300, they are borne also by angled entry conveyor 284. Since both angled entry conveyor 284 and horizontal entry conveyor 300 have a relatively low coefficient of friction, the shipment will tend to slide, under the influence of gravity, down the surface of angled entry conveyor 284 to the outside edge of horizontal entry conveyor 300. In certain embodiments, the direction of travel of angled entry conveyor 284 is disposed at an angle to the direction of travel of horizontal conveyor 300 so as to mechanically assist the action of gravity.

The outer edge of horizontal entry conveyor 300, which is approximately perpendicular to the bearing face of conveyor 300, has a higher coefficient of friction than the remainder of conveyor 300 and angled conveyor 284. This portion of conveyor 300 is primarily responsible, over the further course of the twisting process, for positive conveyance of the mail pieces. Once the trailing edge of the mail piece has moved past the trailing edge of conveyor 284, the mail piece falls over by its own weight through the remaining 40 to 45 degrees until it is resting on the intermediate conveyor 364.

An air cushion briefly forms between the mail piece and intermediate conveyor 364, and it is important that the mail piece not slide off or down the air cushion. In order to dissipate the air cushion, certain embodiments of the present invention incorporate a gap between the horizontal entry conveyor and the intermediate conveyor 364 for faster dissipation of the air cushion. Other embodiments may incorporate perforations in the horizontal entry conveyor and/or the intermediate conveyor 364. At low to medium conveying speeds (up to approximately 1 meter per second,) this compact twisting apparatus has been shown to achieve reliable re-orientation of the mail piece with relatively minimal change in the spacing interval between successive mail pieces, while maintaining high-quality orientation and positioning.

In certain embodiments, the intermediate conveyor 364 has a low coefficient of friction due to the fact that mail pieces are accelerated as they enter the exit section of twister module 18, and it is desirable that the intermediate conveyor 364 not serve as a drag on the acceleration of mail pieces having part of their length remaining on the intermediate conveyor 364. The apparatus described above can be used for a medium speed, up to approximately 1.5 meters per second.

Figure 26:
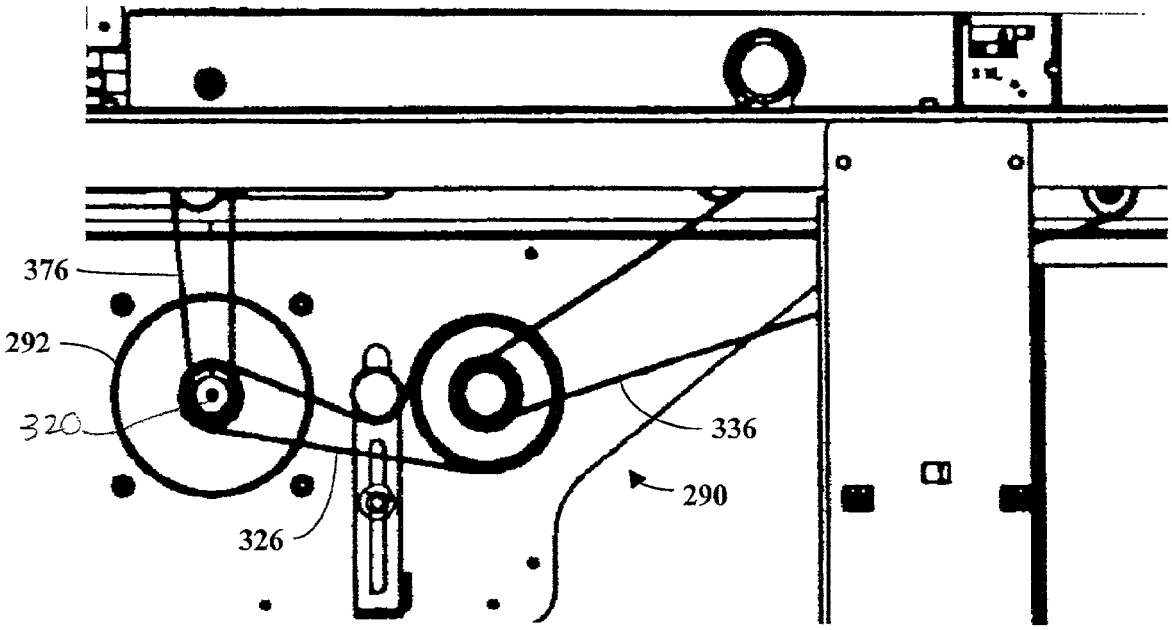
FIG. 26 is a detailed side view of the mechanical power distribution mechanism of the mail piece twister module of FIGS. 21–24.

FIG. 26 is a detailed view of the mechanical power distribution mechanism 290 of twister 18. FIG. 25 is the manner in which power from drive motor 292 is distributed to exit diverter drive belt 376, power transmission belt 326, and intermediate conveyor drive belt 336. As its name implies, exit diverter conveyor drive belt 376 transmits power to the exit diverter conveyor 288, while intermediate conveyor drive belt 336 transmits power to intermediate conveyor 286, angled entry conveyor 284 and horizontal entry conveyor 300. The operation of these mechanisms is described in more detail in the following drawings.

Figure 27A:
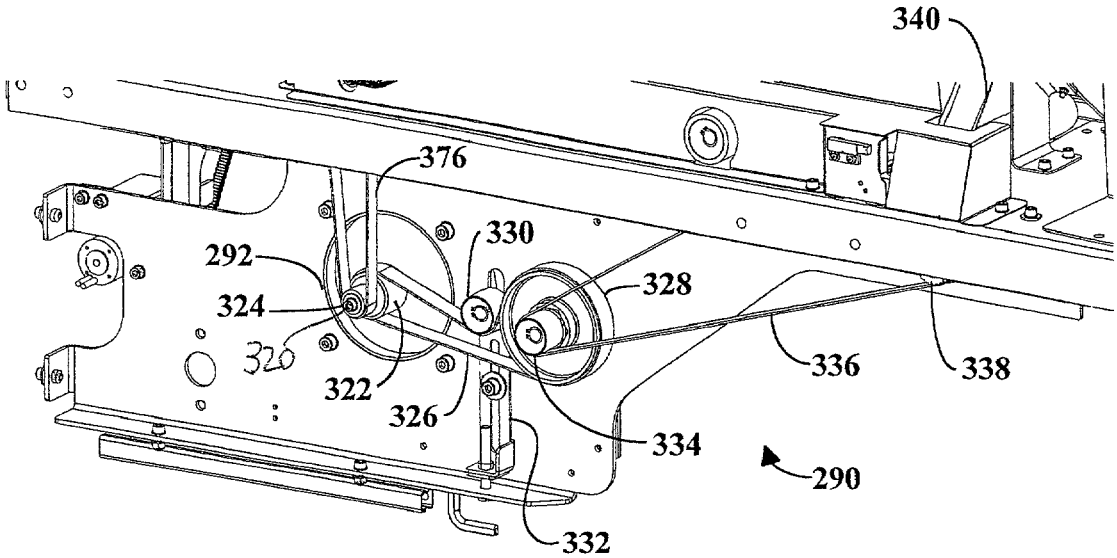
FIG. 27A is a detailed isometric view of the mechanical power distribution mechanism of FIG. 26.

FIG. 27A is an isometric view of power distribution mechanism 290, with portions of the frame 280 removed for clarity. As shown in FIG. 27A, power from motor 292 is transmitted from motor shaft 320 to inner drive pulley 322 and outer drive pulley 324, both of which are fixed to motor shaft 320. Inner drive pulley 322 drives power transmission driven pulley 328 through power transmission drive belt 326. Tension on power transmission drive belt 326 is maintained by tension of pulley 330 mounted to tensioner bracket 332.

Power transmission driven pulley 328 is fixed to intermediate conveyor drive pulley 334 which drives intermediate conveyor drive belt 336. Power is transferred from intermediate conveyor drive belt 336 to angled entry conveyor drive belt 340 through power transfer pulley 338.

Figure 27B:
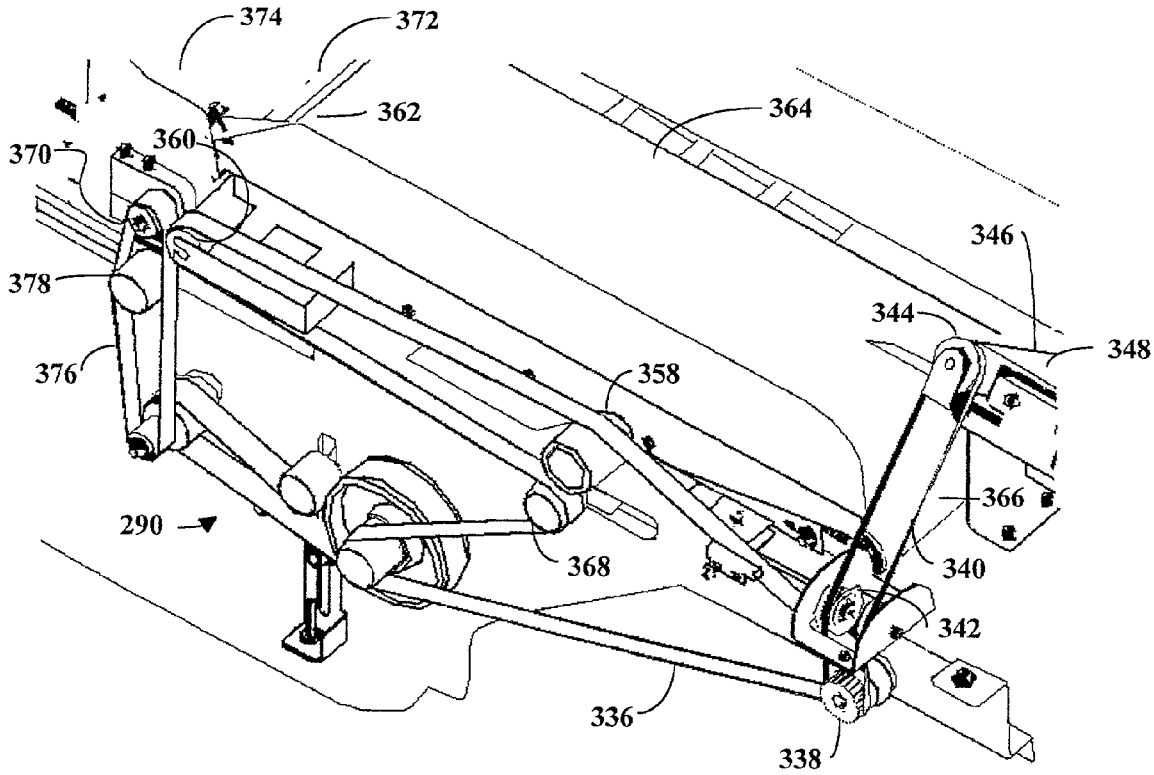
FIG. 27B is a detailed isometric view of the mechanical power distribution mechanism of the mail piece twister module of FIG. 26 with certain frame components removed for clarity.

FIG. 27B shows the power drive mechanism 290 of the twister module 18 having covers and frame components removed so as to facilitate clarity. The drive mechanism for angled entry conveyor 284 can be more clearly seen in FIG. 27. As shown in FIG. 27, drive belt 336 passes over power transfer pulley 338 then over upper idler 358, intermediate conveyor drive pulley 360, and lower idler 368. Power is transferred through drive belt 336 to the angled entry conveyor 284 and intermediate conveyor 286 through power transfer pulley 338 and intermediate conveyor drive pulley 360, respectively.

Power transfer pulley 338 drives angled entry conveyor drive belt 340, which passes over entry conveyor drive belt idlers 342 and then to angled entry conveyor drive pulley 344. Angled entry conveyor drive pulley 344 in turn drives angled entry conveyor drive roller 346 which drives angled entry conveyor belt 348.

Intermediate conveyor 286 and horizontal entry conveyor 300 are driven together in a similar manner to angled entry conveyor 284. Drive belt 336 drives horizontal conveyor driving roller 362 through horizontal conveyor drive pulley 360. Horizontal conveyor driving roller 362 in turn drives intermediate conveyor belt 364 and horizontal entry conveyor belt 354. Intermediate conveyor 286 and horizontal entry conveyor 300 transmit mail pieces from angled entry conveyor 284 to exit diverter conveyor 288. Intermediate conveyor 286 also functions as a landing surface for the outer edge of the mail piece as it drops off the edge of the angled entry conveyor drive roller 346 and is pulled by the force of gravity to the surface of intermediate conveyor belt 364. Intermediate conveyor 286 is driven at approximately the same speed as angled entry conveyor 284.

Figure 28:
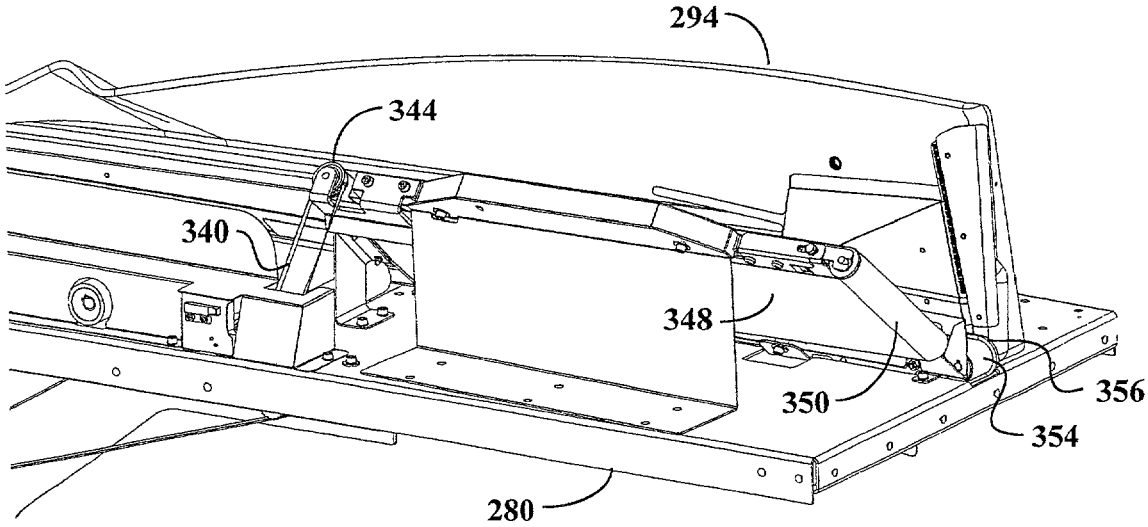
FIG. 28 is a detailed isometric view of the entry section of the mail piece twister module of FIGS. 21–24.
Figure 29:
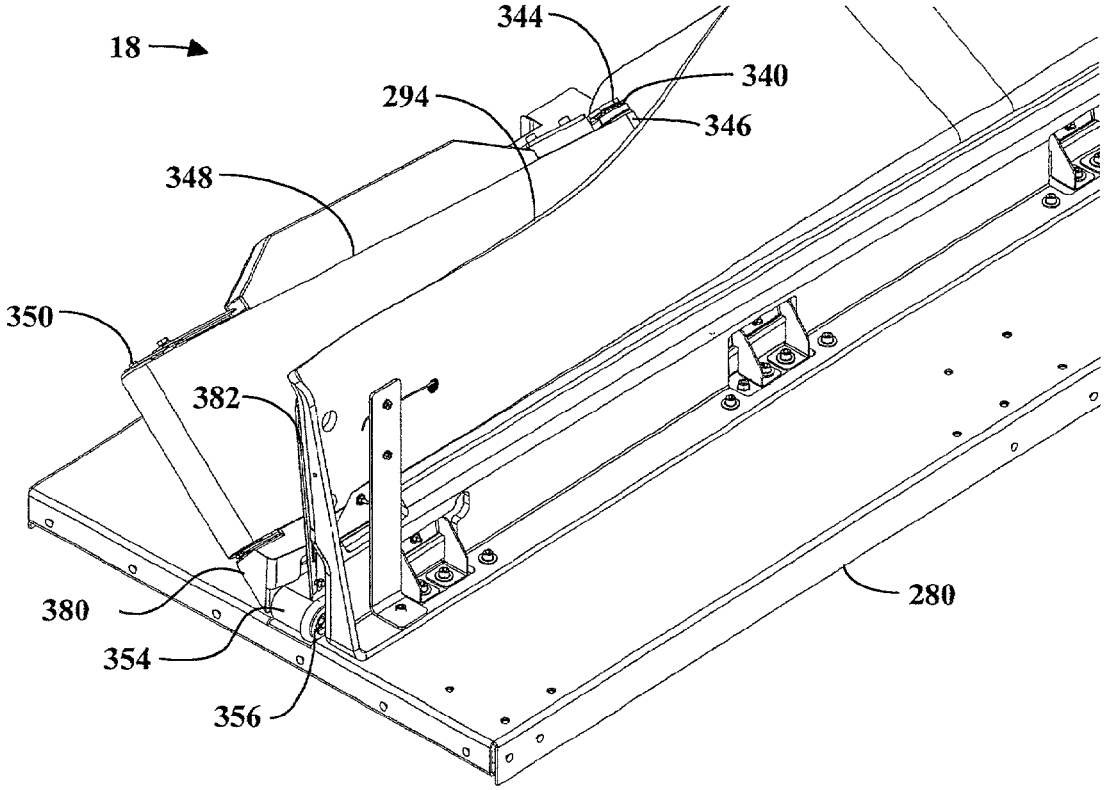
FIG. 29 is a second detailed isometric view of the entry section of FIG. 28.

Exit diverter conveyor 288 is driven through a separate mechanism from entry conveyors 284 and 300 and intermediate conveyor 286. A separate drive mechanism allows for a speed differential between exit diverter conveyor 288 and conveyors 284, 286, and 300. While the entry and intermediate conveyors are driven by drive belt 336, the exit diverter conveyor is driven by exit diverter conveyor drive belt 376, which powers exit diverter conveyor drive pulley 370. Tension in exit diverter conveyor drive belt 386 is maintained by exit diverter conveyor tensioner idler 378. Exit diverter conveyor drive pulley 370 drives exit diverter conveyor driving roller 372, which in turn drives exit diverter conveyor belt 374. FIGS. 28 and 29 show two isometric views of the entry portion of the twister module 18. FIGS. 28 and 29 more clearly show the manner in which the twister 18 receives mail pieces from turner 16 and guides and rotates them as they pass into the twister module 18. As seen in these views, a mail piece entering the twister module 18 first encounters the horizontal entry conveyor belt 354 riding on horizontal entry conveyor driven roller 356. The top portion of the mail piece is guided between inner guide flange 380 and outer guide flange 382. When the mail piece first enters the twister module 18, the inner guide flange 380 prevents the mail piece from contacting angled entry conveyor 284. Once the mail piece has moved completely into the twister module 18, and the back edge of the mail piece has moved past the inter guide flange 380, the upper leading edge of the mail piece will contact the deflector 294. The curved angled shape of deflector 294 is such that a mail piece traveling on horizontal entry conveyor 300 in an upright orientation is forced over onto the surface of angled entry conveyor belt 348 as it travels into twister module 18. Once the mail piece has been leaned over to rest on angled entry conveyor belt 348, the mail piece is carried by both the angled entry conveyor 284 and the horizontal entry conveyor 300.

Figure 30:
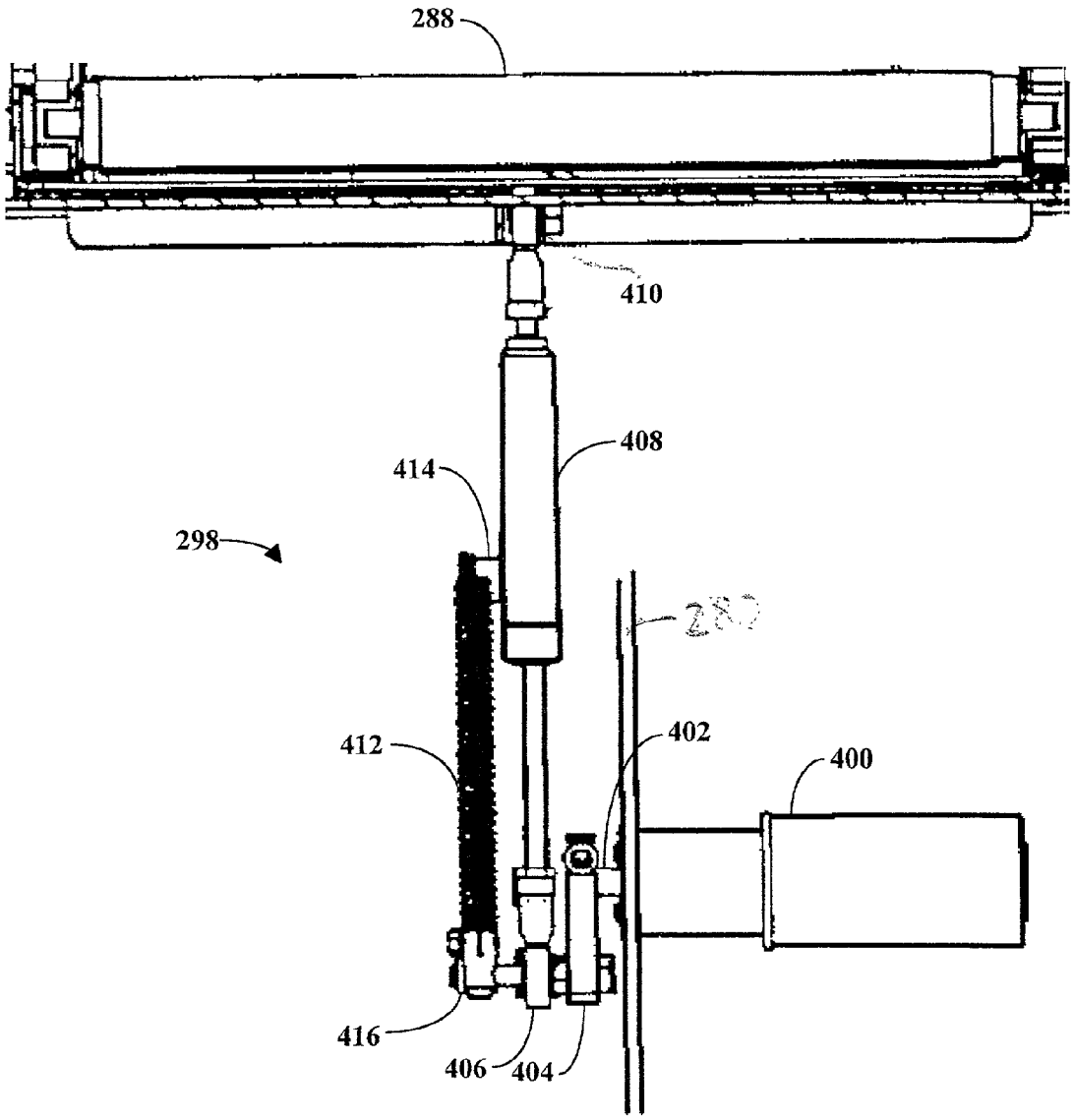
FIG. 30 is a detailed end view of the mail piece diverter gate of the mail piece twister module of FIGS. 21–24.

FIG. 30 is a detailed view of the diverter gate actuator 298 as seen from the exit end of the twister module 18. As seen in FIG. 30, exit diverter actuator 298 comprises a diverter motor 400 mounted to twister frame 280. Actuator bell crank 404 connects motor shaft 402 to actuator gas strut 408 and actuator spring 412. Gas strut 408 connects bell crank 404 to exit diverter conveyor 288 to enable exit diverter conveyor 288 to be raised and lowered so as to divert the travel path of a mail piece to a desired destination. Gas strut 408 is connected to bell crank 404 by swivel eye 406 and to exit diverter conveyor 288 by swivel eye 410. Spring 412 connects bell crank 404 to twister frame 280, and operates to assist motor 400 in raising exist diverter conveyor 288 against the force of gravity. Spring 412 is connected to frame 280 by mount 414 and to bell crank 404 by mount 416.

Figure 31:
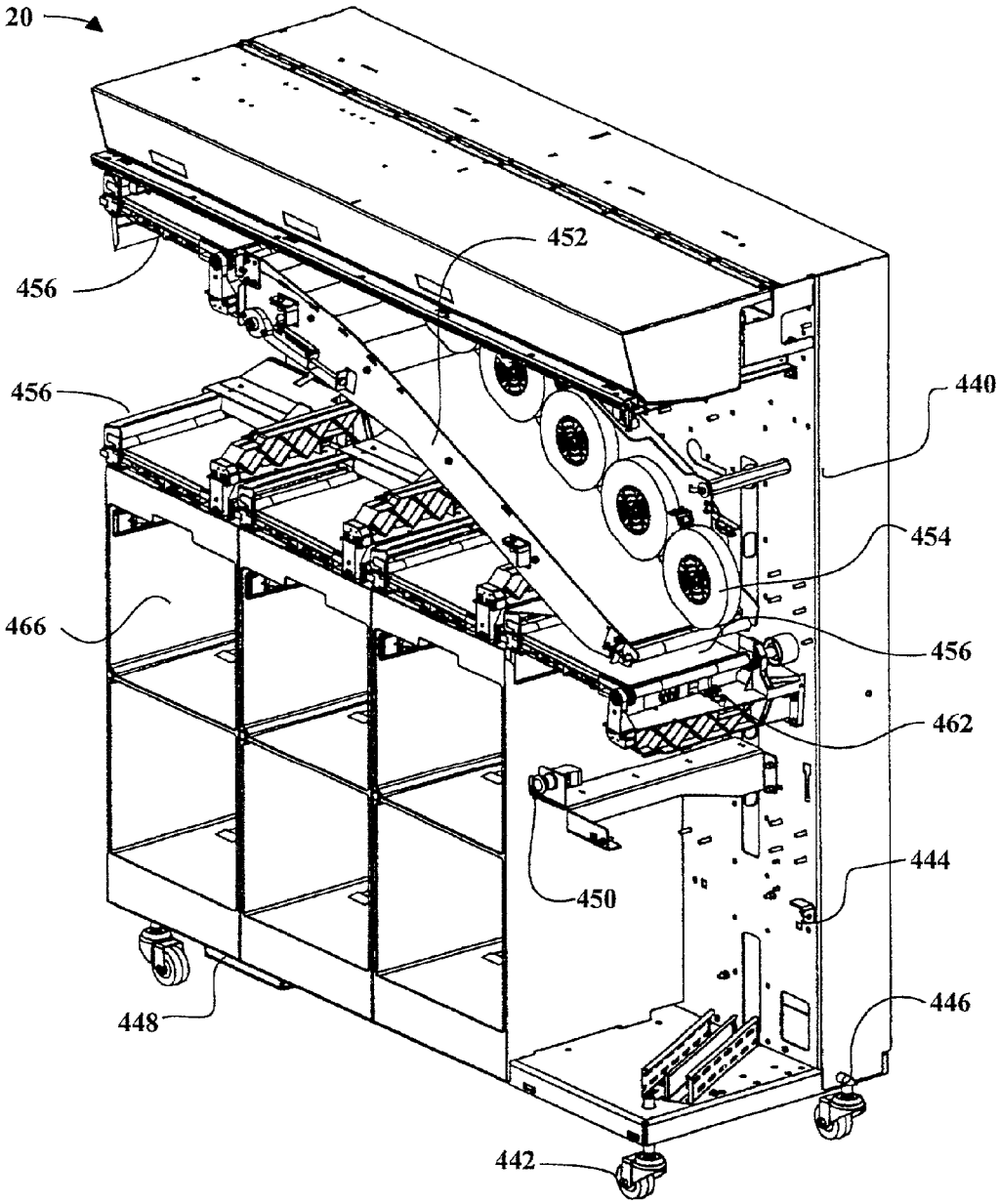
FIG. 31 is an isometric view of a mail piece elevator module of the sorter of FIG. 1.
Figure 32:
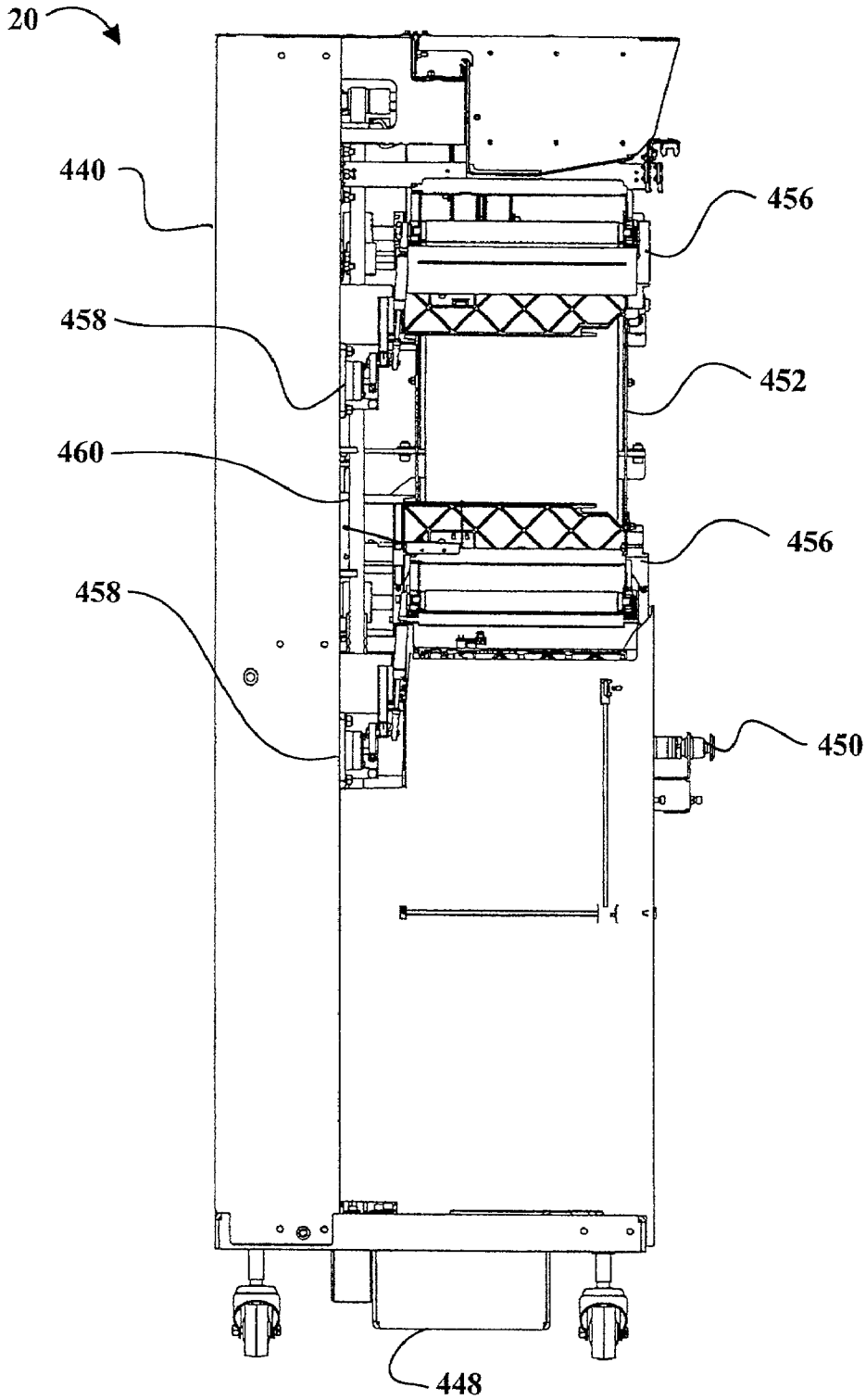
FIG. 32 is an end view of the mail piece elevator module of FIG. 31.
Figure 33:
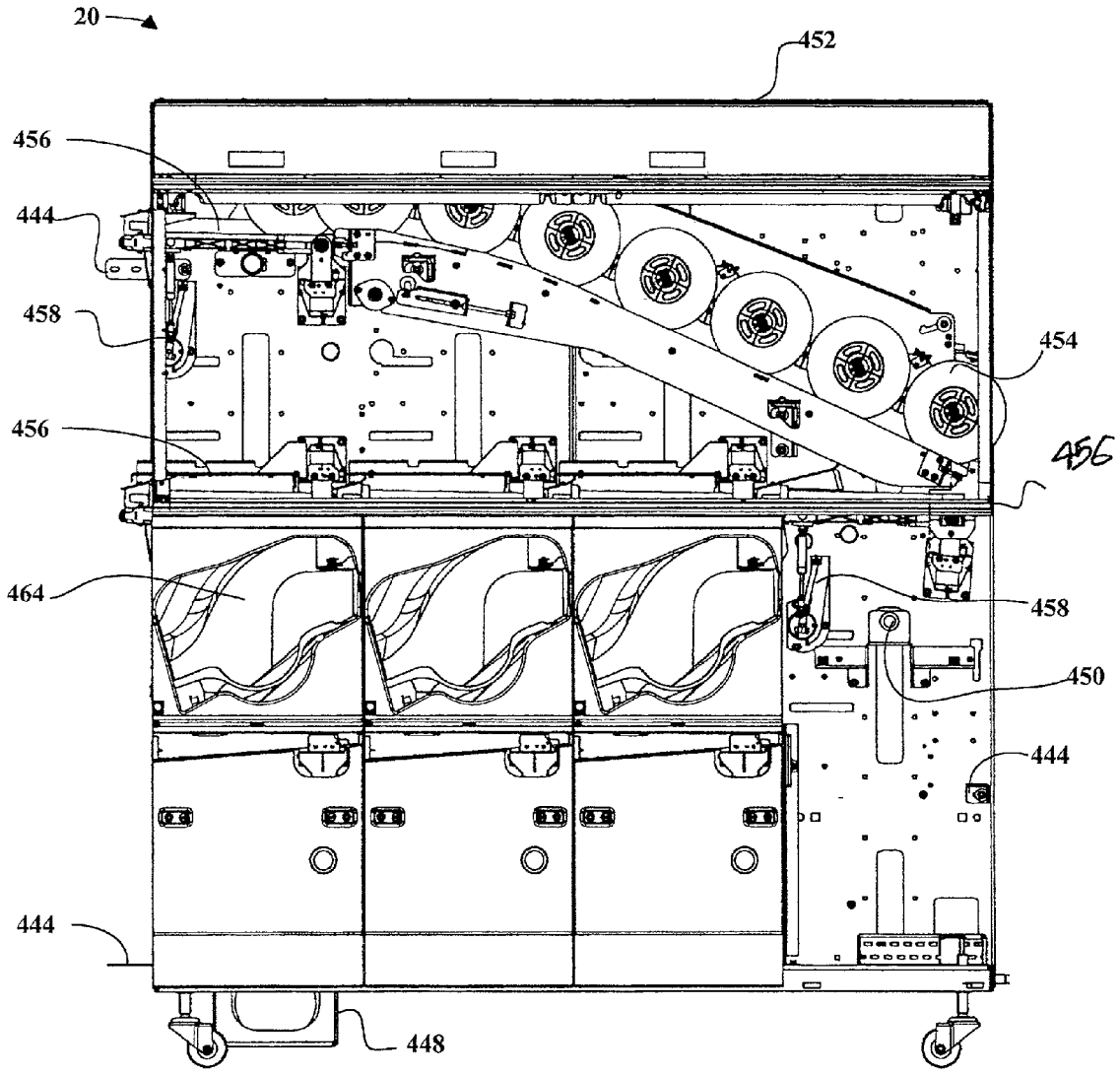
FIG. 33 is a side view of the mail piece elevator module of FIGS. 31 and 32.

Mail pieces exiting the twister module 18 pass into elevator module 20, which is installed between twister module 18 and the first bin module 22. The elevator module 20, shown in FIGS. 31–33, provides several functions for the mixed mail sorter 10. In addition to providing the function of raising mail pieces destined for the upper row of sorting bins, the elevator module 20 houses the first three bin receptacles 466 as well as the first five diverter gates 456. Mail pieces destined for the upper row of sorting bins are raised by the elevator 452 from the lower travel path to the upper travel path. Mail pieces are fed to either the upper or lower travel path by the exit diverter conveyor 288 of the twister module 18 described above. Elevator conveyor 452 incorporates a set of compliant rollers 454 similar to those incorporated into the exit diverter conveyor 288 of the twister module 18 to hold mail pieces in constant, positive, high-friction contact with elevator 452 as they are raised to the upper bin path.

As shown in FIGS. 31–33, elevator module 20 comprises an elevator module frame 440 riding on casters 442. The entry side of elevator module 20 is aligned to the twister module 18 through the use of alignment bullet 446 and is attached to the module fastener 444. As with the above-described modules, mechanical power for the elevator module 20 comes from a single central electric motor, in this case drive motor 448, at the bottom of the module 20. The motion in the device can be stopped by the user at any time by the use of emergency stop button 450.

Bin sorting within the mixed mail sorter 10 is performed by diverter gate mechanisms 456, which divert a mail piece traveling down the travel path into the proper bin at the appropriate time. As an example, a mail piece entering the elevator module 20 may be destined for the first bin in elevator 20. In this situation, the control computer for the mixed mail sorter 10 will divert the exit diverter conveyor 288 in the twister module 18 to the lower position and will lower the first diverter gate mechanism 456 in the elevator module 20 to the lower position. Thus a mail piece leaving the twister module 18 will be diverted into the lower bin path and will be diverted by the diverter gate mechanism 456 downward into the bin receptacle 466, rather than continuing down the path to the subsequent bins. Although not shown in FIG. 31, bin receptacle 466 will normally contain removable sorting bins. Each diverter mechanism 456 incorporates a light barrier sensor 462 to monitor the progress and position of mail pieces as they pass through the elevator module 20.

FIG. 32 is an end view of elevator module 20, showing many of the same components as shown in FIG. 31 from a different vantage point. Additionally, FIG. 32 shows the diverter gate actuators 458 which act to raise and lower the exit end of the diverter gate mechanisms in the same manner as described above for the exit diverter in the twister module. FIG. 32 also shows drive belt 460, which distributes mechanical power through the elevator module 20.

FIG. 33 shows elevator module 20 from a side view showing many of the same features and aspects disclosed in FIGS. 31 and 32 from yet another vantage point. In particular, FIG. 33 shows the gate mechanisms 456 in a clearer side view as well as showing gate actuators 458. Additionally, elevator 20 shown in FIG. 33 is shown with three standard volume bins 464 which serve as the final destination for the sorter mail pieces.

Figure 34:
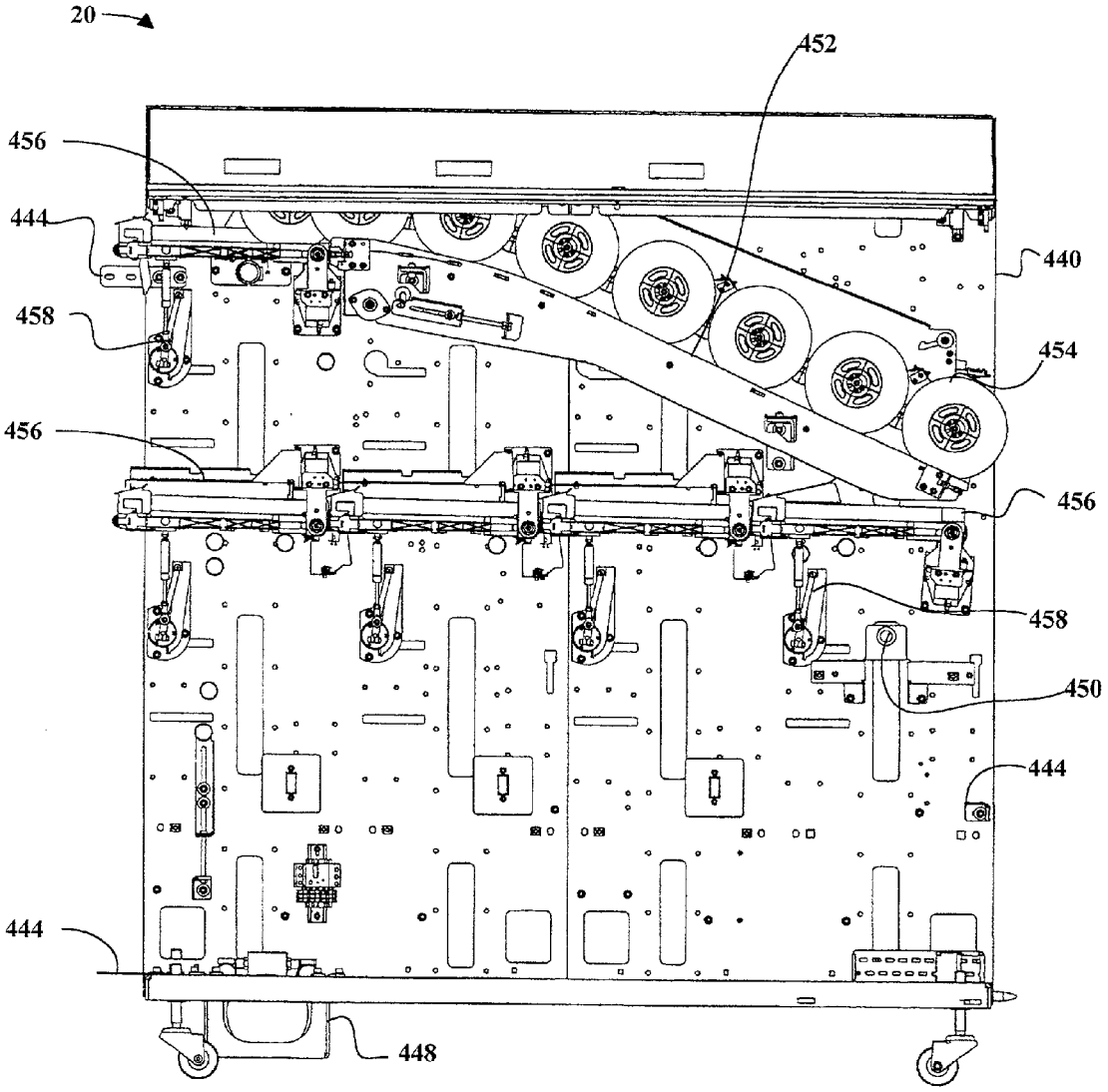
FIG. 34 is a side view of the mail piece elevator module of FIGS. 31–33 with all mail bins and bin receptacles removed for clarity.

FIG. 34 shows elevator 20 from the same vantage point as FIG. 33 with certain frame components, as well as bin receptacles 466 and bins 464, removed for clarity. In particular, the orientation and location of the four lower gate mechanisms 456 and gate actuators 458 can be seen with clarity. As shown in FIG. 34, all four gate mechanisms 456 are disposed end to end, so that as long as none of the gate actuators 458 is energized to divert gate mechanisms 456 to a downward angle, a mail piece will be carried from the entry to the exit of the elevator module 20 without being diverted or interrupted. Similarly, a mail piece carried up elevator 452 will be either carried onto the upper conveyor travel path of an attached bin module 22, or diverted into the first upper mail bin of an attached bin module 22, depending on the position of gate actuator 458 of upper gate mechanism 456.

Figure 35:
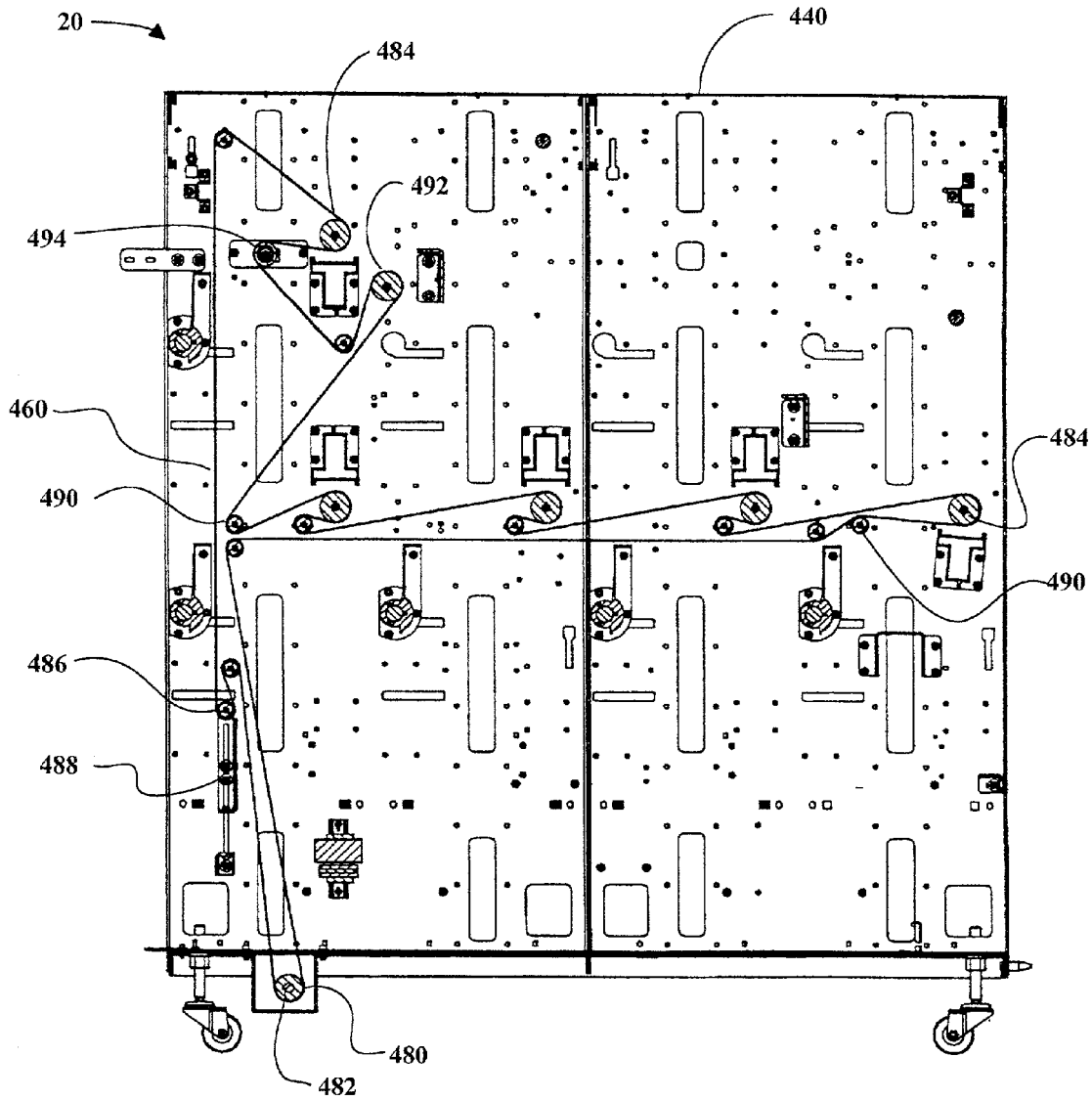
FIG. 35 is a side view of the mail piece elevator module of FIGS. 31–33 with all mail bins, bin receptacles, and conveyors removed for clarity.

FIG. 35 shows elevator module 20 from the same vantage point as FIGS. 33 and 34 with all gates bins and rollers removed, so as to more clearly show the power distribution mechanisms of the elevator module 20. As seen in FIG. 35, power is distributed through elevator module 20 by a single power drive belt 460. Power drive belt 460 winds through the machine around a series of idler pulleys and driven pulleys. As shown in FIG. 35, drive belt 460 is driven by motor drive pulley 480 attached to motor drive shaft 482. Drive belt 460 powers a series of driven pulleys, each of which is connected to a separate conveyor within the module. The drive system incorporates five gate conveyor drive pulleys 484, one for each diverter gate conveyor 456 within the module 20. The drive system also incorporates a single drive pulley 492 for powering the elevating conveyor of elevator mechanism 452. Also shown in FIG. 35 is module synchronization pulley 494. Synchronization pulley 494 serves to maintain uniformity in the conveyor drive speeds of the elevator module 20 and attached bin modules 22. Tension in drive belt 450 is maintained by tensioner idler 486 riding on tensioner bracket 488.

Figure 36:
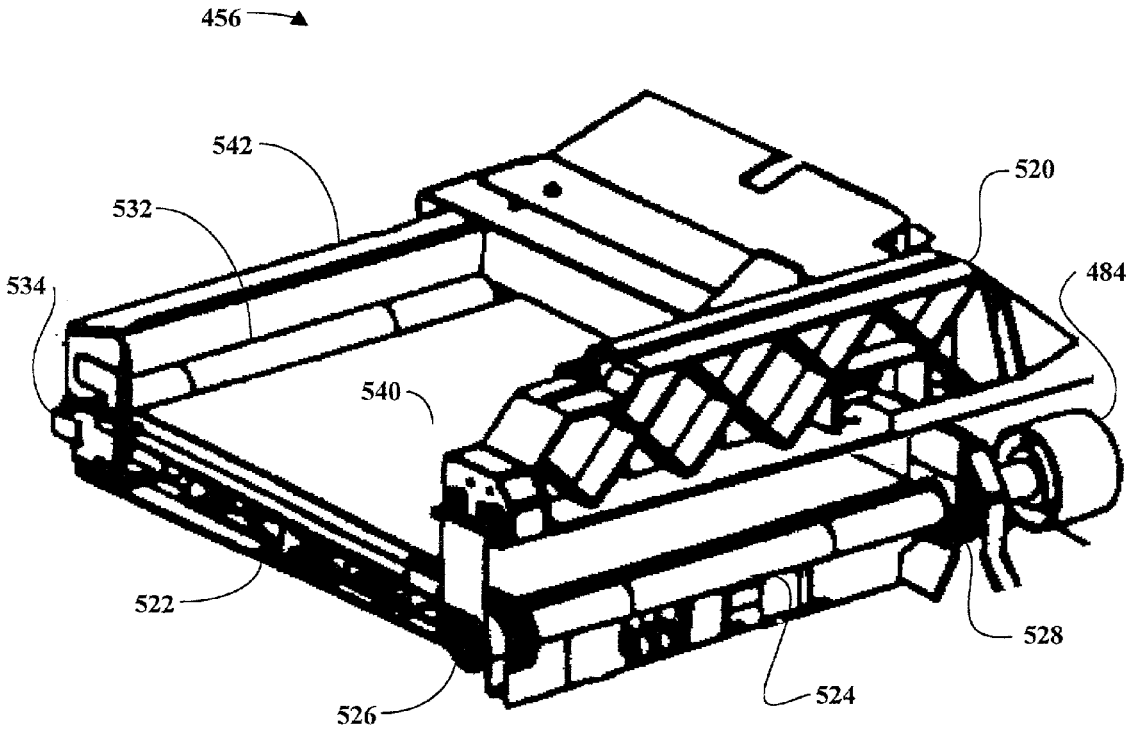
FIG. 36 is an isometric view of a mail piece diverter gate of the mail piece elevator module of FIGS. 31–33.

FIG. 36 is a detailed isometric view of a diverter gate mechanism 456 as used in elevator module 20. Gate mechanism 456 shown in FIG. 36 is shown without a conveyor belt installed so as to facilitate clarity. In operation, each gate mechanism 456 incorporates its own separate conveyor belt. Diverter gate mechanism 456 in essence comprises a tiltable conveyor module mounted to the module frame 440 by upper structural support 520. The conveyor belt is driven by driving roller 524, which rides between outboard front bearing 526 and inboard front bearing 528. Driving roller 524, in turn, is driven by gate conveyor drive pulley 484, which has been described in connection with FIG. 35 above. The gate mechanism 456 is designed to pivot around bearings 526 and 528 so that the exit end of the mechanism 456 can be diverted downward. This is done when a mail piece is to be diverted into the mail bin located at the exit edge of diverter gate 456. As shown in FIG. 36, the pivoting portion of gate mechanism 456 comprises outboard structural support 522, conveyor belt support surface 540, driven roller 532, outboard rear bearing 534, and deflector 542. The exit edge of mechanism 456 also comprises an inboard rear bearing which is not shown in FIG. 36.

Figure 37:
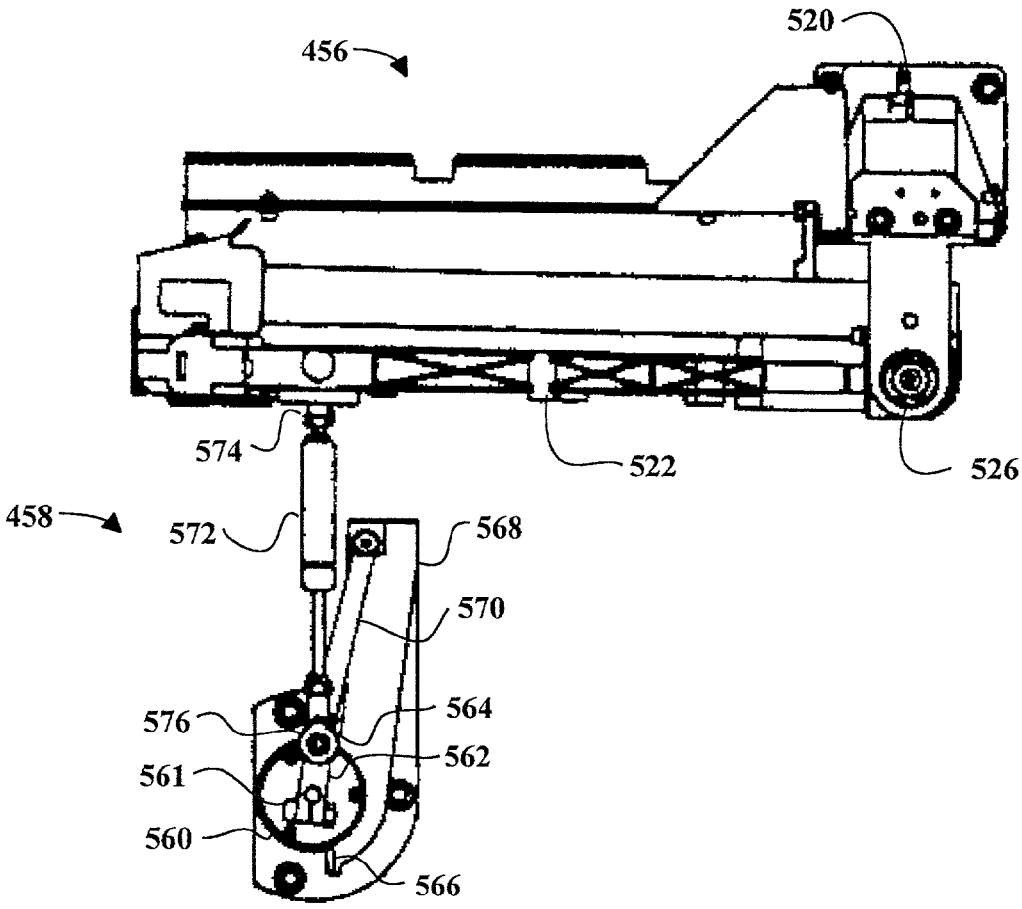
FIG. 37 is a side view of the mail piece diverter gate of FIG. 36 with the actuator bellcrank in the upper position.

FIG. 37 shows diverter gate mechanism 456 in an orientation in which diverter gate actuator 458 can be clearly seen. It will be noted that diverter gate actuator 458 is very similar in structure to twister exit diverter actuator 298. It is also very similar in function. Diverter gate actuator 458 comprises an actuator motor 560 having an actuator belt crank 562 mounted to motor shaft 561. In operation, belt crank 562 swings about an arc between upper travel stop 564 and lower travel stop 566. Travel stops 564 and 566 are mounted to travel stop support bracket 568. Gate actuator 458 incorporates a gate actuator spring 570 to assist the actuator motor in lifting the diverter gate 456 against the force of gravity. Belt crank 562 is connected to gate mechanism 456 by gas strut 562. Gas strut 572 is connected to gate mechanism 456 and bell crank 562 by upper swivel eye 574 and lower swivel eye 576.

Figure 38:
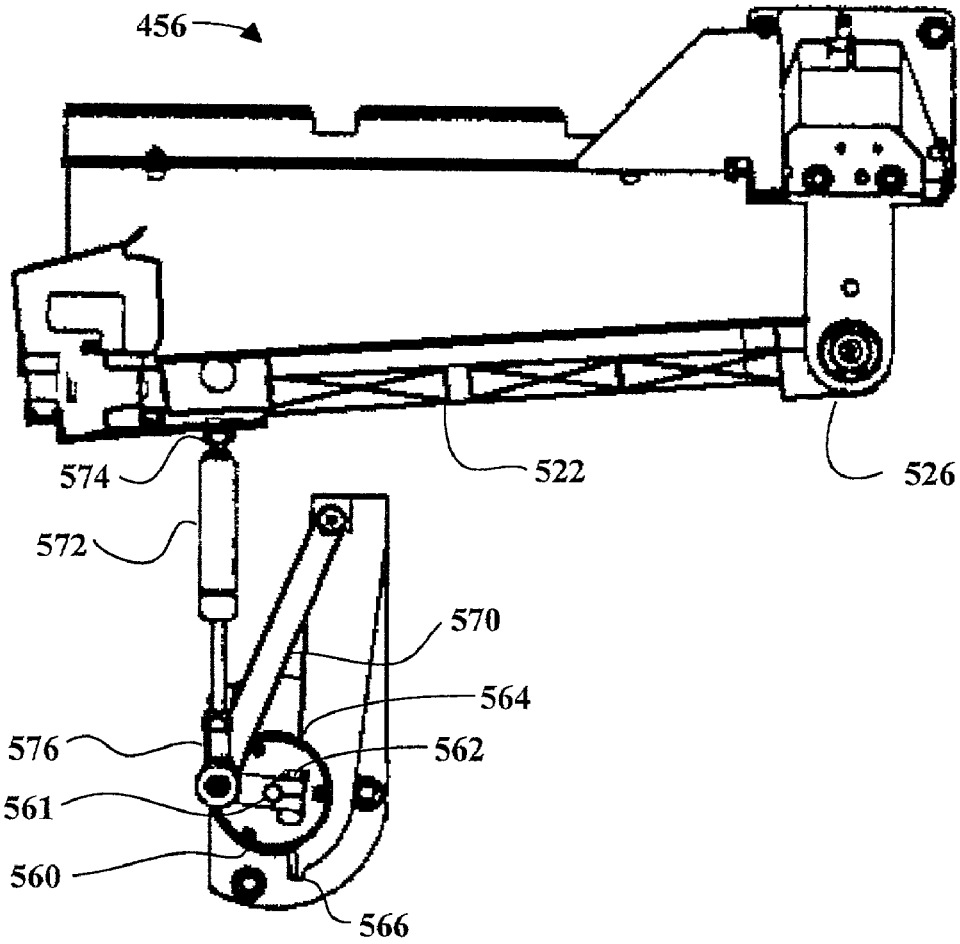
FIG. 38 is a side view of the mail piece diverter gate of FIG. 36 with the actuator bellcrank in an intermediate position.

FIG. 38 is a view of the actuator 458 shown in an intermediate position between upper travel stop 564 and lower travel stop 566. This view clearly shows the manner in which diverter gate 456 is lowered to divert mail pieces into a sorting bin. A diverter gate 456 disposed in this manner will carry a mail piece in a downward direction into a mail sorting bin disposed at the exit edge of gate mechanism 456, rather than carrying the mail piece horizontally to the next portion of the mail piece travel path. As shown in FIG. 38, deflector 542 serves to assist in diverting mail pieces into the sorting bin.

Figure 39:
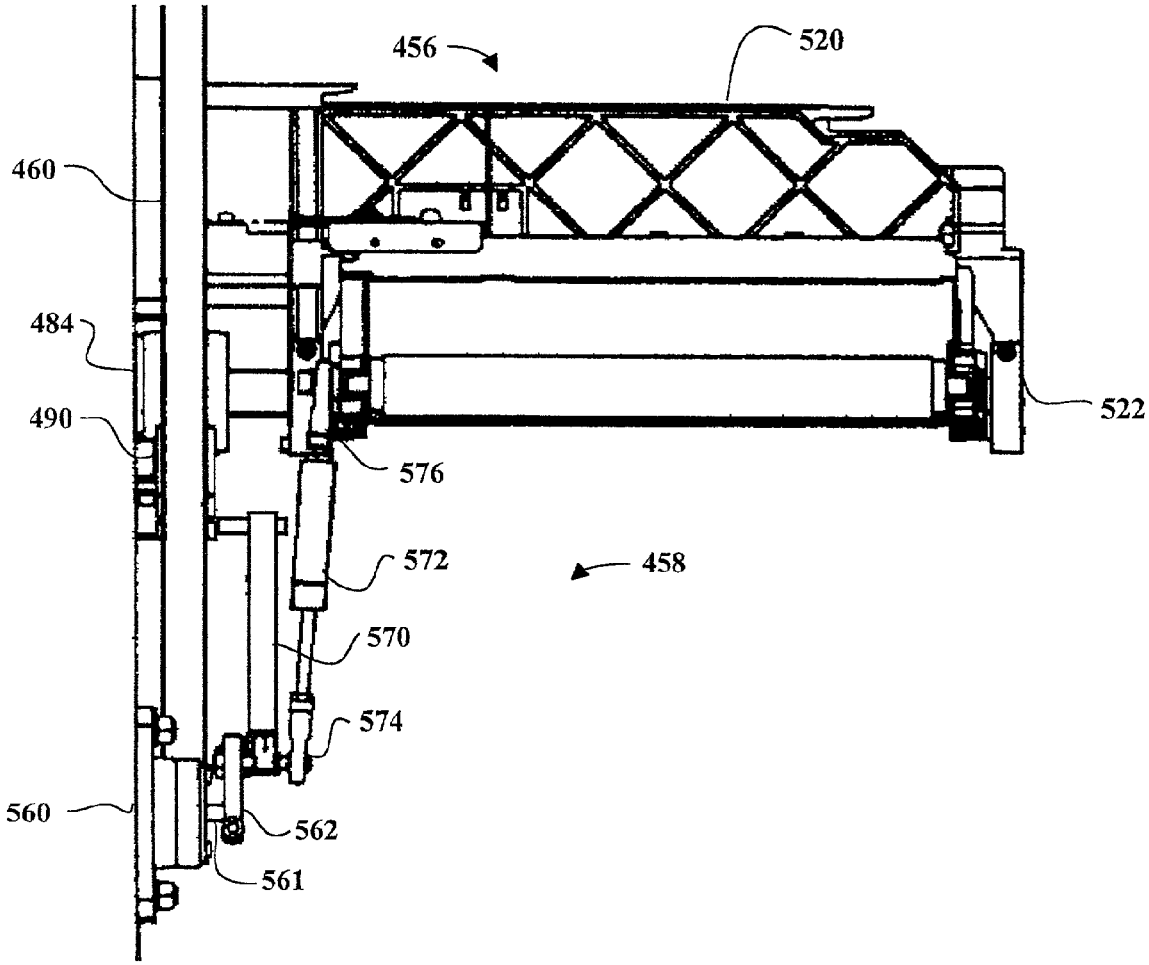
FIG. 39 is an end view of the mail piece diverter gate of FIG. 36.

FIG. 39 is an end view of a diverter gate mechanism 456 showing the orientation and the operation of the elements described above, in addition to showing an additional view of drive belt 460 conveyor drive, pulley 484 and idler pulley 490.

Figure 40:
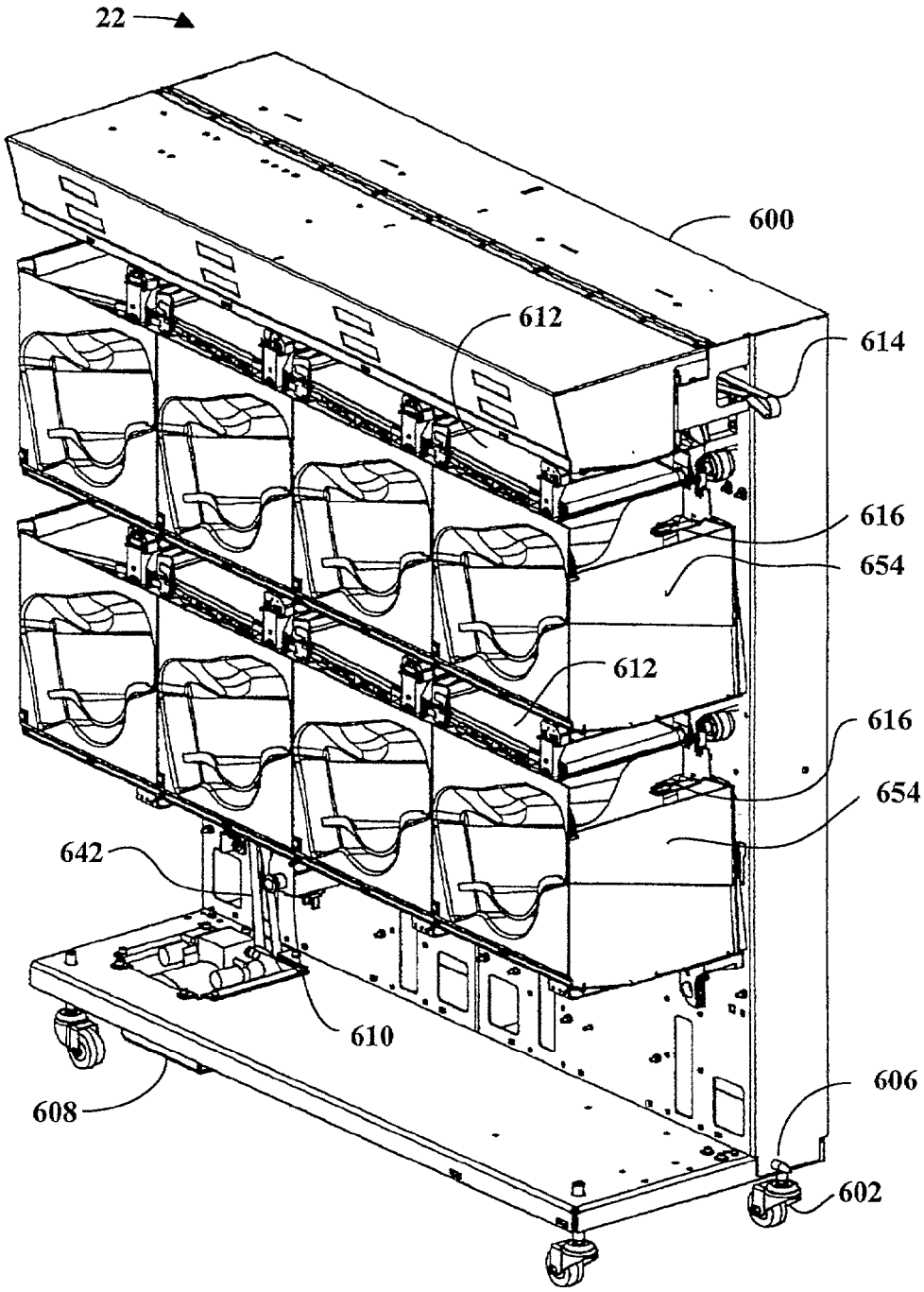
FIG. 40 is an isometric view of a bin module of the sorter module of FIG. 1.
Figure 41:
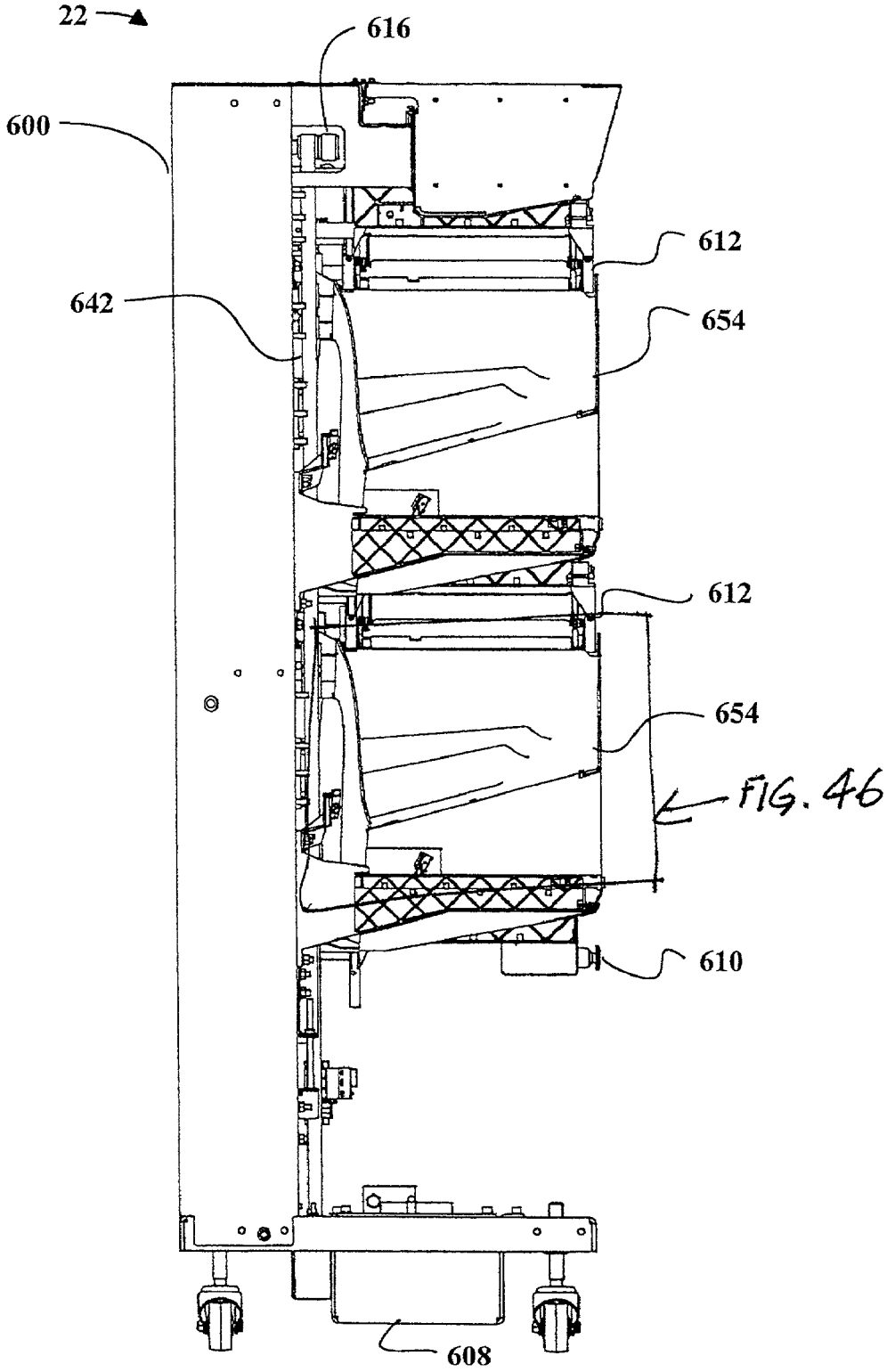
FIG. 41 is an end view of the bin module of FIG. 40.
Figure 42:
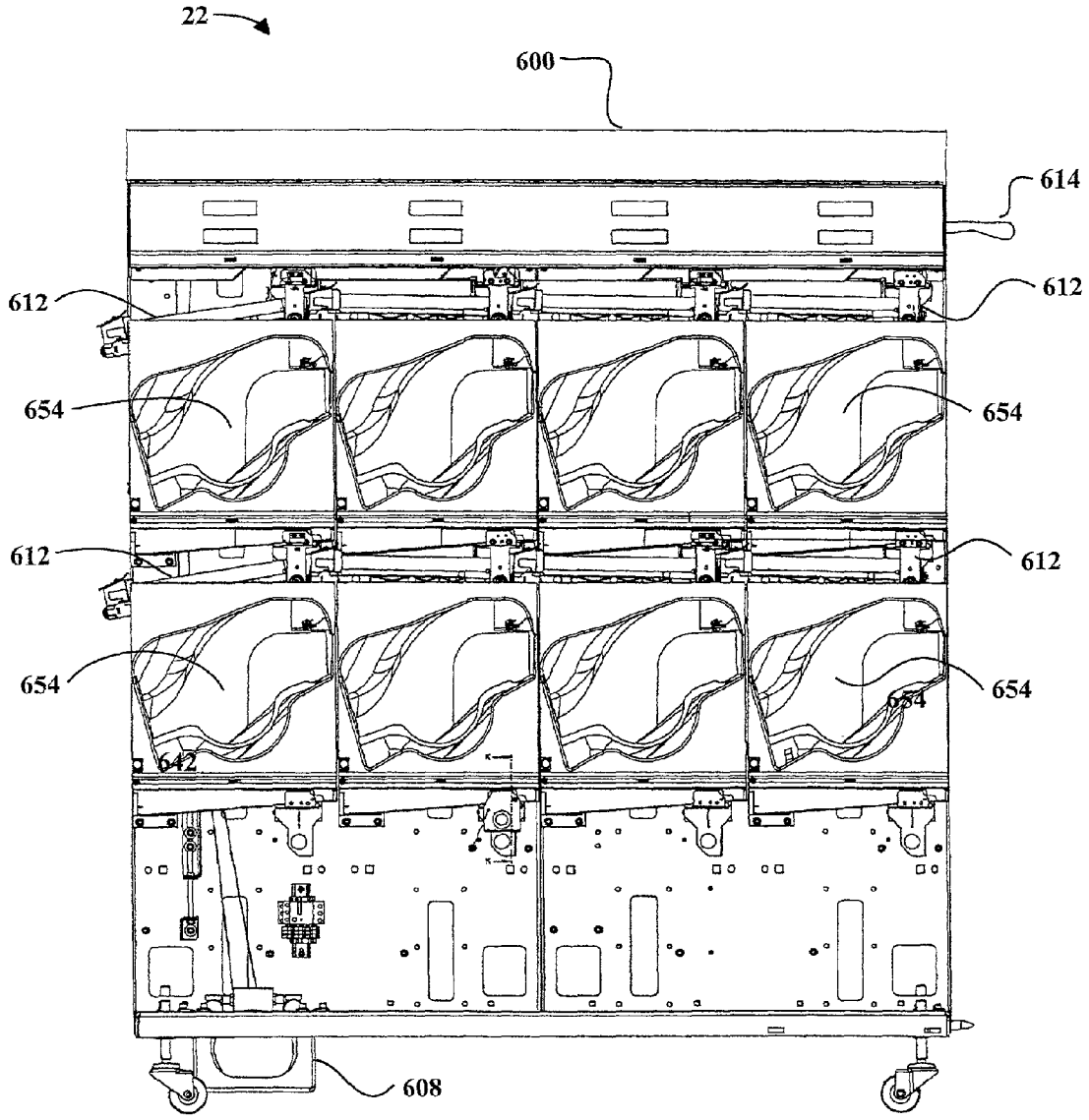
FIG. 42 is a side view of the bin module of FIGS. 40 and 41.
Figure 43:
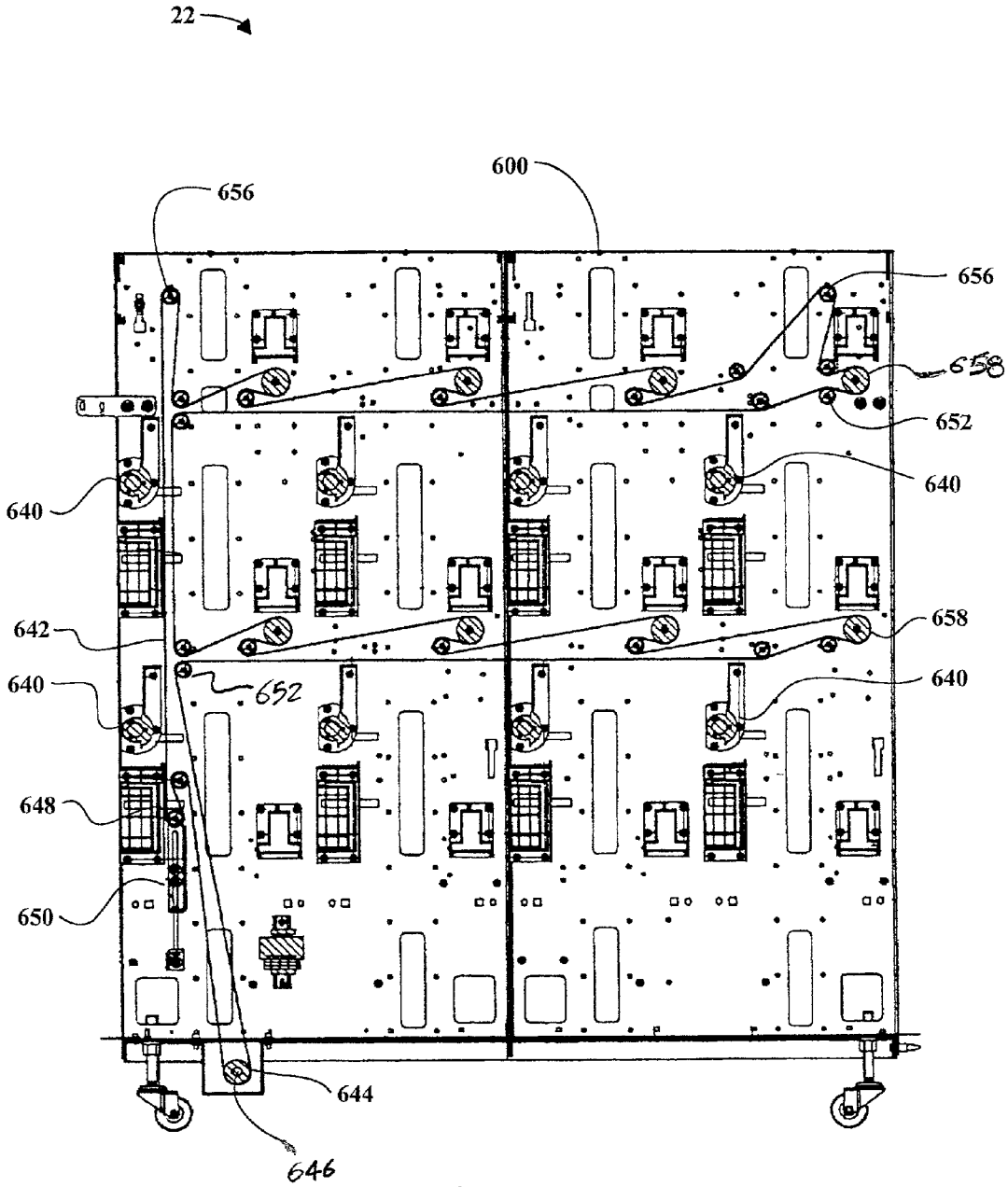
FIG. 43 is a side view of the bin module of FIGS. 40–42 with bins and diverter gates removed.

As described, mail pieces exit the elevator module along either an upper or a lower travel path, depending on whether the final destination bin for the mail piece is in the upper or lower row of sorting bins 456. FIGS. 40–43 show a set of views of an eight-bin module 22 of the sorter 10. FIG. 40 shows an isometric view of a bin module of the sorter 10 according to one embodiment of the present invention. FIG. 41 shows an end view of the bin module of FIG. 40, while FIG. 42 shows a side view of the bin module of FIGS. 40 and 41, and FIG. 43 shows a side view of the bin module of FIGS. 40–42 with bins and diverter gates removed.

FIG. 40 shows the eight-bin module 20 in an isometric view. As installed in the sorter 10, eight-bin module 22 may be disposed between elevator module 20 and one or more additional bin modules 22. As shown in FIG. 40, bin module 22 comprises a bin module frame 600 riding on casters 602. The entry side of bin module 22 is aligned to the upstream module by alignment bullet 606. As with the above-described modules 14–20, mechanical power for the bin module 22 comes from a single central electric motor, in this case drive motor 608 at the bottom of the module 22. The motion in the device can be stopped by the user at any time by the use of emergency stop button 610.

In a similar manner as that described above in connection with twister 18 and elevator 20. Bin sorting within the bin module 22 is performed by diverter gate mechanisms 612, which divert a mail piece traveling down the travel path into the proper bin at the appropriate time. Each diverter mechanism 612 incorporates a light barrier sensor 616 to monitor the progress and position of mail pieces as they pass through the bin module 22. An interruption of light passing across light barrier sensor 616 signals to the control software the front edge of a mail piece, while re-establishment of an interrupted signal signals the passage of the trailing edge.

FIG. 41 is an end view of bin module 22, showing many of the same components as shown in FIG. 40 from a different vantage point. FIG. 41 also shows drive belt 642, which distributes mechanical power through the bin module 22.

FIG. 42 shows bin module 22 from a side view showing many of the same features and aspects disclosed in FIG. 41 from yet another vantage point. In particular, FIG. 42 shows the gate conveyors 612 in a clearer side view. Additionally, bin module 22 shown in FIG. 42 is shown with eight standard volume bins 654 which serve as the final destination for the sorter mail pieces. As shown in FIG. 42, two sets of four gate mechanisms 612 are disposed end to end, so that as long as none of the gate actuators is energized to divert any of the gate mechanisms 612 to a downward angle, a mail piece will be carried from the entry to the exit of the bin module 22 without being diverted or interrupted.

FIG. 43 shows bin module 22 from the same vantage point as FIG. 42 with all gates 612 and bins 654 removed, so as to more clearly show the power distribution mechanisms of the bin module 22. As seen in FIG. 43, power is distributed through bin module 22 by a single power drive belt 642. Power drive belt 642 winds through the module 22 around a series of idler pulleys 652 and driven pulleys 658. As shown in FIG. 43, drive belt 642 is driven by motor drive pulley 644 attached to motor drive shaft 646. Drive belt 642 powers a series of driven pulleys 658, each of which is connected to a separate diverter conveyor 612 within the module 22. The drive system incorporates eight gate conveyor drive pulleys 658, one for each diverter gate conveyor 612 within the module 22. Also shown in FIG. 43 are module synchronization pulleys 656. Synchronization pulleys 656 serves to maintain uniformity in the conveyor drive speeds of the bin module 22 and attached modules. Tension in drive belt 642 is maintained by tensioner idler 648 riding on tensioner bracket 650.

Figure 44:
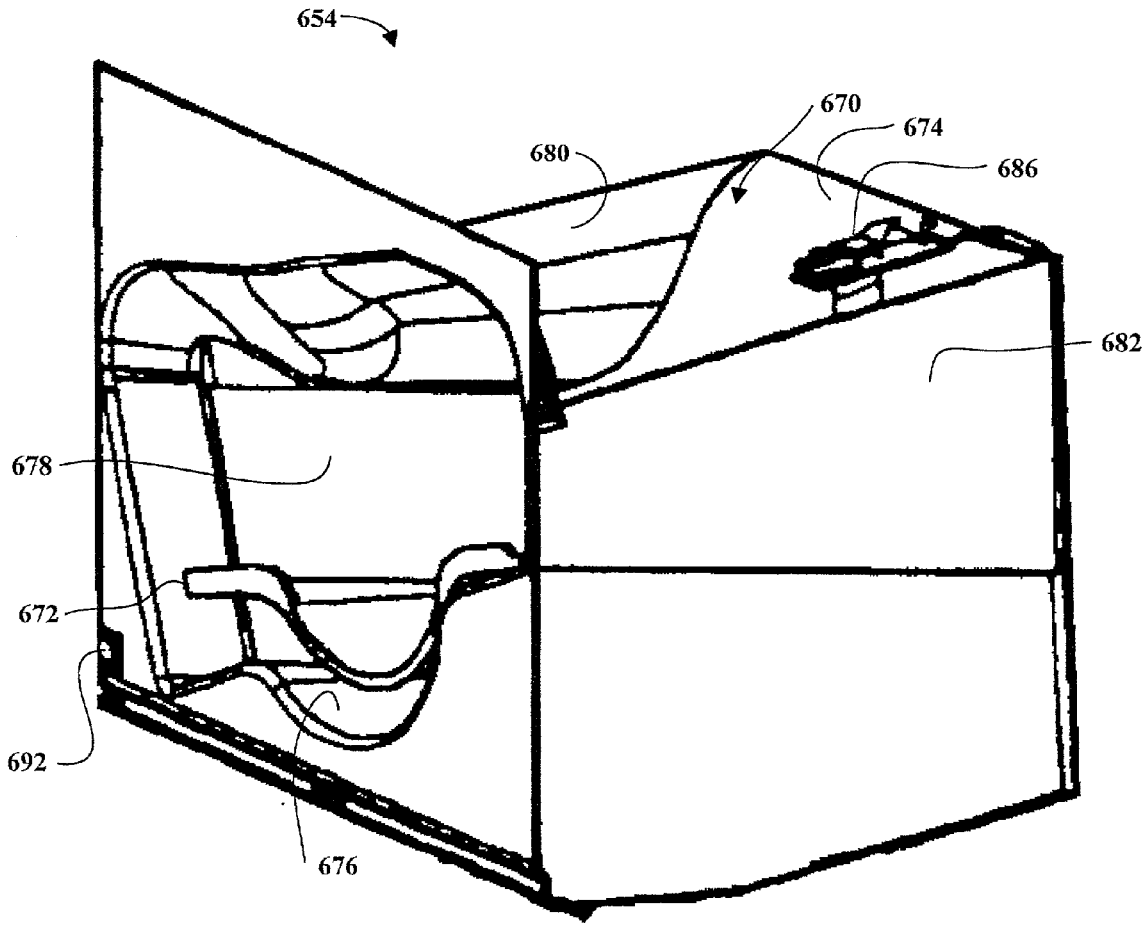
FIG. 44 is an isometric view of a mail piece bin as used in the bin module of FIG. 40.
Figure 45:
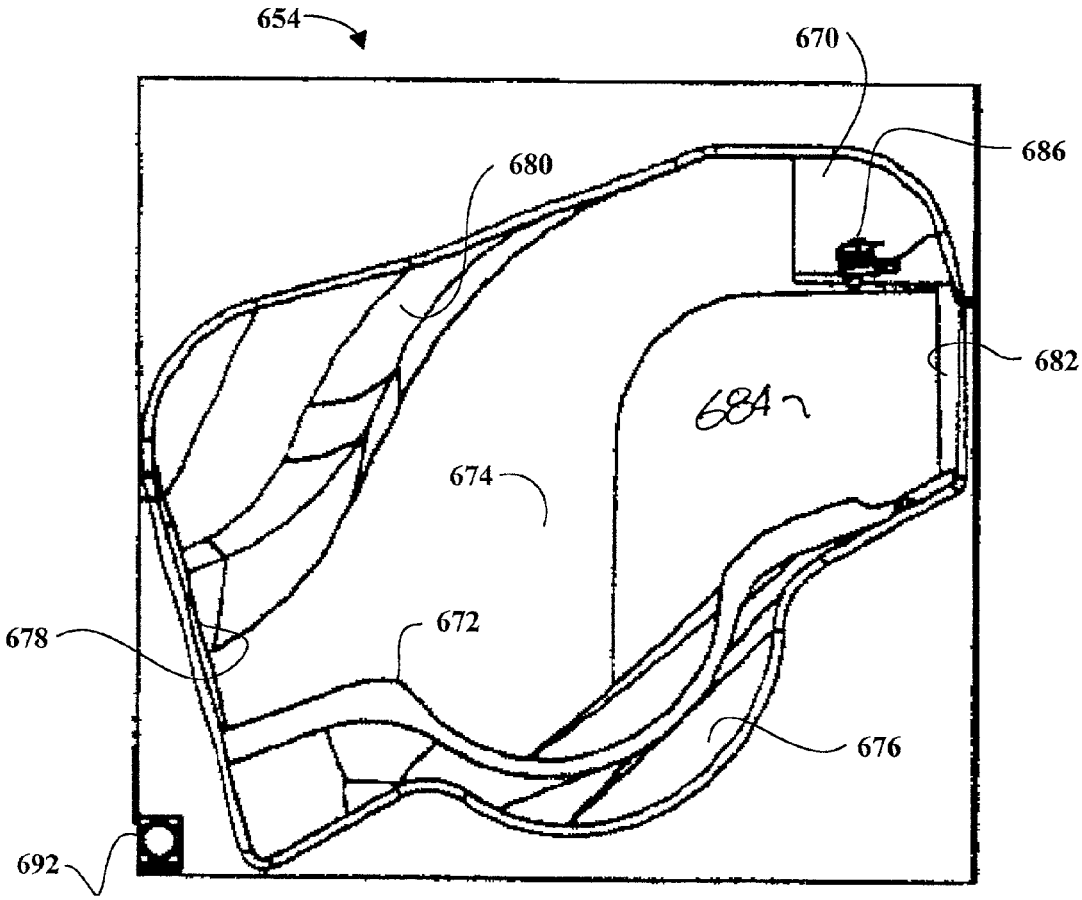
FIG. 45 is a side view of the mail piece bin of FIG. 44.
Figure 46:
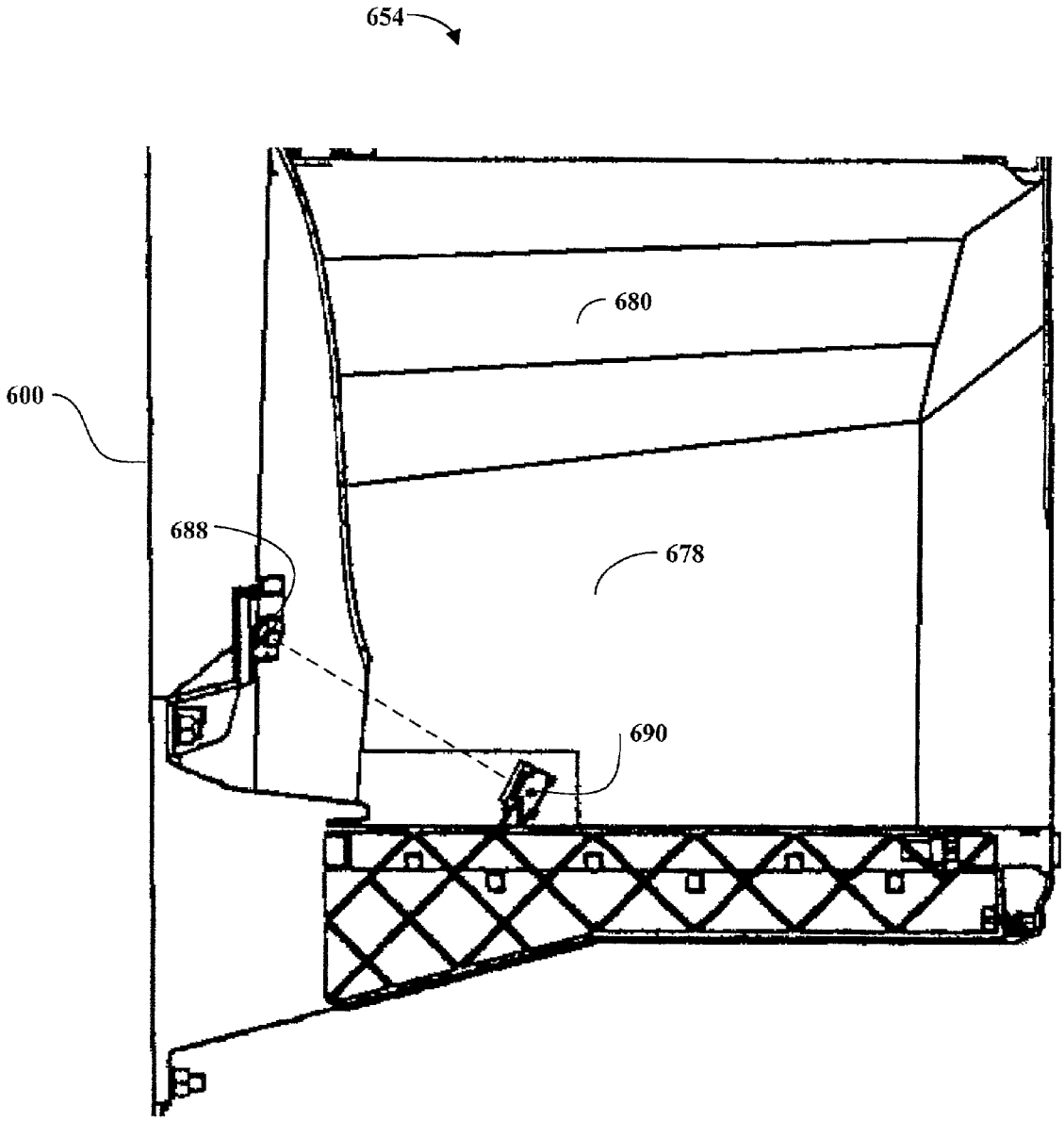
FIG. 46 is an end view of the mail piece bin of FIGS. 44 and 45.

FIGS. 44–46 show a set of views of mail bins 654 used in the elevator module 20 and eight-bin modules 22 of sorter 10. FIG. 44 shows an isometric view of a mail piece bin 654 as used in the bin module of FIG. 40, while FIG. 45 shows a side view of the mail piece bin 654 of FIG. 44, and FIG. 46 shows an end view of the mail piece bin 654 of FIGS. 44 and 45.

As explained above, the sorter 10 is designed to process a range of different mail piece sizes. There is a risk in such a machine that variation in mail piece parameters such as size, weight and surface condition may adversely affect the piling quality and the interruption-free and time-independent ability of a mail bin to receive mail pieces.

Mail piece bins are known in the art, such as that disclosed in EP 0407795 B1. Prior art mail bins are generally suitable only for a limited spectrum of mail pieces, generally limited to light and flat mail pieces, such as normal letters or postcards, which may be inserted into a mail bin at high speed. In certain such designs, a pivotable guide fork arranged at the entrance guides mail pieces onto the bin bottom or onto stacked mail pieces, wherein the guide fork rests on the stack of mail pieces and is pivoted as a function of the degree to which the bin is full. In such designs, the bin bottom platter is pivotable at the edge shared with the impact wall, which is inclined forward in the stacking direction. The guide fork is curved on its support such that across the pivoting range, the pressure point is at a nearly constant minimum distance from the impact wall. In order to guarantee that stacked mail pieces will be correctly oriented with respect to the side wall, the impact wall, which stops the mail pieces, turns inward toward the side wall.

In order to prevent an incoming mail piece from striking the back edge of a preceding mail piece at high speed and causing a stacking error, a mail piece to be stacked must not contact the preceding mail piece by less than a certain minimum angle. In order to maintain the correct geometry as the height of the stack grows (that is, as the orientation of the guide fork approaches horizontal), the stacking platter pivots downward in the direction of a horizontal orientation as a function of the degree to which the bin is full.

If mail pieces having vastly different sizes, thicknesses and weights are stacked in racks at a substantially lower transport speed than in the aforementioned design, then the mail bin described above would not be suitable, as the guide fork would slow down mail pieces by differing amounts. The result would be unsatisfactory stacking quality.

Mail bins incorporated into the sorter 10 are designed to achieve a secure, rapid and aligned transport of each mail piece to the front edge of the pile with minimized mail piece damage. The advantage of the mail bin 654 of the present invention is that mail pieces having a large spectrum of sizes and thicknesses can be stacked optimally at low transport speed with a device having a relatively low manufacturing cost. Advantageous embodiments of the mail bin 654 of the present invention are described below. The invention is explained in greater detail in connection with FIGS. 44–46.

As described above, mail pieces are transported through the sorting modules of sorter 10 by diverter gates 456 and 612. When the sorter control determines that a mail piece is to be diverted into a certain bin 654, the gate actuator for that bin is lowered, which has the effect of pivoting the diverter gate 456 or 612 toward the opening 670 of bin 654. In mail bin 654, a movable stacking platter 672 suspended by means of a spring (not shown) is inclined, in an empty state, downward and to the right toward the side wall 674 relative to the direction of transport and direction of orientation of the mail pieces. That is, platter 672 is inclined toward the back right corner of mail bin 654. The spring (not shown) is supported against the fixed lower surface 676 of bin 654.

An impact wall 678, which stops the forward momentum of the entering mail pieces, is inclined at an angle greater than perpendicular to the lower surface 676. In addition, impact wall 678 turns inward with the side wall 674. In addition, the mail bin has an upper surface 680 in addition to a back wall 682 opposite the impact wall 678. The edge of upper surface 680 defines the upper edge of opening 670. As upper surface 680 extends further in the direction of the impact wall 678, the lid 680 curves downward such that its inner outline extends below the upper limit of the mail piece trajectory. With this shape, upper surface 680 guides mail pieces such that in an empty mail bin 654 they contact the lower region of the impact wall 678 at a point near the edge of the stacking platter 672 closest to the impact wall 678. The mail pieces strike the impact wall 678 at an angle of 70°–90° to the impact wall 678.

If there already are mail pieces in the mail bin 654, then after a certain mail stack height has been reached, mail pieces to be stacked first contact the uppermost mail piece in the stack and then slide on the surface of the uppermost mail piece toward the impact wall 678, rather than striking the impact wall 678 first. The forced inclination of the mail pieces due to the lid 680 both contributes to stabilizing the trajectory and supports the escape of air toward the open side.

A mail bin 654 according to the present invention guarantees that the broadest variety of mail pieces may be stacked securely and in alignment while minimizing the possibility that mail pieces will jam or fall out of the bin 654.

The upper surface 680 curves away from the stacking platter 672 so as to meet the impact wall 678 parallel to the edge between stacking platter 672 and impact wall 678 and within a distance from an empty stacking platter 672 smaller than the length of the shortest mail piece. This prevents a short mail piece from standing up in the bin, which would erroneously signal a full mail bin 654. According to the size of the stack of mail pieces, the stacking platter 672, supported by a spring, pivots downward such that the interval from the uppermost mail piece to the upper surface 680 of bin 654 remains nearly constant and is always shorter than the length of the shortest mail piece to be sorted.

The side wall 674 inclines away from the upper boundary so that the side wall does not impair the downward movement of the mail pieces. In order for mail pieces to be stacked quickly, the cushion of air which forms as mail pieces fall must be removed as quickly as possible. Accordingly, the side wall 674 has, adjacent to the opening, a cutout 684 through which air can escape rapidly.

In order to prevent a piling rack from overflowing, a pair of photoelectric sensors 688 and 690 are present to monitor the size of the mail stack. The sensors 688 and 690 are arranged such that they detect the front inside corner of the uppermost mail piece piled at the stack height to be detected. This geometry prevents errors that would otherwise be caused by mail pieces overlapping in the region of the opening.

In order to facilitate manual emptying of the mail bin, piling bottom 672 is provided with a recessed grip area so that the operator may access a pile of mail pieces without difficulty.

Figure 47:
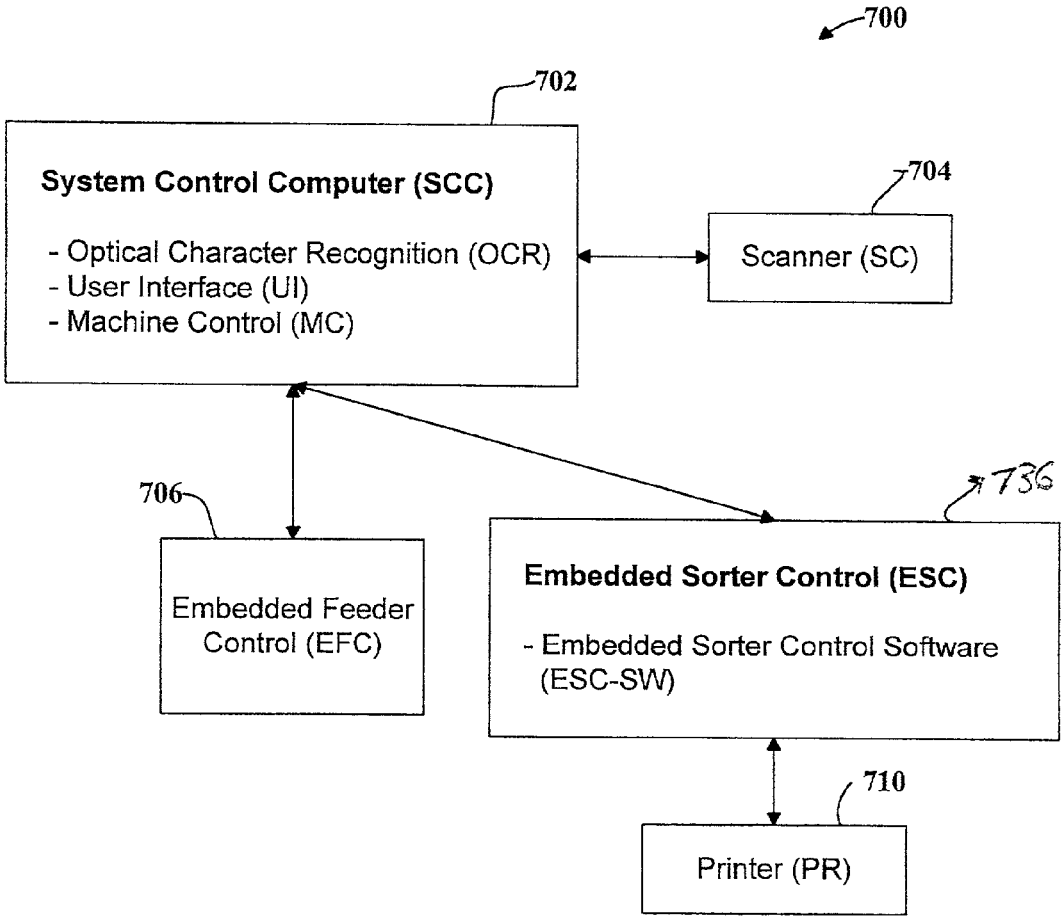
FIG. 47 is the top-level structure of the sorter control scheme including the work share between the system control computer and the embedded sorter control.

The mechanical portion of sorter 10 has been described above. The mechanical portion of the machine is controlled by a software and hardware control system described below. The interaction and communication scheme employed between the system control computer, the embedded feeder control, and the embedded sorter control is shown in FIG. 47 and generally designated 780. The system control computer (SCC) 702 is the top-level machine control computer running the application software including the user interface (UI), the machine control (MC) and the optical character recognition (OCR) process. The user interface (UI) is the graphical user interface on the system control computer. The machine control (MC) is the process of the system control computer that controls all machine components. The optical character recognition system incorporates all functionality necessary for processing of mail piece address images. In certain embodiments, system control computer 702 is a PC architecture system running Microsoft Windows NT.

In addition to the OCR, UI, and MC, system control computer 702 incorporates a tracking control (TC), mail piece control (MPC) and a message dispatcher. The tracking control (TC) within the system control computer provides mail piece tracking through the machine on the basis of light barrier signals and encoders within the embedded sorter control. The tracking control controls on-line related devices, such as flap drives and the printer via the embedded sorter control. Mail piece control (MPC) is a process running on the system control computer providing further mail piece control functionality. The system control computer message dispatcher dispatches all messages between the broker and inside the machine control process.

System control computer 702 coordinates the activities of the scanner 704, the embedded feeder control 706, and the embedded sorter control 708. System control computer 702 communicates with scanner 704 by means of a scanner interface comprising a software interface of the image scanner to the OCR image queue. The OCR process is used to derive mail piece result data (MRD), which is then used to determine the proper bin assignment for the mail piece. The system control computer communicates with the embedded sorter control via an embedded sorter control interface (ESC-IF) between the system interface control and embedded sorter control. In certain embodiments, this interface is an RS-232 serial link.

The embedded sorter control comprises an embedded sorter control computer running the embedded sorter control software (ESC-SW) to provide embedded tracking control (ETC) for the sorter. The embedded control computer (ECC) is a dedicated computer running the software for embedded machine control (EMC), or the low level control of the sorter modules, each of which has its own drive motor and velocity encoder. In certain embodiments, the ECC is a PC architecture computer running under the QNX 4.24 operating system. The embedded sorter control software (ESC-SW) is low level device control software running on the embedded sorter control computer. The embedded sorter control software comprises the embedded sorter control machine control (ESC-MC), which is the process of the embedded sorter control which controls machine hardware such as the module drive motors. Embedded tracking control (ETC) provides mail piece tracking through the machine based on the outputs of light barriers and encoders. Tracking of each mail piece begins at the mail piece creation lightbarrier (MCL), which is the first lightbarrier of the scanner module. Furthermore, the ETC directly controls most on-line related devices such as flap drive motors, feeder, printer, and meter.

Figure 48:
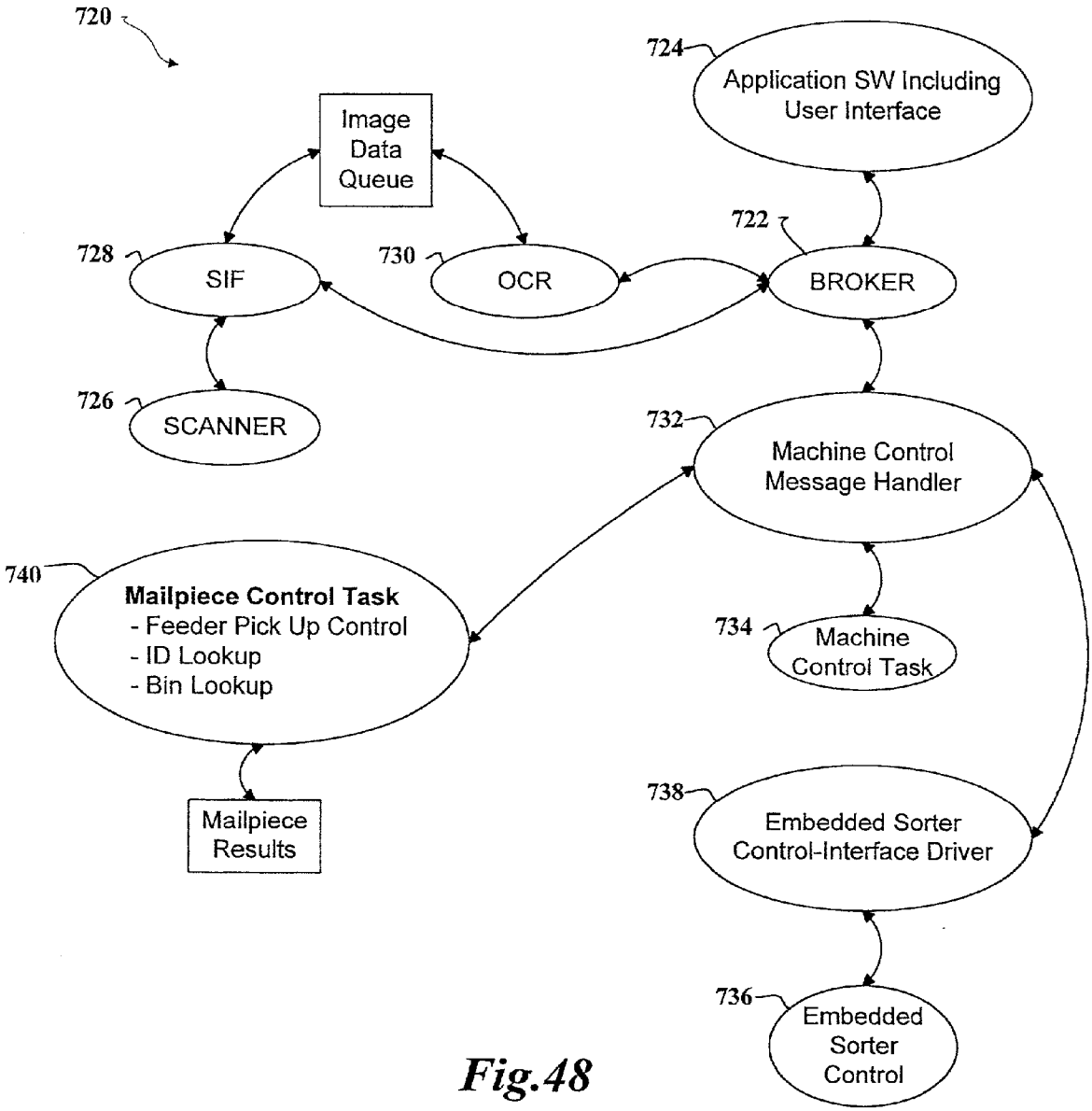
FIG. 48 is the structure of the low-level, or "realtime" software of the mail sorter.

FIG. 48 shows the structure 720 of the low-level, or "realtime" software of the mail sorter. Broker 702 is the central communication medium between the user interface 724 and all realtime related components. It provides the message exchange between the UI 724, the OCR system (scanner 726, scanner interface 728, and OCR software 730) and the machine control components (via the message handler 732). In certain embodiments, the OCR related components use the SEC TLV standard communication message protocol.

The machine control message handler 732 dispatches all messages between the broker 722 and the machine control process 734. It also passes messages to and from the embedded sorter control 316 via the embedded sorter control interface 738.

The main tasks of the system computer machine control are the machine control task 734 and the mail piece control task 740. The machine control task 734 is responsible for:

start/stop procedures of the machine;
initialization of all components;
machine operating mode control;
'module ready' check;
component configuration download; and
operation supervision (problem handling, context dependent stop processing & user interface error message generation).

The mail piece control task 740 is responsible for the co-ordination of all mail piece related on-line information management tasks. These include:

creation, writing, reading and deletion of mail piece records;
receipt of mail piece records, including the mail piece ID, from the embedded sorter control 736;
adding a timestamp to the embedded sorter control mail piece record;
sending mail piece records to the scanner interface 728;
receiving OCR results;
lookup of the manual coding result table where necessary;
lookup of the logical bin from the sort scheme corresponding to the mailstop;
sending the mail piece bin information down to the Embedded Sorter Control 736;
receiving and saving the mail piece sorting result from Embedded Sorter Control 736;
receiving (via local area network) administrate manual coding results from the manual coding PC;
providing access and administration functions for manual coding results; and
providing access and administration functions for mailstop—bin correspondence based on the current sort scheme.

The output of the OCR process 730 comprises an OCR processing result comprising:

Mail piece ID;
Mailstop;
DPC (Delivery Point Code);
Other information like 'Urgent;'
Print information;
Print area;
External ID (Barcode Tag); and
OCR-related information (processing time, mail piece format data including skew and reference in the address data base,).

Figure 49:
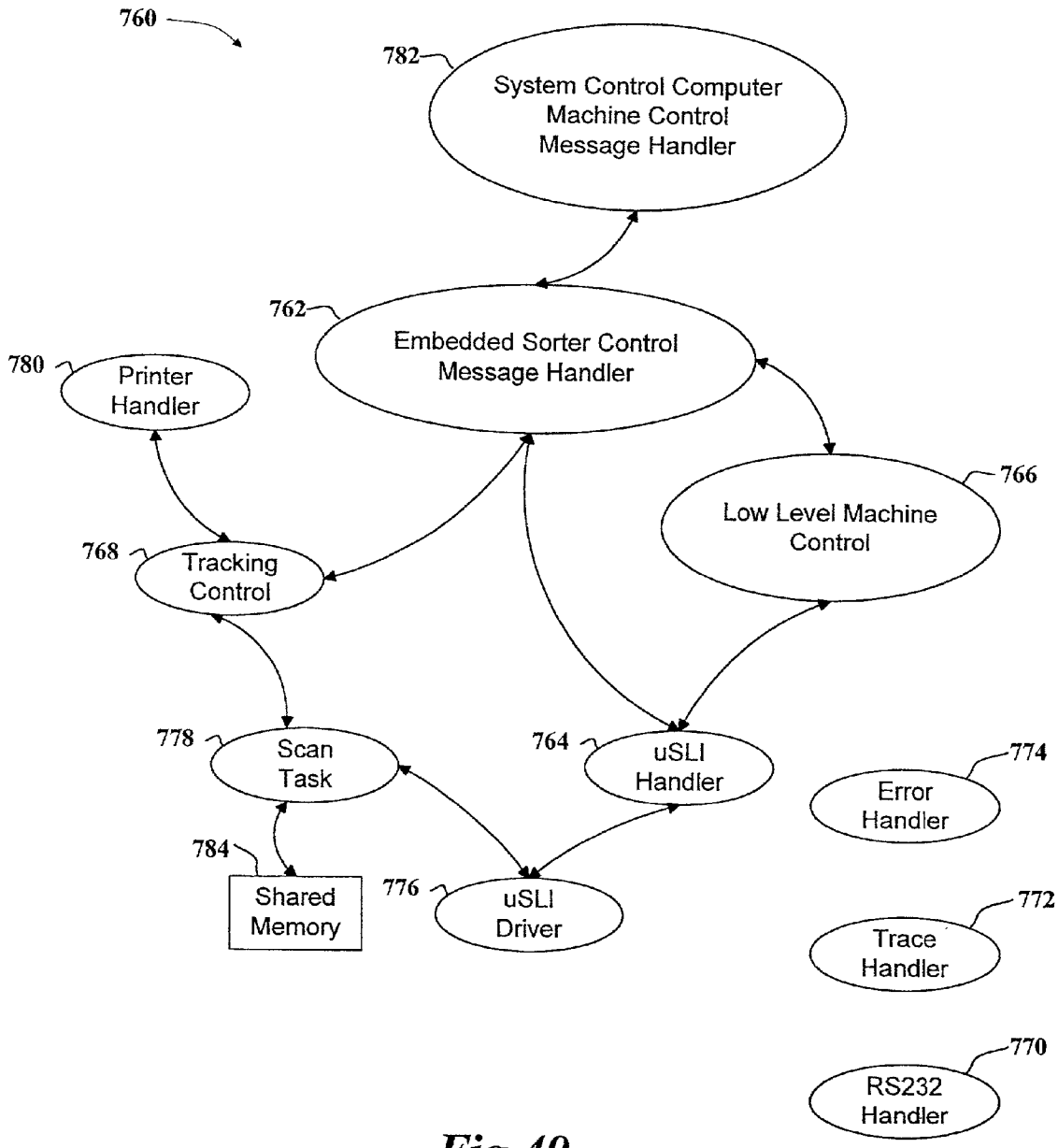
FIG. 49 is the structure of the embedded sorter control (ESC) of the machine.

The structure 760 of the embedded sorter control (ESC) of the machine is shown in FIG. 49. The embedded sorter control (ESC) of the machine is responsible for most or all of the low level control and real-time related tracking functions of the machine. The embedded sorter control is responsible for:

communication handling to the system control computer;
low level machine control and mail piece tracking;
startup selftest;
low level test functions; and
printer handling.

The system is divided into several modules. The embedded sorter control message handler 762 handles all communications between the embedded sorter control 316 and system control computer 702 via the system control computer machine control message handler 782. The communication between all embedded sorter control modules is based on a message queue. This approach is advantageous due to the fact that it incorporates a simple communication structure, provides minimised dead lock risk and reduction of side effects, and is simple and extendible. The embedded sorter control message handler 782 facilitates communication between the system control computer 702 and the embedded sorter control 736. It is responsible for communication set up, communication check, and message distribution. In certain embodiments, the configuration data for the embedded sorter control 736 will be saved in one or more files on the embedded control computer. A host configuration message specifies the device to be configured on the embedded sorter control and the corresponding configuration file name. A special parameter loading process within the embedded sorter control reads the appropriate configuration file on request and distributes the parameters to the corresponding embedded sorter control processes.

The configuration of all devices follows the same procedure. At any time, the system control computer 702 can request the configuration status of each embedded sorter control device via a dedicated message. The concerned device, for example a printer, responds with its current configuration status to the host. If necessary the system control computer 702 issues a configuration message to the device. After the device configuration has been executed, the device replies with its current configuration status. In certain embodiments, communication with the system control computer 702 takes place via a serial RS232 interface. In certain embodiments, the system control computer 702 downloads the required parameters and settings to the embedded software at start-up. This feature allows the same realtime software to be implemented in a variety of contexts, allowing for operation with different machine sizes and operating requirements.

The micro serial link interface ($\mu$SLI) provides a control means via a serial bus between the embedded sorter control and all machine hardware components such as lightbarriers, flapdrives, belt speed encoders and LCD displays. Certain devices, such as the printer, are connected via RS232 serial interfaces or the $\mu$SLI to the embedded sorter control. Each device has its own dedicated device handler. The device handler acts as an interface to the embedded sorter control software and provides all device specific functionality. After power-on reset, the machine μSLI driver 716 performs an automatic hardware configuration detection of all connected hardware modules. On request of the system control computer, the detected μSLI configuration will be sent to the host. On the basis of the detected ESC-μSLI configuration, the host sends a machine tracking configuration trigger message to the embedded sorter control, which makes it possible to define the scope of active photocells. Additionally, message events related to definable tracking positions can be configured to provide the system control computer realtime tracking needed for the meter control. The embedded sorter control replies to all these configuration messages with the current tracking configuration status. The embedded sorter control configuration process comprises:

automatic detection of existing μSLI-Modules;
dynamic signal and status configuration;
configuration of embedded sorter control Tracking processes;
configuration of devices; and
configuration verification.

After the embedded sorter control has finished the dynamic signal and state configuration, the message MID_ESC—CNFG-STATE-DESCR-CONF will be sent on system control computer request. This message contains the dynamic state description of the following partial states:

μSLI-module states (SliModulesConfig);
sorter cover states (aCoverConfig);
sorter interlock states (aInterlockconfig);
sorter drive states (aDriveConfig);
sorter jam position states (aJamPosConfig);
sorter bin full levels (aBinFuIlLevelConfig);
sorter power supply states (aPowerSupplyConfig);
sorter lightbarrier test states (aLBConfig);
sorter lamp states; and
AVR ready states.

Each of these states is described by an array of structures that contain:

sorter module number;
sorter module type;
VSLI module type (e.g. MSB10, MMA10, . . . )
the corresponding bin number (for jam position states and bin full levels); and
a lightbarrier signal count to differentiate multiple signals from one module.

Any state transitions within the embedded sorter control will cause a general state message (MID_ESC_STAT_GENERAL) to be sent to the system control computer. The general state message contains for all the above mentioned partial states a summary that expresses whether there is a problem within this item or not. Additionally, the general state message provides information about the current machine mode and machine state as well.

The embedded sorter control low level machine control 406 is responsible for:

the power on sequence;
set-up and control of the operation mode;
supervision of the ready state of various system components;
low level handling of start and stop events;
control of service and diagnostic functions; and
control of the LCD display.

The tracking control 768 is responsible for all mail piece related on-line control and tracking related functionality, including: creation of mail piece descriptors, receipt and processing of bin assignment messages, and transmission of mail piece results to the system control computer. The tracking control 768 is also responsible for mail piece related hardware control functions, including flap position control, jam supervision, printer information control, and the thickness result control for bin status.

Figure 50:
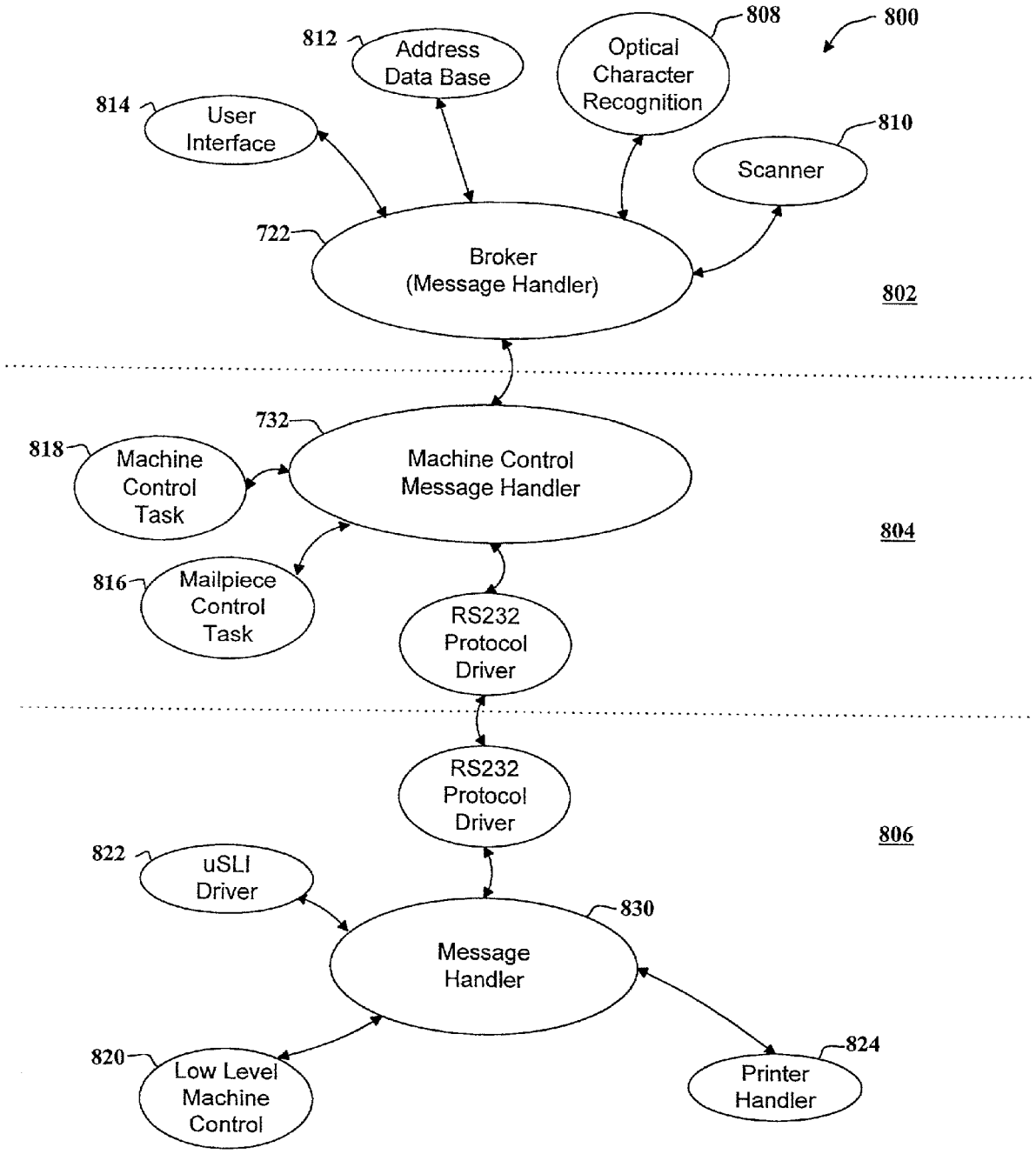
FIG. 50 is the principal system message communication scheme.

FIG. 50 shows the principal system message communication scheme, generally designated 800. Communication within the machine takes place within several communication areas. Each communication area has a dedicated message handler. One embodiment of the system incorporates three communication areas. These include the broker area 802, the machine control area 804, and the embedded sorter control area 806. The broker area 802 is responsible for communication with the OCR 808, scanner interface 810, user interface 814, and the Address Data Base 812, which contains all information for the OCR validation. The machine control area 804 is responsible for the mail piece control task 816 and the machine control task 818, as described above. The embedded sorter control area 806 is responsible for tracking control and low level machine control 820.

Message exchange between different communication areas takes place through the message handlers. For example, a message from the user interface 814 to the machine control task 818 of the system control computer will be sent to the broker 722 and forwarded to the machine control message handler 732.

In certain embodiments, the interprocess communication within the embedded sorter control is based on the QNX operating system. Interprocess communication includes Message Queueing, Message Passing (sending, receive, reply) and Shared Memory. In certain embodiments, the messages have unique message IDs and are defined and described in detail in a global header file.

All messages within the embedded sorter control use a common message format. In this format, each message consists of a message header and a data section. The message header of each message contains the following information:

Destination_Communication_Area,
Source_Process (unique id of sender),
Message Type,
Message Id,
Message Priority, and
Data Size.

The data section of each message contains binary data according to the c structure definition. Destination_Communication_Area is the destination communication area of the message handler that belongs to the destination of the message to be sent. Source-Process is a system wide unique process ID.

The Message Type (ID) specifies the message itself. It will be used to route the message from the destination message (area) handler to the 'interested' process or processes, such as the feeder, printer, or user interface. The Message ID makes it possible to differentiate commands to the same destination process. For example, both a 'New mail piece Record' message and a 'mail piece Status' message may need to be sent to the mail piece control task 816 of the system control computer. Message priority provides a means to control the order of message passing according to a priority number. This information is used to avoid message jams and to optimise the on-line message traffic. Data size specifies the size of the data in the message. This is used for memory allocation.

Message routing is consistent with the broker 302 and is based on the message Destination_Communication_Area. Each message is passed by the concerned message handlers 722, 732, and 830. If a message handler receives a message with a valid Communication_Area_ID which identifies a different message handler, then the message will be passed to the correct message handler. Otherwise, the message will be sent to all the processes within the communication area of the current message handler that have an 'interest' in that message type. With this routing scheme, one message can be sent to multiple recipients. Certain embodiments utilize the Pitney Bowes FOX/B900 Link Layer Protocol for the application related communication between the system control computer and the embedded control computer.

The system is designed to periodically check the state of the system communication links in the event that there has been no message transfer in a certain period of time. In the event that a link is down, the system is designed to re-establish the severed communication link and then report on the link state. The system is also designed to continuously time synchronize the system components with the system control computer.

For the identification of machine elements such as bins and light barriers in messages passed between the system control software and the embedded sorter control, a common enumeration convention is required. The sorter of FIG. 1 incorporates a dual-level architecture, in which the sorting bins are arranged into an upper and a lower level beginning with the first bin module following the elevator module 20. In this embodiment, the elevator module 20 incorporates a set of bins within its lower level.

Different embodiments of the present invention may incorporate different bin identification schemes. One embodiment of a bin numbering scheme is described below. In this embodiment, all bins in the lower level beginning with the first bin of the splitter module 20 to the end of the End bin module 24 are enumerated with a particular identification number. The bins identified in the lower portion of the splitter module 20 are identified as bins 1–3. The first lower bin of the first bin module 22 would then be identified by the software as Bin 4. For a machine configuration containing one eight bin module 22 and an end bin module 24 the last bin in the lower set of bins would be identified by the software as Bin 11 (=3+4+4).

According to the above-described identification scheme, the first upper bin in the first bin module 22 is identified with the number of the bin directly underneath it+an offset of 100. Identification numbers 101–103 would not be used, as there are no bins located directly above the bins in the splitter module 20. Identification number 104 is the software identification for the first upper level bin and 111 is the software identification for the last upper bin 128. This numbering scheme is shown in the following table:

| | Splitter-8 Bin Extension Module- | | | | | | | | | | |
|---|---|---|---|---|---|---|---|---|---|---|---|
| | | | | —End Bin Module— | | | | | | | |
| Upper Bins | Module | | | 104 | 105 | 106 | 107 | 108 | 109 | 110 | 111 |
| Lower Bins | 1 | 2 | 3 | 4 | 5 | 6 | 7 | 8 | 9 | 10 | 11 |

In one embodiment, the bin configuration is uniquely defined according to two parameters, FIRST_UPPER_BIN_NO and LAST_UPPER_BIN_NO, in the embedded sorter control configuration parameter file.

Figure 51A:
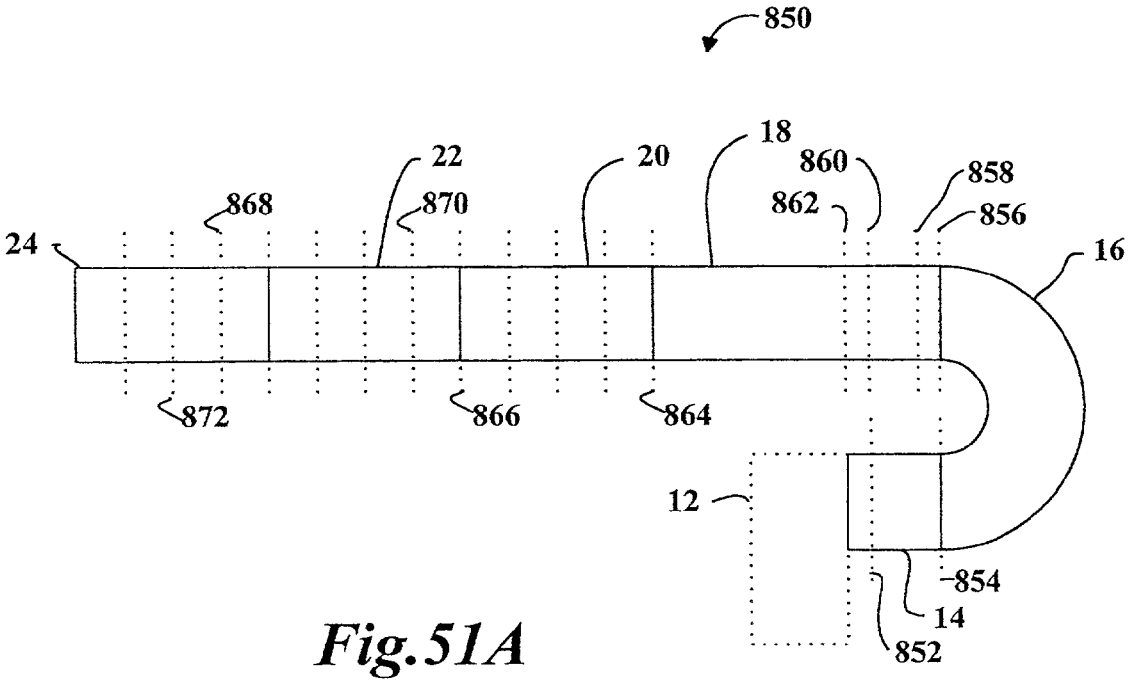
FIGS. 51A and 51B show the layout of light barriers according to one embodiment of the present invention.
Figure 51B:
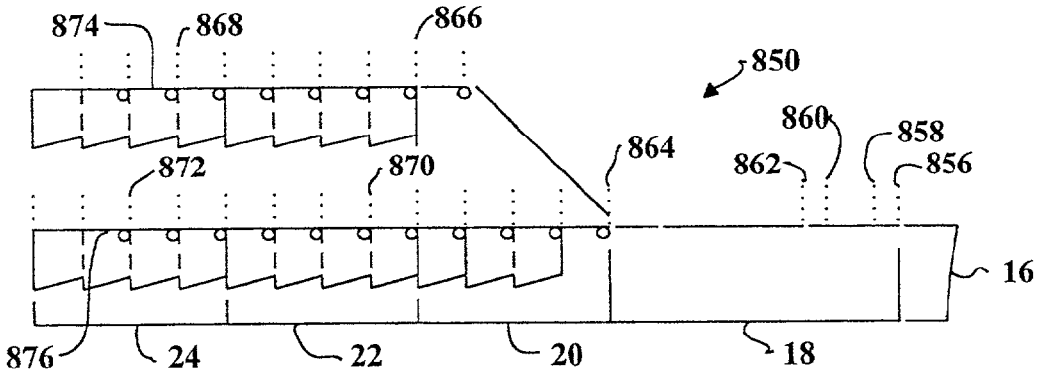

In addition to the bins, the system incorporates a number of light barriers, each of which must also be referenced by a unique, commonly-employed identifier. The layout 600 of light barriers within the sorter 10 of FIG. 1 is shown in FIGS. 51A and 51B. In one embodiment of the present invention, light barrier enumeration is defined as follows: beginning with the scanner module 14, the light barriers are enumerated in sequence, including the light barriers in each of the bin modules such as bin module 22 down to the end of the End bin module 24. Each of the lightbarriers in the upper level in the bin modules is enumerated with an identification number equal to the sum of the identification number of the corresponding low level lightbarrier and an offset of 100. As with the bin configuration, certain embodiments incorporate two parameters FIRST_UPPER_LB_NO and LAST_UPPER_LB_NO, to define the system lightbarrier configuration.

The start of image capture (LBSCAN) light barrier 852 is located at the entrance of scanner module 14. The output of light barrier 852 is used in the embedded sorter control for both letter tracking and jam monitoring. Additionally, light barrier 852 triggers the image scan process. Within the embedded sorter control, the mail piece record, including the mail piece ID, will be sent to the mail piece control process and scanner interface within the system computer upon triggering of light barrier 852.

The begin of turner (LBBOTU) light barrier 854 and the end of turner (LBEOTU) light barrier 856 are located in the turner module 16. The output of light barriers 854 and 856 are used in the embedded sorter control for both letter tracking and jam monitoring.

The start of printing (LBSTPR) light barrier 858, the end of printer (LBEOPR) light barrier 860, and the begin of accelerator (LBBOAC) light barrier 862 are located in the twister module 18. The output of light barriers 858, 860, and 862 are used in the embedded sorter control for both letter tracking and jam monitoring. Additionally, start of printing (LBSTPR) light barrier 858 triggers the printer.

The first splitter (LBSPGA) light barrier 864 is located in the splitter module 20. The output of light barrier 864 is used in the embedded sorter control for both letter tracking and jam monitoring. Additionally, the output of light barrier 864 is used in the embedded sorter control for flap control.

Each of the bin modules 22 and 24 incorporates a series of upper level gate lightbarriers (LBULFC), such as gate light barriers 866 and 868 and a series of lower level gate lightbarriers (LBLLFC), such as gate light barriers 870 and 872. The output of each of these light barriers is used in the embedded sorter control for both letter tracking and jam monitoring. Additionally, the output of each of these light barriers is used in the embedded sorter control for synchronization of the mail piece position with the diverter conveyors such as diverter conveyors 874 and 876.

In the event that a jam is detected by any of the above-described light barriers, the embedded sorter control sends a general state message and a partial jam state message. The system control computer will then issue a message to the user, via the user interface, to clear the concerned flap(s). Before restarting the machine, the embedded sorter control causes the Automatic Flap Position Adjustment of the jam concerned flaps. The sorter can then be restarted.

It is important that maintenance, diagnosis, and repair of the machine is not unnecessarily difficult for operators and service personnel. To this end, an efficient set of diagnostic tests is incorporated into the system. Some of the tests are run automatically in the background and are not specific to machine start or stop processes. Other tests run at system initialization and can be started from a menu by the operator.

The embedded sorter control provides diagnostics and maintenance functions for self detection of errors and interactive detection of errors as well as exchange of download firmware files. The functions are only accessible by means of the application software without respect to whether access is requested by the operator locally or from a call centre remotely. If these functions are called or two special Hardware switches are set, the embedded sorter control transfers into one of several special machinemodes. Handling of these events is described in following paragraphs. Additionally, after power on, several self tests check the hardware and the embedded sorter control provides the result to the system control computer.

There are two groups of machinemodes, classified roughly as RUN modes and DIAG modes. In any of the three RUN modes—NORMAL, SERVICE and OVERRIDE—the sorter is able to run. The DIAG modes, including the several DIAG_xxx modes as well as FW_DOWNLOAD, provide special maintenance features. The embedded sorter control sets the machinemode spontaneously if hardware condition has been changed, or by the system control computer request message SC_STRT_SET_MACHINEMODE. The requested mode will be set or rejected, or a divergent mode will be set, depending on whether the required conditions are fulfilled.

In NORMAL mode, the Sorter can be started by message SC_STRT_START, or initialized by Remote Control Unit or by a user interface button. If there is no hardware exception, the embedded sorter control starts the sorter, as it is ready to sort mail pieces.

If the Sorter is to be operated with opened covers, the override switch on PCB MSB 10 must be set, thereby initiating override mode. The Sorter can then be started, but not by Remote Control Unit or UI button, but only by the hardware start button, also located at PCB MSB 10. This start button signal is also sent in the message ESC-STRT-REMOTE-CNTL, with additional member HwStart sent to the system computer. If HwStart is set, the system control computer has to be sent SC-STRT-START. Embedded sorter control will start the Sorter if the start button is still pressed. Operation is then identical to operation in NORMAL mode.

The system control computer cannot control the machine in SERVICE mode. In this mode, it is only possible to start the motors by means of the hardware switches. No mail piece sorting or jam detection is possible. It is permitted, but not useful, for the system control computer to request SERVICE or override mode. To terminate a maintenance mode, the system control computer must request NORMAL. Then embedded sorter control checks hardware conditions (switches SERVICE and override) and sets the appropriate mode.

Much information about the status of the sorter is returned in messages containing General and Partial Status of the sorter. For detailed checks during preventive inspections or in response to errors, certain diagnostic features provide additional information gathering functionality. Certain test functions can be called when the machine isn't running. Results for these functions are returned after the test is finished. Initializing events, as well as normal and exceptional states of the embedded sorter control are recorded in the service logfile.

All tests will be started by a message SC_DIAG_xxx-_TEST_START Certain tests terminate after one pass, while others repeat until the embedded sorter control opmode is reset to normal by message SC_STRT_SET_opmode. Certain tests do not return measurable results to the system internally, but rely instead on optical or acoustical verification by operator. The result message for these tests is either always ok, with a binary result only (ok or not ok), or with detailed information containing the binary summary result with additional information.

The DIAG modes, including the several DIAG_xxx modes as well as FW_DOWNLOAD, provide special maintenance features. To request a diagnostic mode, the system uses the SC_STRT_SET_MACHINEMODE for the parameterless modes and SC_DIAG_xxx_TEST_START for modes having parameters. The most consistent manner is to use only one message SC_STRT_SET_MACHINEMODE with a union of parameter structures. The requested mode is checked by embedded sorter control and operation mode will be switched to requested mode so long as the sorter motors are not running (MachineState==ESC-STATE-STOPPED) and no other diagnostic function is running. In case of a previous auto-terminating test, the system will wait for the termination, indicated by message ESC_DIAG_xxx-_TEST before starting the next test.

In case of previous SC-terminating test, the system will terminate the test by message SC_STRT_SET_MACHINEMODE, parameter NORMAL. The system will then wait for termination, indicated by message ESC_DIAG_xxx_TEST, before starting the next test.

The fan sort function is used to test the machine without OCR. There are several different Fan sort schemes. The machine can be instructed to sort mail pieces into consecutive bins, sort mail pieces into one dedicated bin, to sort mail pieces randomly, or to distribute the mail pieces according to the length of each.

The track adjustment function is used to optimize the tracking to the individual machine once. The track adjustment runs several test items through the machine.

The lightbarrier test verifies the correct function of all photocells excluding the photocells in the feeder. The test procedure checks the operation at full and reduced supply voltage automatically. In other words, the light barriers are tested with their light emitters at full, reduced and zero power. The result of the test will be displayed individually for each photocell. The test is started with message SCSTRT_SET_MACHINEMODE, parameter: Machinemode=ESC_MACHINEMODE_DIAG_LB. The test results are given in Result messages as well as in PartStatus message. This test mode terminates after finishing the 3 tests, so that no stop message is required.

The lightbarrier distance test provides information about the actual distances between the lightbarriers of the sorter. The embedded sorter control is set into the lightbarrier distance test mode by the message SC_SET_LB_DISTANCE_TEST_START mode. Because the bin module lightbarriers are organized into an upper and a lower tier, this test is carried out using a pair of mail pieces. The first mail piece will be sent to the last bin in the lower tier, and the second mail piece will be sent to the last bin of the upper tier. After a mail piece has reached the designated bin, the embedded sorter control sends a lightbarrier distance status message to the application software corresponding to the embedded sorter control jam position state configuration message. The distance value returned for each light barrier is the distance in millimeters from the preceding lightbarrier. The first lightbarrier, at the scanner, is given the value 0. Unaffected lightbarriers are also given the value 0.

The application software will display the individual distances of each mail piece as well as a histogram display of all lightbarriers. This test should only be run when the machine is not running, as the size of the response message (13KB) can interfere with the transmission of other real time messages.

The test verifies the correct operation of all machine diverter gate actuators. The test includes the automatic diverter actuator self position procedure. There are several modes for the flap test, including modes to test all actuators, to test a selected group of actuators, to change actuator position either synchronously or asynchronously, and a mode to test the frequency of actuator activation.

This test can be run in either active or passive mode. In active mode the diverter gates will be normalised to move down and up, then the data will be read. In passive mode, the gates are not moved and the only the data is read. The flap test is done in sequence one bin at a time, so that gate movement can be observed by the user. After finishing the test for each bin a verbose gate data message is sent. Flap test mode terminates after finishing the tests, so that no stop message is required.

Other diagnostic tests include the LCD test, the interlock switch test, the stop lamp test, the bin lamp test, and the beeper test. Each of these diagnostic routines operates according to a simple cyclic repetition of the relevant machine elements so as to identify failed components.

To avoid message traffic bursts after certain sorter error situations, a partial state message will be sent without system control computer request only if no other error condition is valid. In the event that multiple error states occur at the same time, the system control computer has to request each partial state.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A mail sorting machine comprising:

a feeder that receives a stack of incoming mail pieces and outputs the mail pieces one at a time in a vertical position;

a scanner which receives mail pieces from the feeder and scans each mail piece in a vertical position to read sorting information thereon;

a transport device which conveys receives mail pieces from the scanner including:

(a) a deflector, the deflector defining a substantially semicircular path through which the transport device transports mail pieces, the deflector further defining an input end and a discharge end of the transport, the deflector being configured to turn mail pieces received by the device from a first transport direction substantially aligned with the input end to a second transport direction substantially aligned with the discharge end;

(b) a first, vertically oriented, endless belt configured to travel along the substantially semicircular path in contact with the deflector from the input end to the discharge end of the transport device;

(c) a second, vertically oriented, endless belt configured to travel along the substantially semicircular path from the input end to the discharge end, the first endless belt contacting the second endless belt adjacent to the input end and carrying the second endless belt around the path to the discharge end of the transport device;

(d) at least one guide member, the guide member forming a path for mail pieces fed to the transport device into the input end of the transport device and between the first and second endless belts; and (e) a horizontal conveyor configured to receive the bottom edge of mail pieces entering the input end of the transport device and convey the mail pieces along the guide member and between the first and second endless belts, the first and second endless belts conveying the mail pieces through the path from the input end to the discharge;

a reorientation section including a reorientation conveyor which receives the scanned mail pieces from the transport device and re-orients each mail piece from a vertical to a horizontal position, and a splitter conveyor which receives the scanned mail pieces from the reorientation conveyor, including a movable divert conveyor that moves between a first position to convey a mail piece to an upper conveyor flight and a second position to convey a mail piece to a lower conveyor flight;

a bin module which receives the scanned mail pieces from the splitter conveyor, which bin module includes upper and lower bin sections, wherein each bin section comprises a row of bins and an associated series of tiltable conveyor sections comprising the upper and lower conveyor flights, which tiltable conveyor sections are actuated to drop a mail piece into the associated bin; and a control system which tracks each mail piece as it moves from the scanner to the bins and controls operation of the divert conveyor and the tiltable conveyor sections so that each mail piece is sorted to a predetermined bin based on the sorting information read by the scanner.

2. The mail sorting machine of claim 1 further comprising a printer for labeling mail pieces carried though the semicircular path.

3. The mail sorting machine of claim 1 further comprising a sensor at an input end of the semicircular path, the sensor detecting a mail piece at the input end of the transport device.

4. The mail sorting machine of claim 1 further comprising a sensor at a discharge end of the semicircular path, the sensor detecting a mail piece at the discharge end of the transport device.

5. The mail sorting machine of claim 1 further comprising a pair of input guide flanges, the guide flanges forming a path for mail pieces fed to the transport device into the input end of the transport device and between the first and second endless belts.

6. The mail sorting machine of claim 1 further comprising a discharge guide assembly, the discharge guide assembly forming a path for mail pieces exiting the transport device from between the first and second endless belts, the discharge guide assembly including at least one guide member configured for movement to accommodate the passage of a mail piece through the guide assembly.

7. The mail sorting machine of claim 1 wherein the device carries the mail pieces through an are of about 180°.

8. The mail sorting machine of claim 1 further comprising means for reversing the direction of travel of mail pieces exiting the scanner, the means being disposed between the scanner and a downstream mail piece processing apparatus.

9. The mail sorting machine of claim 1 wherein the moveable divert section further comprises a belt conveyor configured to receive and convey horizontally positioned mail pieces from the reorientation section, the moveable diver conveyor having first and second ends and being pivotable around the first end to move the second end to a selected flight.

10. The mail sorting machine of claim 9 wherein the moveable divert conveyor further comprises a plurality of resilient rotating members positioned above the moveable divert conveyor, the resilient rotating members retaining mail pieces between the members and the belt conveyor as the mail pieces are conveyed by the belt conveyor.

11. The mail sorting machine of claim 9 further comprising an elevator conveyor, the elevator conveyor receiving mail from the divert conveyor and carrying the mail along an incline to an upper flight for sorting into a selected one of the sort bins of the upper bin section.

12. The mail sorting machine of claim 11 wherein the elevator conveyor further comprises a plurality of resilient rotating members, the members retaining mail pieces between the conveyor and the members as the mail pieces are carried up the incline.

13. A mail sorting machine comprising:

a feeder that receives a stack of incoming mail pieces and outputs the mail pieces one at a time in a vertical position;

a scanner which receives mail pieces from the feeder and scans each mail piece in a vertical position to read sorting information thereon;

a reorientation section including a reorientation conveyor which receives the scanned mail pieces from the scanner and re-orients each mail piece from a vertical to a horizontal position, and a splitter conveyor which receives the scanned mail pieces from the reorientation conveyor, including a movable divert conveyor that moves between a first position to convey a mail piece to an upper conveyor flight and a second position to convey a mail piece to a lower conveyor flight;

a bin module which receives the scanned mail pieces from the splitter conveyor, which bin module includes upper and lower bin sections, wherein each bin section comprises a row of bins and an associated series of tiltable conveyor sections comprising the upper and lower conveyor flights, which tiltable conveyor sections are actuated to drop a mail piece into the associated bin, each of the tiltable conveyor sections having first and second ends and being pivotable around the first end to incline the conveyor section to direct mail pieces into an associated bin, each of the bins comprising an impact wall, an inclined moveable stacking platter, a side wall and an upper wall, the upper wall extending downwardly into the path of mail pieces entering the bin to direct mail pieces entering the bin downwardly into the bin and wherein the impact wall is inclined toward the stacking planer and toward the side wall to align mail pieces entering bin and impacting the impact wall; and a control system which tracks each mail piece as it moves from the scanner to the bins and controls operation of the divert conveyor and the tiltable conveyor sections so that each mail piece is sorted to a predetermined bin based on the sorting information read by the scanner.

14. The mail sorting machine of claim 13 further comprising a sensor for detecting the volume of mail pieces present in the bin and signaling the control system when the volume of mail pieces in the bin reaches a predetermined level.

15. A mixed mail sorting machine adapted to sort mail pieces of varying thickness, comprising:

a feeder that receives a stack of incoming mail pieces and outputs the mail pieces one at a time in a vertical position;

a scanner that receives mail pieces from the feeder and scans each mail piece in a vertical position to read sorting information thereon;

a transport device that receives mail pieces from the scanner, the transport device including a deflector defining a substantially semicircular path through which the transport device transports mail pieces, the deflector defining an input end and a discharge end of the transport, the deflector being configured to turn mail pieces received by the device from a first transport direction substantially aligned with the input end to a second transport direction substantially aligned with the discharge end;

a reorientation conveyor that receives the scanned mail pieces from the transport device and reorients each mail piece from a vertical to a horizontal position;

a bin module which includes upper and lower bin sections, wherein each bin section comprises a row of bins and an associated series of tiltable conveyor sections which are actuated to drop a mail piece into the associated bin;

a diverter that diverts each mail piece from the reorientation conveyor to one of the series of tiltable conveyor sections of the bin module;

a control system that tracks each mail piece as it moves from the scanner to the bins and controls the operation of the diverter and the tiltable conveyor sections so that each mail piece is sorted to a predetermined bin based on the sorting information read by the scanner; and means for permitting mail pieces of varying thickness to pass through the mixed mail sorting machine.

16. The mixed mail sorting machine of claim 15 wherein the scanner includes a pair of opposed conveyor belts for carrying mail pieces past the scanner, and the means permitting mail pieces of varying thickness to pass through the mixed mail sorting machine comprises a plurality of resilient rotating members positioned adjacent and outside of one of the conveyor belts of the scanner, the resilient rotating members engaging the one conveyor belt to retain mail pieces between the conveyor belts as the mail pieces are transported past the scanner.

17. The mixed mail sorting machine of claim 15, wherein:

the diverter further comprises a divert belt conveyor configured to receive and convey horizontally positioned mail pieces from the reorientation conveyor, the divert belt conveyor having front and rear ends and being pivotable around the front end from a horizontal to an inclined position, and the means permitting mail pieces of varying thickness to pass through the mixed mail sorting machine comprises a plurality of resilient rotating members positioned above the divert belt conveyor, the resilient rotating members retaining mail pieces between the members and the divert belt conveyor as the mail pieces are conveyed by the belt conveyor.

* * * * *